United States Patent [19]

Robinson et al.

[11] 3,970,183

[45] July 20, 1976

[54] RANDOM ACCESS LINE PRINTER

[75] Inventors: Prentice Robinson, Pelham; Paul S. Ramsden, Jr., Hudson, both of N.H.

[73] Assignee: Centronics Data Computer Corporation, Hudson, N.H.

[22] Filed: June 5, 1974

[21] Appl. No.: 476,581

[52] U.S. Cl. ..... 197/1 R; 197/19; 197/84 A; 340/172.5

[51] Int. Cl.[2] ..... B41J 3/04

[58] Field of Search ..... 197/1 R, 19, 20, 82, 197/84 A, 60, 65, 66, 18; 340/172.5

[56] References Cited

UNITED STATES PATENTS

| | | | |
|---|---|---|---|
| 3,690,431 | 9/1972 | Howard | 197/1 R |
| 3,703,949 | 11/1972 | Howard et al. | 197/1 R |
| 3,752,288 | 8/1973 | Detig et al. | 197/1 R |
| 3,789,971 | 2/1974 | Deyesso et al. | 197/18 |
| 3,802,544 | 4/1974 | Howard et al. | 197/1 R |
| 3,834,505 | 9/1974 | Fowler et al. | 197/1 R |
| 3,854,563 | 12/1974 | Cowardin et al. | 197/1 R |

*Primary Examiner*—Ralph T. Rader

*Attorney, Agent, or Firm*—Ostrolenk, Faber, Gerb & Soffen

[57] ABSTRACT

An impact printer of the dot matrix type capable of printing in either the forward or reverse direction. Means are provided for determining the position of the print head at any given instant. Upon completion of a line of print the print head is abruptly halted. The next line of characters is examined to determine the end points of its character field. Comparisons are made to determine whether the print head lies within or beyond the end points. In cases where the print head lies beyond the end points of the character field, the printing occurs by moving the head in a direction toward the closest end point and then printing. If the print head occupies the location between the end points the position of the head is loaded into a pair of counters which are simultaneously counted up and down respectively. The outputs of the counters are continuously compared against the values representing the end point locations whereupon the first favorable comparison determines the shortest distance of print head travel for starting printing. High speed electronic circuitry is provided for storing data representing the next line to be printed in both forward and reverse formats whereupon the decision as to the direction in which data is printed automatically controls the appropriate storage medium.

Novel video detection means is provided both for determining the direction of head movement at any instant and for controlling the printing positions. The use of delayed strobes derived directly from the video control allows printing to start immediately from the rest position, and provides accurate registration of delayed strobes relative to strobe pulses regardless of the velocity of the carriage.

The printer has the ability of printing expanded characters and includes electronic circuitry to prevent data in the expanded character format from being lost in cases where the inputted data representing the expanded character format exceeds the print line capacity of the printer whereby any overflow will automatically be printed on the second succeeding line of print.

27 Claims, 32 Drawing Figures

132
131
133a
133b
133d
143
132a
103
134
134a
135
136
136a
136c
137
138
138a
139
140
140a
140b
141
142
113
132b
W
H
2d

134'
134"
141'
141"
145

134'
134"
135"
136
136
135"
142'
137'
2m
2m
141'
141"
139'
139"
145
142'
138'
140
138"
140

145
138'
141'
141"
138"
139'
139"

303 - SELECT LAMP
PRIMEC
LD
PRIME
DSCR
DCPRM
CLKTBI
304-SPKR
UCC
SW1
TBBM
REMLF
EXCHST
LF
DLVLF
PTFWD
PTREV
PMSOL
DCPRM
OSC 330
SCXT
301
302-1
302-8
302-9
DS1
DS2
DS3
DS4
DS5
DS6
DS7
DS8
IP
LFOC
GDSTB
DSC
REMLF
TDFSW
SELSW
DE
CSBY
DSTA
VTH
FFH
OSC
DLYLF
LF
CSLF
UPSC
BELL
CSBSY
DSTTA
OSC1
OSC2
+5V
-12V
-12V BUSY
ACK
FAULT
SLC
+0

799
799a-1
799c
FWDD4
NULL
CRRV
716
15ZCC
779a-1
RS1
RS2
RS3
RS4
719
352a
352
BSR1
BSR2
BSR3
BSR4
SR1
SR2
SR3
SR4
SR5
SR6
SR7
SR8
DSR1
DSR2
DSR3
DSR4
DSRL
DSR8 (TBB)
SR8 (TBB)
350
351a
351a-2
351b-2
351b
351b-1
354-8
355-8
353
331
to +5V-12V
VDD
VSS
VGG
CLR
PRMSR
PRIME
RECCON
CLHTTB
CLHTTBR
DS1
DS2
DS3
DS4
DS5
DS6
DS7
DS8
DMC
CRFD
357
DCSP
356
714
2B
TB1M
TB2M
TB3M
TB4M
TB5M
TB6M
TB7M
TB8M
+5
to
±0
FWDDV
RS5
RS6
RS7
RS8
352b

SEE FIG. 3b
DMC
DS1
DS8
CLHTTB
PRIME
RECON
CLHTBR
OSC51
132SC
SPNCLH
PTREV
CLHTREV
133CC
CRRV
PRIMEC
SYNSPN
OSC1
SPNCLR
EOSPN
133RC
CCEN
ZBCOMP
ZBCLK
DMCCLH
GOFWD
CLHTBI
CLHTSP
DCPRM
CHFWD
PTFWD
CSSPN
RTL
CSBSY
RVDAT
DSRB
SRB
DSCR
OSC2
PRIME

450
+5V
UPDN
H1
HC1D
H2
HC2D
H3
HC3D
H8
HC8D
450a
PRIME 4
LOAD
133cc
81cc
+5
454
454b
CRFD
453
PRIME C
452
464-2
464-1
464-3
464-4
464-6
RC1
RC2
RC3
RC4
RC5
RC6
RC7
RC8
455b
455a
455
464
465
OSC2
CCEN
OSC 51
460
UCC
456
457
458
PRIME
+5V
OSC 52
459
CCEN
OSC52
±0
461
CLEAR
RC1 RC2
RC8
463c
463
463b
LCEN
463a
HC1D
HC2D
HC8D
LC1
LC2
464
HLL
HEL
HGL
TO 476
LC8
PRIME 4
450a
PRIME4
451
+5V
H8 H3 H2 H1
UPDN
HC1U
HC2U
HC3U
HC8U
LOAD
PRIME 4
469
OSC2
CCEN
470
472b
DCSP
+5V
472a
472
472c
PRIME C
471b
+5V
+5V
468a
DCSP
467
468b
468
DCSP
471a
471
471c
468a
468c
LCEN
474
473
PRIME C
HC1U
HC2U
HC3U
HC8U
RC1
RC2
RC3
RC8
476
HLR
HER
HGR

515
CLHSP
533
547
CLEN
FROM 530d (FIG. 4c)
DCSP
514
OSC 2
532
EXCLEN
FROM 531b (FIG 4c)
PRINT
513c
513d
+5V
513
516
516b
512b
RV DAT
516a
516c
512
GO FWD
512a
510
511
OSC2
FWDDV
OSC2
FWDDV
LOAD
506
505
537c
537b
537
537a
536
536c
536a
536d
534
535
538
539
PRELD
ENLD
OSC1
PRIME
PRELD
H&L
H&R
OSC1
540c
FWDEN
540
540a
540b
541

PRIME 2
640
638c
PRIME 2
OSC2
+5V
638
638a
637b
638d
OSC1
638b
639
637
637c
RTPSW
+0
637a
670
ENLD
635b
RTZ
RTZ
635d
PRIME2
PWRPRM
EOJ PNI
TO 643 & 644 (FIG 4f)
DC.PRM
+5V
635
635a
635c
636
632
633
CLHEX
631
+5V
EXCHST
R1
C1
+0
626b
627
630
629b
628
626a
626
+5V
+5
630a
629
629a
625
PMSOL
PRINT
+5V
SELSW
PRIME2
PWRPRM

RTPSW
SEL-SW
OSC1
+5V
650
649
643
OSC1
648
644
+5
647
647a
647b
647c
646
645
OSC1
OSC1
653
652
651
654
654a
654b
PRIME
PRIME
DC.PRM
DC.PRM
655
656
C2
R2
R3
±0
657
658
DC.PRM
LD
FROM 631 (FIG. 4e)
LD
664
662
667c
661
661a
661b
660b
660c
660
660a
+5V
659
EOPSW
RTPSW
CTRSTB
PRIME
663
665a
665b
665
665a
+5V
PSW
PRIME

617
FWDCLD
FWDCLD
618
BRAKE
616
REVCLD
REVCLD
619
615
VIZON
614
-12V
+5V
613
612
RTPSW
+5V
EOPSW
CLEN
608
611
RTL
602
610
OSF
OSR
606
609
OSR
OSF
FW
605
604
FW
602
603
WAIT
FWDDV
FWDDV
601
WAITCL
PRIME
620
622
621
HER
FWDCLD
HEL
REVCLD

+5V
CHANC2
CHANC2
PRIME2
CH10SC
CH20SC
CHAN21
CHAN$\phi$1
CHAN$\phi$2
CH10SC
CH20SC
FWD
STBDLY
PRIME2
FWD
FWDEDCR
RVEDCR
DELSTA
DELSTB
STBDLY
1-20 µs
CH20SC
STROBE
STROBE
CTRSTB
CTRSTB
CH10SC
W1
W2
P1
P2

OCTAL "5"
CLOCK UP
CLOCK DN
PRIME 2
FWD DV
CLRREV
CLR FD
ECSTB2
ECSTB1
FROM 725 (FIG. 5b) RVEDCH
FROM 726 (FIG. 5b) FDEDCH
CH105C
CH205C
DCW0
DCW1
DCW2
DCW3
DCW4
DCW5
H1
H2
H3
H8

RANDOM ACCESS LINE PRINTER

The present invention relates to printers and more particularly to high speed impact printers of the dot matrix type having a bidirectional print capability and being capable of printing succeeding lines in the shortest possible elapsed time and with the minimum amount of head movement.

BACKGROUND OF THE INVENTION

Line printers of the dot matrix type are typically comprised of a print head movable across a paper document and being capable of printing selected dot positions in a dot column. In one typical embodiment, the dot column has seven dot positions which may be selectively printed in any combination. Five adjacent dot columns typically comprise a single alphanumeric character or other symbol thereby creating a 5 × 7 dot matrix wherein the selected printing of the 35 possible dot positions cooperatively form the desired alphanumeric character or other symbol. The printer in its most general form, moves the print heat to the left-hand-most position of the paper document and advances the paper document in readiness for printing the next line (normally referred to as a carriage return-line feed) operation. The print head then moves across the paper document successively printing dot columns at selected positions along the line until it reaches the right-hand end of the paper document thereby completing a line of print. The print head is then moved in the reverse direction, typically at a speed faster than the printing speed, back to the start or left-hand-most position and the paper document is again advanced in readiness for printing the next line.

Numerous techniques and apparatus have been developed to increase printing speeds, one of which is the bidirectional printer which is capable of printing a line of print as the print head moves in either the forward or reverse direction. In operation, every other line of print is produced by moving the head in the forward direction and every intervening line of print is produced by moving the head in the reverse direction thereby eliminating the need for a carriage return operation so that only the paper document need be moved upon the completion of each line of print to advance the paper document in readiness for printing the next line.

The above technique constitutes the most efficient manner presently known for operating line printers in applications wherein the printed matter consists of a large number of lines with each line being substantially filled to capacity with alphanumeric characters and/or other symbols. However, a number of applications exist wherein the data field of a line of print occupies only a fractional portion of a line. With graphic formats of this type, the bidirectional printer nevertheless causes the print head to continue to move over the remainder of the line until it reaches the end of the paper document toward which it is moving, at which time it stops, reverses its direction, and prints the next line. If, for example, the next line of print likewise occupies a mere fraction of the entire length of the line, the movement of the print head over the remainder of the unprinted length of line and reversal of the print head over a significant portion of the next line of print before actually initiating printing becomes wasteful of printing time thereby resulting in a significant reduction in the printing speed of the printer.

BRIEF DESCRIPTION OF THE INVENTION

The present invention is characterized by providing a high speed impact printer of the dot matrix type in which non-printing movement of the print head is substantially eliminated or is reduced to an absolute minimum.

The printer of the present invention continuously monitors the position of the print head, as well as monitoring the direction of movement at any given instant. Upon completion of either a full or fractional line of print, the print head is abruptly halted. Binary data representative of the next line of print is inputted and stored in the printer which develops binary signals representative of the end points of the data field. These signals are compared with the present position of the print head to determine whether the print head lies beyond or between the aforementioned data field end points. In cases where the print head lies outside of the data field end points, the print head is moved toward the direction of the closest end point at which time the video registration means of the printer automatically and instantaneously initiates printing as the print head passes the closest end point and enters the data field. To facilitate printing in either direction, the data representing the next line of print, after being entered into the printer, is stored in a first register in a normal format. The register is spun through one full cycle whereby the decision as to which direction the printing will occur is determined. In forward printing data is outputted from the first register to operate the character generators and ultimately the print head solenoids.

If the comparison operation shows the print head position to lie closer to the right-hand end of the character field, the first register is spun 132 more times to enter the binary data in a second register in reverse order. Data then is stepped out of the second register during printing to operate the character generator.

In situations where the print head lies between the data field end points, binary information of the present print head position is loaded into first and second registers which are respectively counted up and down. The outputs of the registers are respectively compared against the left and right-hand end point information and the first comparison which occurs determines the shortest distance required for print head movement to start printing the next line of print whereupon the print head will move toward the appropriate end point location, moves slightly beyond the location to be abruptly halted and then reverse its direction and start print "on the fly" as it passes the closest end point.

In situations where the present head location is exactly equal to either the left or right-hand end points of the data field, the head will be "kicked" slightly in the direction away from the data field, be promptly reversed and start printing "on the fly" as soon as the print head is in registry with the closest end point.

The video information is detected by a pair of optical channels arranged out of phase with one another so that a precise count of the print head position in the direction of movement is automatically and instantaneously obtained.

The printer of the present invention further has the capability of printing expanded characters and incorporates circuit means for preventing binary data representative of an expanded character format from being lost in instances where the inputted data representative of the expanded character format exceeds the printing capacity of a line of print.

The printer of the present invention further has the capability of printing in the graphic mode which enables printing at all positions including those which typically represent a space between adjacent characters, which capability is also utilized in the graphic mode in the reverse direction.

BRIEF DESCRIPTION OF THE INVENTION AND OBJECTS

It is therefore one object of the present invention to provide a novel bidirectional printer of the dot matrix type which is capable of reducing movement of the print head during non-printing periods to an absolute minimum.

Another object of the present invention is to provide a novel bidirectonal printer of the dot matrix type having novel means for determining the position and direction of movement of the print head at any given instant.

Still another object of the present invention is to provide a bidirectional printer of the dot matrix type having novel means for abruptly halting the print head upon completion of the last character on a line to be printed regardless of character position, of determining the present position of the print head relative to the data field of the next line of print and of moving the print head over the shortest possible distance to initiate printing of the next line.

Still another object of the present invention is to provide a novel bidirectional printer of the dot matrix type which automatically and instantaneously initiates printing "one the fly" as the print head moves into the data field and which uses a novel delayed strobe technique to permit initiation of printing from the rest position of the print head.

Still another object of the present invention is to provide a novel bidirectional printer of the dot matrix type which is capable of printing in either the character or graphic mode and utilizes a novel scheme for printing at any position along a line of print regardless of the direction of printing or the printing mode being employed at any given instant.

The above as well as other objects of the present invention will become apparent when reading the accompanying description and drawings in which:

BRIEF DESCRIPTION OF THE FIGURES

FIG. 4*f* shows the circuitry employed for generating still another prime condition for initializing the printer circuitry and shows the circuitry employed for providing a lamp indication of a failure in the operation of the registration apparatus.

DETAILED DESCRIPTION OF THE INVENTION

Figure 1:
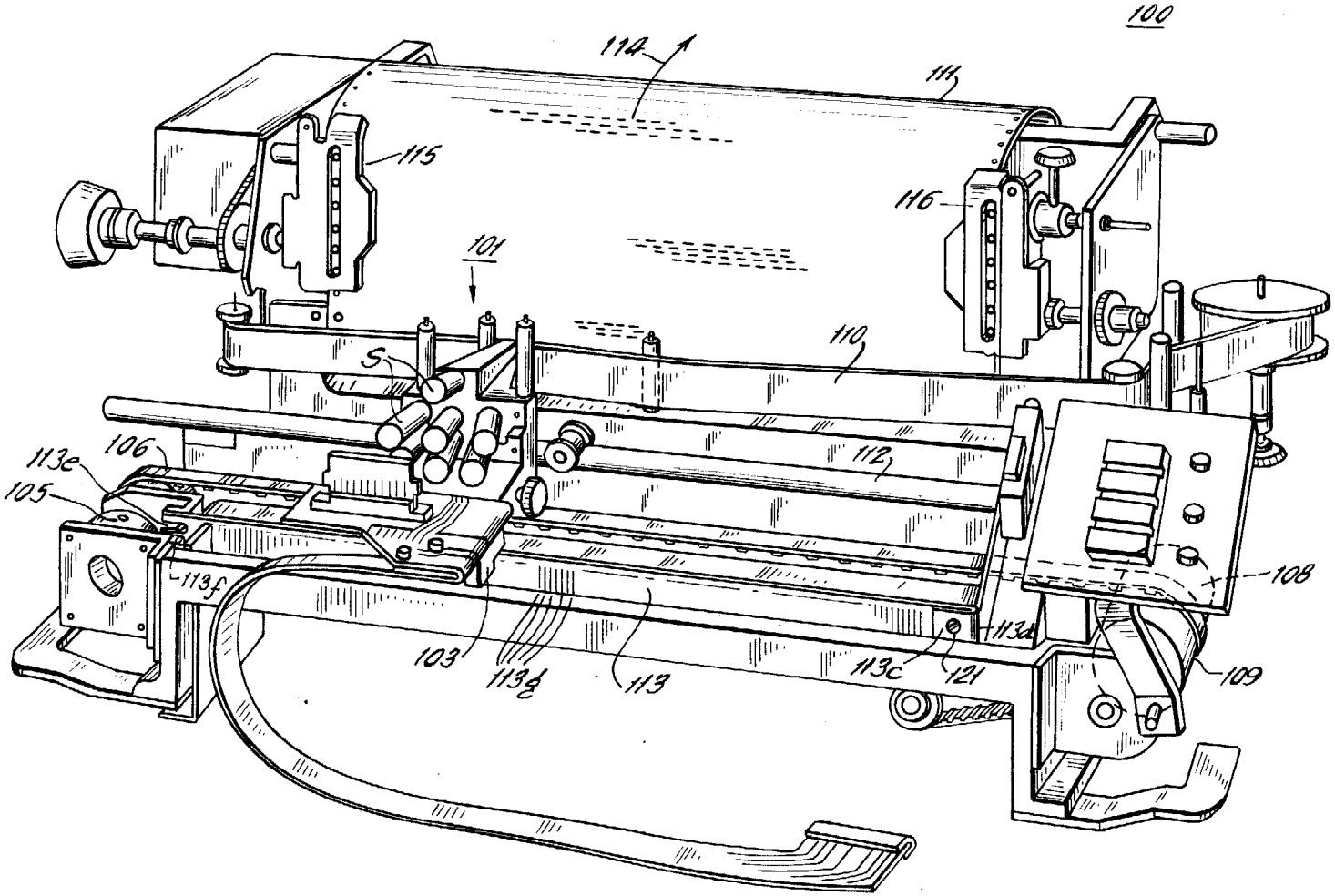
FIG. 1 is a perspective view showing the mechanical aspects of a printer embodying the principles of the present invention.

FIG. 1 shows a simplified version 100 of the printer which comprises a print head assembly 101 mounted upon carriage 102. The print head assembly is provided with seven solenoids S each utilized to selectively print seven vertically aligned dots (i.e. a "dot column"). Copending application Ser. No. 179,457 filed Sept. 10, 1971, now U.S. Pat. No. 3,833,105, shows a typical print head construction. The carriage is secured to a closed loop timing belt 106 by clamp 107. Belt 106 is driven by a motor (not shown) whose output shaft is selectively coupled to belt 106 by either a forward clutch 108 or a reverse clutch 109.

An inked ribbon 110 is positioned in front of print head 101 and spans paper document 111. The selective energization of solenoids S of the print head causes the ribbon to impact the paper document 111 and form the "dot column" patterns.

The print head forms alphanumeric characters or other symbols, each printing five (or nine) dot columns which collectively form a character. The carriage 102 rides along guide tracks 112 (only one is shown in FIG. 1) in moving in the forward and reverse directions.

The registration or accurate placement of the dot columns is assured by a photo-sensing device comprised of a light source and phototransistor assembly 103 (to be more fully described) which cooperates with a registration strip 113 having first and second displaced sets of vertically aligned transparent slits 113*a*, and 113*b* as will be shown best in FIGS. 2*l* – 2*o* and the related description. The optical assembly comprised of a light source and a phototransistor are positioned on opposite sides of registration strip 113 to generate "video" pulses whenever they pass one of the slit arrays 113*a* and 113*b* to permit "full-step" dot columns to be printed. "Half-step" dot columns for printing 9 × 7 matrix characters are printed in between full dot columns under the control of a logical circuitry to be more fully described.

The paper document is moved in the direction of arrow 114 by pin feed mechanisms 115 and 116 under control of form feed, line feed and top of form signals to be more fully described. The pin feed mechanisms are selectively coupled to the motor M through cluth mechanisms (not shown) for purposes of simplicity) which are activated to provide the appropriate paper movement.

The printer, in addition to providing simultaneous operation of the print head solenoids S also provides for printing in the forward (left to right) direction, as well as the reverse (right to left) direction. Although the data representing the characters and other symbols to be printed is always entered into the printer in the same order, logical circuitry, including forward and reverse registers is provided to assure that the correct order of dot column patterns are presented to the print head solenoids regardless of the direction of movement of the print head during printing.

The operation of the printer mechanism as shown in FIG. 1 is such that on start-up of the machine, a PRIME signal is generated which initialized all of the circuitry and generates a return-to-left (RTL) signal which causes the motor and the reverse clutch to operate to return the print head 101 to the left-hand margin of paper document 111. Once this is accomplished, the printer is ready to accept data from an external source such as, for example, a communications link or a computer.

Data is inserted in the form of binary words of at least six binary bits capable of representing up to 64 combinations which may, for example, represent the 26 letters of the alphabet, the numeric characters 0–9, punctuation marks and other symbols. The loading of the binary words representative of a line of characters or other symbols to be printed is preceded by insertion of a dummy character into the register. Once the dummy character reaches the right-hand most stage of the forward register (to be more fully described), the printer initiates operations preparatory to printing. The registration strip 113 and lamp source and photodetector assembly cooperate with a head counter and a pair of up and down counters to be more fully described to provide a binary count representative of the head position relative to the paper document.

The binary words loaded into the forward register are re-circulated once through the register which is of a recirculating type to provide two binary counts representative of the left and right-hand end points of the character field. These counts are compared against the count representative of the head position to determine in what direction printing should occur. With the head 101 at the left-hand margin of the paper document, this comparison operation will indicate that printing in the forward direction should occur.

The preferred embodiment described herein has a capability of printing 132 characters of a 5-column by 7-row dot matrix per line of print. Printing occurs by moving the head to the right so as to successively print dot columns. The successive printing of 5 dot columns constitutes the formation of a single character. Thereafter, a space is provided between the completed character and the next character to be printed which is likewise printed by the selective printing of five successive dot columns.

As soon as a line of characters has been printed, the brake mechanism 105 is energized to abruptly bring the print head to a halt. For purposes of describing the capability of the printer, it will be assumed that character positions will be numbered in ascending order from the lefthand margin to the right-hand margin of the paper document, thus the left-hand-most character will be printed at character position 1, the next character is character position 2, and so forth, with the right-hand-most character position being position number 132. Let it be assumed that the last printed line of characters had a character field terminating at its right-hand end at character position 60. The head will be brought to a half approximately five positions to the right of the right-hand end of the character field or position 65. A binary representation of this count is retained in the print head counter (to be more fully described).

Upon completion of the line of print, the printer is now ready to receive the next group of binary words representative of the next line to be printed. The binary words are shifted into the forward register which will then be re-circulated once to determine the end points of the character field. These end points wll then be compared against the binary word in the head counter representative of the present head position. Let it be assumed that the right-hand end of the character field occupies character position 70. This means that the print head is five positions to the left of the right-hand end of the character field. A comparison of the character field end points against the head position will not indicate that the head lies between the end points, i.e. within the character field. As soon as this indication is recognized (by comparators to be more fully described), which indication occurs substantially instantaneously, the count representing the head position which was previously loaded into a pair of bidirectional registers is then simultaneously incremented and decremented respectively, at the same rate. The print head carriage is held motionless while the outputs of these two counters are compared against counts representing the end points of the character field and are basically "in a race" as to which counter will compare first with the respective end point counts. In the example given, the counter being incremented will be the first one to develop a count equal to the count of the rignt-hand end point of the character field. A signal is developed to indicate that the head must move in the forward direction. As soon as the head moves, the head counter is incremented and when its count is equal to the character position of the right-hand end of the character field, the forward clutch will be de-energized and the brake will be energized. The head will be brought to a halt approximately five character positions to the right of the right-hand end of the character field. Comparison of the head count at this time with the end points of the character field now indicates that the head is positioned to the right of the right-hand end of the character field indicating that printing in the reverse direction is dictated. The brake is de-energized, the reverse clutch is energized and the head starts to move in the reverse direction. As soon as the count in the head counter is equal to the count representative of the right-hand end of the character field, printing is initiated "on the fly". The line will then be printed in the reverse direction through utilization of the reverse register. Upon completion of the line of characters which has been printed in the reverse direction, the reverse clutch is de-energized and the brake is energized bringing the print head to a halt approximately five characters to the left of the left-hand end of the completed character field. The data for the next line of characters to be printed is then loaded into the forward register, the forward register is spun completely one time to ascertain the end points of the character field loaded therein and a determination is made of the direction of movement of the head for printing of the next line. Summarizing the operation, whenever the head lies to the left of the left-hand end of the character field, printing will always occur in the forward direction. Conversely, whenever the print head lies to the right of the right-hand end of the character field, printing will always occur in the reverse direction. Whenever the head lies within the data field, i.e. between the end points of the character field, the head count is loaded into a pair of registers which are simultaneously incremented and decremented respectively, and continuously compared during the incrementation and decrementation operations to see which count will first equal the end point to which it is being compared. The first comparison to occur dictates the direction of movement of the head so as to move the print head either beyond the left or the right-hand end point and then to abruptly halt the head, reverse its direction of movement and print "on the fly" as it passes the nearest end point of the character field.

The printer also has the capability of printing 9 × 7 dot matrix characters which consist of 9 dot columns and 7 dot rows. This is accomplished through the use of a pair of character generators (to be more fully described) which alternately print "full step" and "half step" dot patterns until nine dot columns are printed. The "full step" dot columns are printed upon the occurence of each strobe pulse developed by channel one of a two channel registration assembly. The "half step" dot columns, developed by channel two, are printed at a position equidistant from the "full step" dot patterns immediately to its left and to its right, by a delay strobe signal to be more fully described.

The printer has a further capability of printing expanded characters which consist of double width characters in which, for a 5 × 7 dot matrix, each dot column is printed twice to thereby print a character of double the normal width. Segmented characters and graphic patterns may also be printed through the use of "graphic" character generators which consist of read-only memories having dot patterns which form segments of double or triple height characters, for example. In order to be able to print segmented characters (i.e. double or triple height characters) the DCWO time normally utilized to provide a space between adjacent characters or normal size is now utilized to print a dot column, thereby giving the printer the capability of printing a dot column in any dot column position across a line of print. Additionally, the printer may print graphs or other images through the use of this capability.

REGISTRATION SYSTEM

As is shown in FIG. 1 of the present application, an elongated registration strip 113 is mounted between a pair of brackets B,B secured to a forward member of the printer main frame. The registration strip is aligned so as to be substantially parallel to the printing surface of paper document 11. The carriage 102 upon which the print head is mounted, is provided with an assembly 103 which cooperates with the registration strip to provide what will hereinafter be referred to as STROBE pulses which control the firing of the print head solenoids at the appropriate time. In the example given hereinabove in which the printer is capable of printing 132 5 × 7 matrix characters, since each character consists of five dot columns plus a space therebetween, there are 792 dot column positions across the printing area of the paper document. This means that a registration strip having 792 slits must be provided. For standard 5 × 7 matrix characters, the printer has a capability of printing ten characters per inch. Since there are six dot column positions per character, the registration strip 113 must be provided with 60 slits per inch. Thus, the center line distance between slits is 0.0167 inches. The width of a typical slit is 0.0060 inches measured in the direction of travel of the print head.

The registration strips utilized in the prior art are formed of plastic of a thickness sufficient to provide a registration strip which is rigid and will not bend. The photosensitive emulsion is treated by a photochemical process through the use of a mask which forms transparent slits of a spacing referred to hereinabove with opaque regions or "pickets" interspersed between each pair of adjacent slits. This arrangement necessitates an exacting and laborious process.

The present day registration apparatus utilizes a light source positioned to one side of the registration strip, which light source is mounted to the print head carriage assembly 102. A light sensitive photodetector device also secured to the print head carriage 102 has a fiber optics bundle with its input end positioned adjacent the registration strip 113 and with its output end directing light incident upon the fiber optics bundle to the photodetector mounted on top of carriage 102. Operation of the registration apparatus is such that as the light source passes a picket and begins to move across a transparent slit, the light passes through the slit, is picked up by the fiber optics bundle and is directed to the photodetector device which thereby becomes energized. Amplification of wave-shaping means is utilized to develop a pulse of sufficient definition to provide precise triggering of the print head solenoids S.

In order to greatly simplify the fabrication of registration strips while at the same time retaining the required dimensional precision, a registration strip has been developed which requires one-half the number of transparent slits. This is accomplished by providing associated circuitry (to be more fully described) which is utilized with the registration strip and optical components so as to generate a trigger pulse at both the leading and trailing edge of a strobe pulse with each of these pulses being utilized for strobing the solenoids.

Figures 2A, 2B, 2C, 2P:
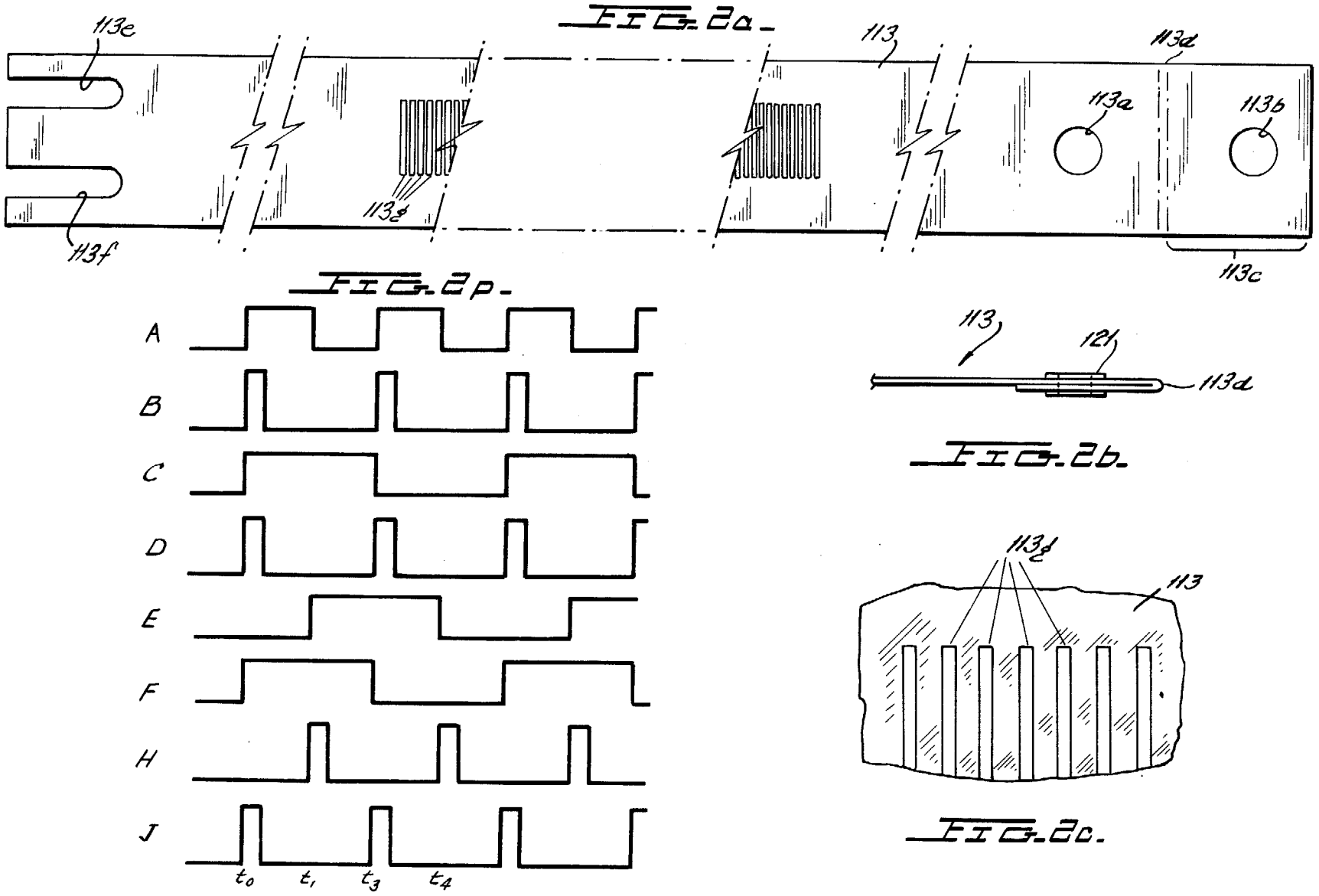
FIG. 2*a* shows a plan view of a registration strip employed in the printer of FIG. 1.
FIG. 2*b* shows a partial top view of the registration strip of FIG. 2*a*.
FIG. 2*c* shows an exploded view of the transparent slit pattern of FIG. 2*a*.
FIG. 2*p* shows a plot of waveforms useful in describing the operation of the registration techniques of the present invention.

FIG. 2*a* shows a registration strip designed in accordance with the principles of the present invention. Registration strip 113 is an elongated plastic member substantially thinner than prior art registration strips and has a thickness preferably of the order of 0.007 inches. The plastic material may, for example, be MYLAR, a registered trademark identifying a particular type of plastic. The registration strip 113 has a substantially rectangular configuration and is provided with a pair of openings 113*a* and 113*b*. To mount the registration strip upon the printer frame, an end portion 113*c* of the registration strip is folded over along a line 113*d* (note also FIG. 2*b*) so as to align openings 113*a* and 113*b*. Bracket 121 is secured to the registration strip and has a fastening member (not shown) passing through aligned openings 113*a* and 113*b*.

The left-hand end of registration strip 113 is provided with a pair of elongated open ended slots 113*e* and 113*f* which are secured to a suitable bracket (not shown for purposes of simplicity). The depth of slots 113*e* and 113*f* is sufficient to enable the registration strip 113 to be stretched between the mounting bracket so as to be reasonably taut.

The intermediate portion of the registration strip 113 is provided with a uniform pattern of vertically aligned elongated slits 113*g* preferably formed by means of a photographic process. The center line to center line distance between slits is twice as great as that set forth hereinabove in connection with present day registration strips. Although the preferred embodiment described herein teaches a printer having a capability of printing 132 5 × 7 matrix characters per line, it should be understood that any greater or lesser number may be printed by appropriate modification of the printer. Similarly, the registration strip may be provided with a greater or lesser number of transparent slits 113*g* dependent upon the character capacity of the particular printer. In the application given, since strobe pulses for operating the print head solenoids are developed at both the leading and trailing edges of each slit, only 397 transparent slits 113*g* are required for a printer having a character capacity of 132 characters per line. The number of transparent slits employed provide proper registration of both "full-step" and "half-step" dot column patterns regardless of the direction of movement of the print head during a printing operation.

Figures 2D, 2E, 2F, 2G, 2H:
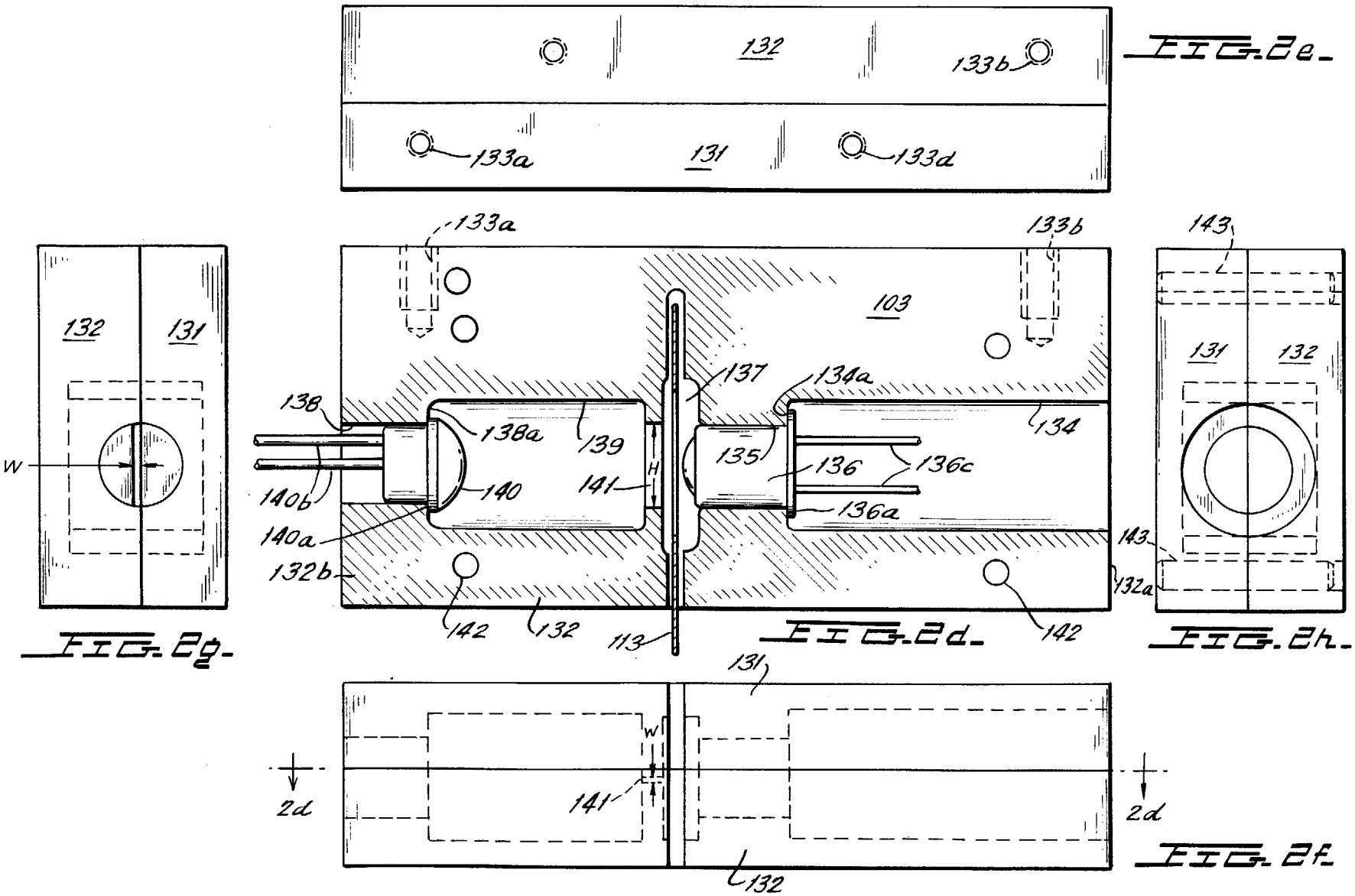
FIGS. 2*d*–2*h* show various views of an optical assembly employed with the registration strip of FIG. 2*a*, FIG. 2*d* showing a view of one housing portion looking in the direction of arrows 2*d*—2*d* of FIG. 2*f*.
Figure 2I:
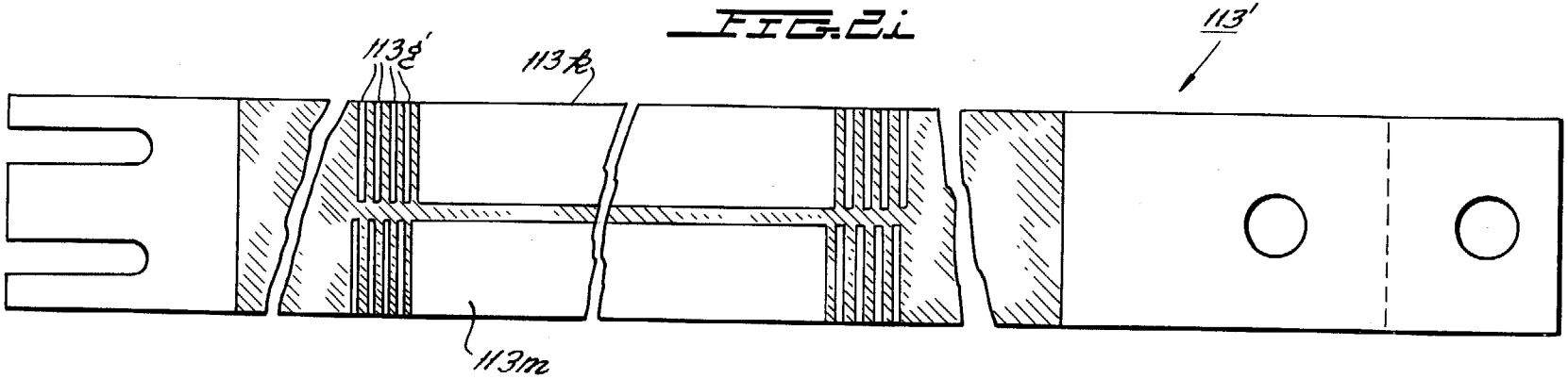
FIG. 2*i* shows another preferred embodiment of a registration strip in plan view.
Figure 2K:
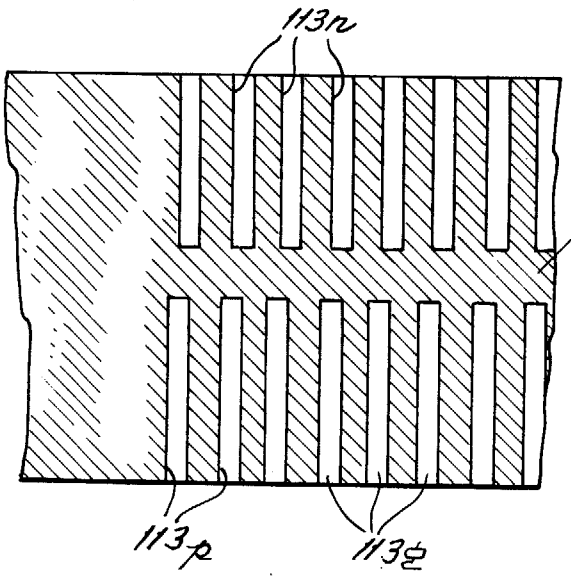
FIG. 2*k* shows an exploded view of the registration slit arrays of FIG. 2*i*.

FIGS. 2*d*–2*h* show a novel optical assembly utilized with the registration strip of FIG. 2*a*. The optical assembly 103 is comprised of a housing having two molded portions 131 and 132, while FIG. 2*e* shows a top view. FIG. 2*d* shows the interior of housing portion 132 looking in the direction of arrows 2*d*—2*d* of FIG. 2*f*. Since both housing portions are substantially mirror images of one another, only the interior of housing portion 132 will be described for purposes of simplicity.

Molded housing portion 132 is provided with a pair of threaded openings 133*a* and 133*b* along its top surface for securement to the underside of print head carriage 102. The right-hand portion of housing 132 is provided with an elongated hollow cylindrical opening 134 communicating with the right-hand edge 132*a* of the housing. The inner end of hollow opening 134 terminates at a shoulder 134*a* which extends between opening 134 and a short cylindrical hollow portion 135 of reduced diameter. A light emitting diode 136 is positioned in hollow opening 135 so that its base portion 136*a* which forms an outwardly directed flange, rests against shoulder 134*a*. A pair of leads 136*c* serve as the means for connecting the light-emitting diode to an energy source.

The hollow portion 135 communicates with a hollow slot 137 extending in the vertical direction and having a thickness sufficient to permit registration strip 113 to substantially freely pass therethrough.

The left-hand end of housing 132 is provided with a hollow cylindrical bore 138 which communicates with the left-hand side 132*b* of housing 132. Cylindrical bore 138 opens into a hollow cylindrical bore 139 of substantially enlarged diameter, there being a shoulder 138*a* being positioned therebetween. A photodetector device 140 is positioned so that a shoulder 140*a* provided thereon rests against shoulder 138*a*. The leads 140*b* of photodetector 140 extend through bore 138 to facilitate connection to appropriate circuitry. Both the light-emitting diode 136 and the photodetector 140 may be expoxied or otherwise cemented into position.

The chamber 139 communicates with vertically aligned slot 137 through a vertically aligned slot 141 which has a height H of the order of 0.175 inches, as can best be seen in FIG. 2*d* and which has a width W which, as can best be seen in FIGS. 2*d* and 2*g*, is of the order of 0.006–0.008 inches. The housing half 132 is provided with four openings 142 which cooperate with coaligned openings in housing half 131 for force-fittingly receiving pins 143, only two of which are shown in FIG. 2*h* for purposes of simplicity. These pins may, for example, be dowel pins which are force-fittingly inserted through the coaligned openings to join the housing halves to one another. Obviously, the light emitting diode 136 and photodetector 140 are inserted and secured into place before joining the housing halves. The tapped openings 133*a* and 133*b* of housing half 132 and the similarly tapped openings 133*c* and 133*d* of housing half 131 are utilized to secure the optical assembly 103 to the underside of the print head carriage. It has been found that even though the registration strip is not completely taut, that the assembly shown still nevertheless provides precise strobe pulses sufficient for very accurate placement of dot columns printed by the print head solenoids. The narrow slit 141 serves as a mask to prevent light from more than one transparent slit from entering into chamber 139. The double width transparent slits utilized in the novel registration strip doubles the tolerance values which would otherwise be required in conventional registration strips. Relative to conventional registration strips, the leading edge of each slit (regardless of the direction of travel of the print head) lines up with the leading edge of a conventional slit while the trailing edge of the double width slit lines up with the leading edge of the next slit adjacent thereto (in the print direction) so as to maintain the same dimensional relationships while reducing the number of slits required by one-half.

The interior surface of chamber 139 may be coated with a reflective material to enhance and increase the amount of light reaching photodetector 140. By forming the housing in the configuration shown in FIGS. 2*d*–2*h*, it is possible to provide a precision component with close tolerances while at the same time significantly reducing fabrication complexity and costs.

The registration strip and optical assembly of FIGS. 2*a*–2*h* may be utilized to great advantage in both unidirectional and bidirectional printers. However, in order to provide a random access printing capability, it is necessary to be able to determine at any given instant the direction of travel of the print head. This is accomplished by the use of a modified registration technique in conjunction with logical decoding circuitry.

Figures 2L, 2M, 2N, 2O:
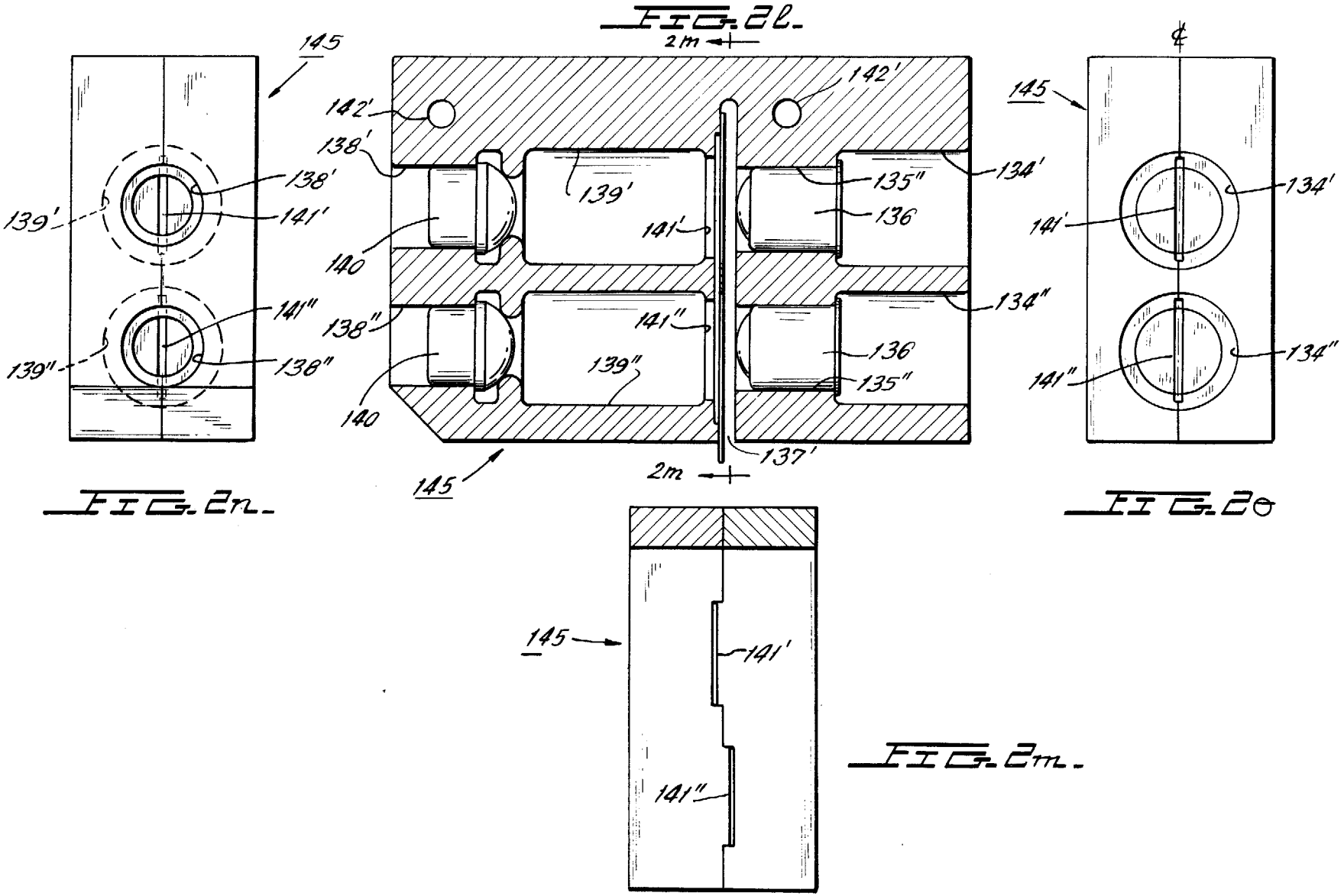
FIGS. 2*l* – 2*o* show various views of a dual slip optical assembly for use with the registration strip of FIG. 2*i*.

FIGS. 2*l*–2*o* show a dual slit optical assembly 145 which may be used with a registration strip of the type shown in FIG. 2. The dual slit assembly 145 is substantially similar to that shown in FIGS. 2*d*–2*h* except that a pair of optical assemblies are provided in the housing. Noting, for example, FIG. 2*l* housing half 132' is provided with first and second optical assemblies substantially identical to one another and comprising upper and lower bores 134' and 134'', smaller diameter bores 135' and 135'' each adapted to receive a light emitting diode 136; a vertically aligned slot 137'; upper and lower bores 138' and 138'' each adapted to receive a photodetector device 140; upper and lower chambers 139' and 139''; and upper and lower masking slits 141' and 141''. Openings 142' are provided in each housing half as shown in FIG. 2*l* for housing half 132' to receive pins for force fittingly joining the housing halves to one another. In the embodiment of FIG. 2*m* which shows a sectional view of the joined housing portions looking in the direction of arrows 2*m*—2*m* in FIG. 2*l*, the housing portions are arranged so that the upper and lower masking slits 141' and 141'' are offset from one another by a phase angle equal to 90° which relationship will be more fully described as set forth hereinbelow.

Since offset moldings of this nature tend to significantly complicate the molding of the housing halves, an alternative technique is shown in FIGS. 2*m* and 2*o* wherein the upper and lower masking slits 141' and 141'' are in exact alignment with center line CL. In order to provide the 90° phase angle offset with perfectly aligned masking slits 141' and 141'', the registration strip 113' is modified in the manner shown in FIGS. 2*i* and 2*k*. As can be seen from FIG. 2*i* the registration strip dimensionally is substantially identical to that shown in FIG. 2*a*. However, the registration slits are arranged so as to provide upper and lower registration slit arrays 113*k* and 113*m* which individually are substantially similar to the registration slit array comprised of slits 113*g* in FIG. 2*b*, and can be seen to be arranged such that the slits 113*g'* in upper array 113*k* are staggered so that their left-hand edges 113*n* each lie to the right of the forward edges 113*p* of slits 113*g''* in lower array 113*m*. In addition thereto, the upper and lower arrays are separated from one another by an elongated horizontally aligned opaque section 113*q* to further prevent any spillover of light between the upper and lower optical assemblies provided, for example, in FIG. 2*l*.

FIG. 2*b* shows a plurality of waveforms useful in describing the advantages derived from the novel registration techniques employed in the present invention. Waveform A represents a series of square pulses generated by present day registration apparatus. Thus, at time $t_o$ the pulse output goes high to indicate that the light source and cooperating photodetector are passing a slit. At time $t_1$ the output drops abruptly to indicate that the light source and cooperating photodetector have passed over an opaque "picket" positioned between a pair of slits. Succeeding square pulses of waveform A represent a passage of the light source and photodetector along the registration strip.

In actuality, the waveform A represents the ideal output of a photodetector. In actuality, the waveform will not be a perfect square pulse. As a result, the output of the photodetector is passed through appropriate amplification and wave shaping means to generate a narrow square pulse occurring just slightly after time $t_o$–$t_4$, which pulses are utilized to enable the firing of the print head solenoids. The leading edge of each square pulse can be seen to occur at the leading edge of each slit as shown by waveform B.

Waveform C represents the output of a photodetector of the type shown in FIG. 2*d* when employing a registration slip 113 of the type shown in FIG. 2*a*. Since the registration slits 113*g* are of double width, it can be seen that each positive going square pulse is twice as wide (measured in the time scale) as the pulses shown in waveform A. Through the use of an appropriate electronic circuitry (to be more fully described), enabling pulses for enabling the firing of the print head solenoids are generated at both the leading and the trailing edges of the square pulses shown in waveform C so as to generate square pulses of narrow pulse width shown by waveform D, which can be seen to be identical to the square pulses generated by the present registration apparatus and shown by waveform B. Thus, the same precise firing of the print head solenoids is obtained while using half the number of registration slits. The actual electronic hardware utilized to obtain this operation will be described in detail hereinbelow.

Waveforms E and F represent the outputs of the upper and lower photodetectors 140 shown, for example, in the embodiment of FIG. 2*l*. Considering the registration slit pattern shown in detail in FIG. 2*k*, and considering the fact that the optical slit assembly moves from the left toward the right relative to FIG. 2*k*, at time $t_o$, waveform F can be seen to form a positive going square pulse. This waveform is identical to waveform C shown hereinabove. One-quarter cycle thereafter or, after 90° phase lag, the upper photodetector starts to pass the leading edge of the next following registration slit which is indicated in waveform E so that at time $t_1$ a positive going pulse is initiated.

Moving in the reverse direction, it can be seen that at time $t_3$ the trailing edge of waveform F will become the leading edge which follows the leading edge of the pulse of waveform E occurring at time $t_4$, by a 90° phase lag. Thus, regardless of the direction of movement of the print head the same time and geometric relationships are maintained. Waveform H shows the solenoid actuated pulses developed from waveform E, while waveform J shows the pulses developed at the leading and trailing edges of the square pulses represented by waveform F. The pulses of waveforms H and J are utilized in electronic circuitry to be described hereinbelow for the dual purpose of controlling the accurate and precise firing of the solenoid print heads regardless of whether the print head is moving to print in either the forward or the reverse direction, as well as providing a unique circuit for determining at any given instant the direction of travel of the print head. Only one set of narrow square pulses (shown by waveform J) is utilized for strobing the print head solenoids which can be seen to be identical to the square pulses of waveforms B and D. However, both sets of narrow square pulses (shown by waveforms H and J) are used for determining the direction of movement of the print head (by means of electronic circuitry to be more fully described).

Figure 3A:
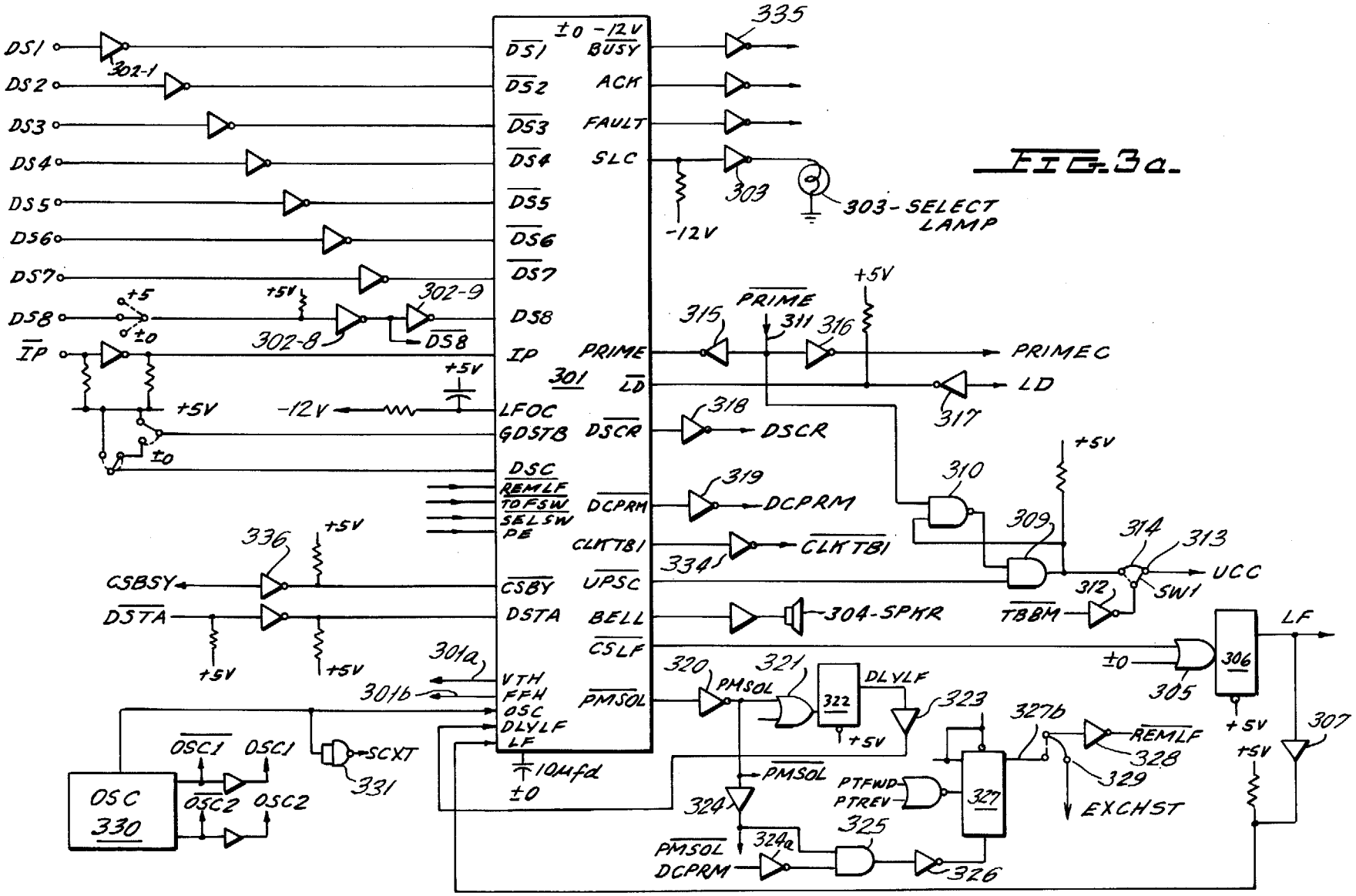
FIG. 3*a* is a block diagram showing the function decoder and related circuitry for providing various function signals.

FIG. 3*a* shows the circuitry employed for interfacing the printer with a computer facility communications link or the like. Data control codes and function codes (as will be more fully described) are inputted at terminals DS-1 - DS-8, said data being in the form of 8-bit binary words presented to the aforesaid input terminals in parallel. In those devices inputting data to the printer in serial form, serial to parallel converters may be provided so as to present the data in parallel form to either the shift register (to be more fully described) or the control code recognition circuitry 301. The data is applied to inverters 302-1 - 302-8 to convert the levels of the data before application to the input of control code recognition circuit 301. Input line DS-8 is provided with a second cascaded inverter 302-9 to apply the 8th-bit of the word in true (as opposed to complementary) form to circuitry 301. A strobe pulse (to be more fully described) loads the data word into decoding circuitry 301 which is designed to recognize coded function words, typically in ASCII format for identifying the control functions: SELECT ON and SELECT OFF (which indicate that the printing operation has been selected by the particular imputting device); BELL which provides the audible alarm for specified situations; LINE FEED for remotely controlling the line feed mechanism; VERTICAL TAB for slewing the paper document; FORM FEED for moving the paper document to the top of the next form; and EXPAND LINE for causing the printer to print expanded characters, as will be more fully described. The presence of a SELECT ON causes a select lamp 303*a*, coupled through inverter 303, to be illuminated, which lamp is turned off upon the occurrence of the next SELECT OFF code. A BELL code energizes speaker 304, typically for a period of the order of one second at a 2 kHz frequency.

A LINE FEED is developed by the generation of a $\overline{\text{CSLF}}$ (decode line feed) signal, which signal is applied to one input of gate 305 to activate one-shot multivibrator 306 for generating a line feed output (LF) which is coupled to the LF input of control code recognition circuit 301 through inverter 307 to terminate the $\overline{\text{CSLF}}$ signal.

A vertical tab signal (VTH) appears at output 301*a* and a form feed signal (FFH) appears at output 301b. The functions of these signals will become apparent as will be more fully described.

The presence of an expanded character format causes the generation of a signal $\overline{\text{UPSC}}$ which is applied to one input of gate 309, whose other input is coupled to the output of gate 310. Upon the occurrence of a PRIME signal at input 311, gate 310 is enabled, which in turn enables gate 309 to develop signal UCC, which signal is utilized for expanded character format. As an alternative, switch SW1 in conjunction with inverter 312 may be utilized to accept the signal $\overline{\text{TB8M}}$ as the control code format for expanded characters. The switch SW1 may be connected to stationary terminal 313 and jumper 314 is removed to accomplish this alternative arrangement.

A $\overline{\text{PRIME}}$ signal is applied at terminal 311 to "prime" or initialize the circuitry upon turn-on of the equipment and is applied to inverters 315 and 316. Inverter 315 is coupled to the PRIME input of code recognition circuit 301 to prime or initialize the circuitry. A load signal LD is coupled to inverter 317 to apply a lamp detect signal to the code recognition circuit for the purpose of enabling identifying failure of a lamp failure in the registration optics, in a manner to be more fully described. The code recognition circuit is also capable of receiving a binary code representative of a PRIME operation in order to prime or initialize the equipment from the remote source, such as, for example, a computer. The coding of this circuitry develops the signal $\overline{\text{DCPRM}}$ (decode "prime") which is applied to inverter 319 to develop the signal DCPRM, for a use to be more fully described. A carriage return code applied to the code recognition circuit develops a signal $\overline{\text{DSCR}}$ (decode carriage return) which is applied to inverter 318 to develop a signal DSCR which is utilized in a manner to be more fully described.

In cases where expanded characters are desired, the code for expanded characters may be applied to the code recognition circuit 301 to develop the signal $\overline{\text{UPSC}}$ which is applied to gate 309 which is cross-coupled with gate 310 to operate as a bistable circuit. The output of gate 309 is coupled to one input of gate 310, whose other input is coupled to the $\overline{\text{PRIME}}$ input 311 for resetting the gate. The output of gate 309 generates a signal UCC which conditions the printer to print expanded characters, in a manner to be more fully described.

The application of a remotely generated line feed code to the circuitry 301 causes the generation of signal $\overline{\text{CSLF}}$ which is applied to one input of gate 305 which triggers one-shot multivibrator 306 to develop the line feed signal LF for advancing the paper document in the printer. This signal is applied through inverter 307 at the trailing edge of the one-shot pulse to the LF input circuit 301 which causes the paper movement solenoid signal $\overline{\text{PMSOL}}$ to be developed, which signal is applied to inverter 320 and gate 321 to trigger one-shot multivibrator 322. The output of one-shot 322 is applied to inverter 323 to circuit 301 to cancel the line feed signal. The output of inverter 320 is applied through inverter 324 to reproduce the signal $\overline{\text{PMSOL}}$ which is applied to one input of gate 325 as well as being employed for other purposes, to be more fully described. The remaining input of gate 325 is coupled to the $\overline{\text{DCPRM}}$ output of circuit 301 which is coupled to the clear input of bistable flip-flop converter 327 through inverter 326. Output 327*b* of bistable flip-flop 327 is coupled through inverter 328 to develop the remote line feed signal $\overline{\text{REMLF}}$ or alternatively the output 327*b* may be coupled to stationary contact 329 to develop the signal EXCHST which is utilized to reset the print head carriage for a purpose to be more fully described.

The paper movement solenoid signal PMSOL or the prime signal DCPRM is utilized to reset bistable flip-flop 327 to remove the remote line feed signal $\overline{\text{REMLF}}$. Gate 329 is utilized to set the bistable flip-flop 327 upon the occurrence of either a print forward (PTFWD) or a print reverse (PTREV) signal, which signal will be more fully described hereinbelow.

The printer utilizes an oscillator 330 having a basic operating frequency, typically of the order of 1 MHz which is divided down to provide two out-of-phase signals OSC1 and OSC2 each being typically of a frequency of 500 KHz. The basic frequency is divided down again to develop an output oscillator signal of the order of 125 KHz which is coupled to one input of gate 331 to develop signal OSCXT and is also applied to the OSC input of code recognition circuit 301 for synchronizing purposes.

Other signals arranged to be inputted to or outputted from the code recognition circuit 301 will be described hereinbelow.

Figure 3B:
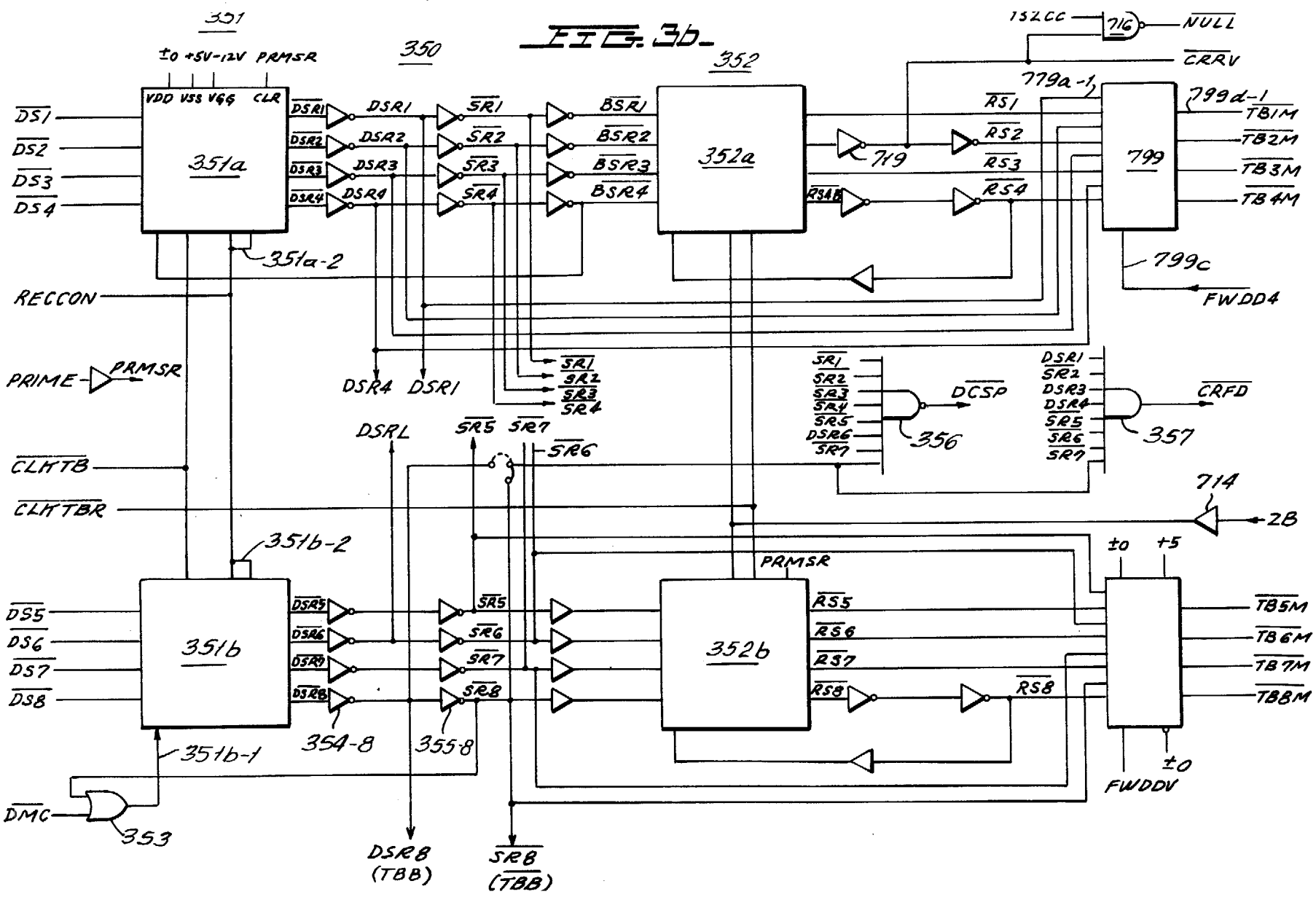
FIG. 3*b* is a block diagram showing the forward and reverse registers of the printer.

FIG. 3*b* shows the register circuits employed in the printer which are comprised of forward register 351 and reverse register 352. Each of the forward and reverse registers is comprised of 133 stages for printers having a capability of printing 132 characters per line so as to be capable of storing binary representation of 132 characters plus a dummy character which functions in a manner to be more fully described. The forward register 351 is comprised of first and second register halves 351*a* and 351*b*, each capable of storing 133 words of four bits, the register halves thereby providing a capability of storing 133 words of 8-bit length. The inputs $\overline{DS1}$ – $\overline{DS8}$ are coupled to the outputs of inverters 302-1 - 302-9 of FIG. 3*a*. The registers are capable of operating in a recirculating mode which causes the binary word in the right-hand-most (i.e. output) stage to be transferred to the left-hand-most (i.e. input) stage so as to retain all words present in the shift register for a purpose to be more fully described. Recirculation is obtained in the presence of a "recirculation control" signal RECCON.

Generation of the PRIME signal is coupled to the "clear" inputs CLR of the register halves 351*a* and 351*b* to clear the register in preparation for the printing of the next line of characters, as will be more fully described.

Reverse register 352 is similarly comprised of register halves 352*a* and 352*b*, each capable of storing 133 words of four-bit length, so as to collectively provide a capability of storing 133 words of eight-bit length.

Loading of data begins upon the generation of a clocking signal CLKTB1 developed by the code recognition circuit 301 and appearing at the output of inverter 334. This signal has a frequency rate determined by the data strobe signal (DSTA) applied to the code recognition circuit 301.

Initially a dummy character is loaded into register 351 followed by binary coded words representative of the characters, symbols and/or blank spaces to be printed along the line of characters. Loading of the binary information continues until the presence of a dummy character is detected in the right-hand-most stage of forward register 351.

Figure 3C:
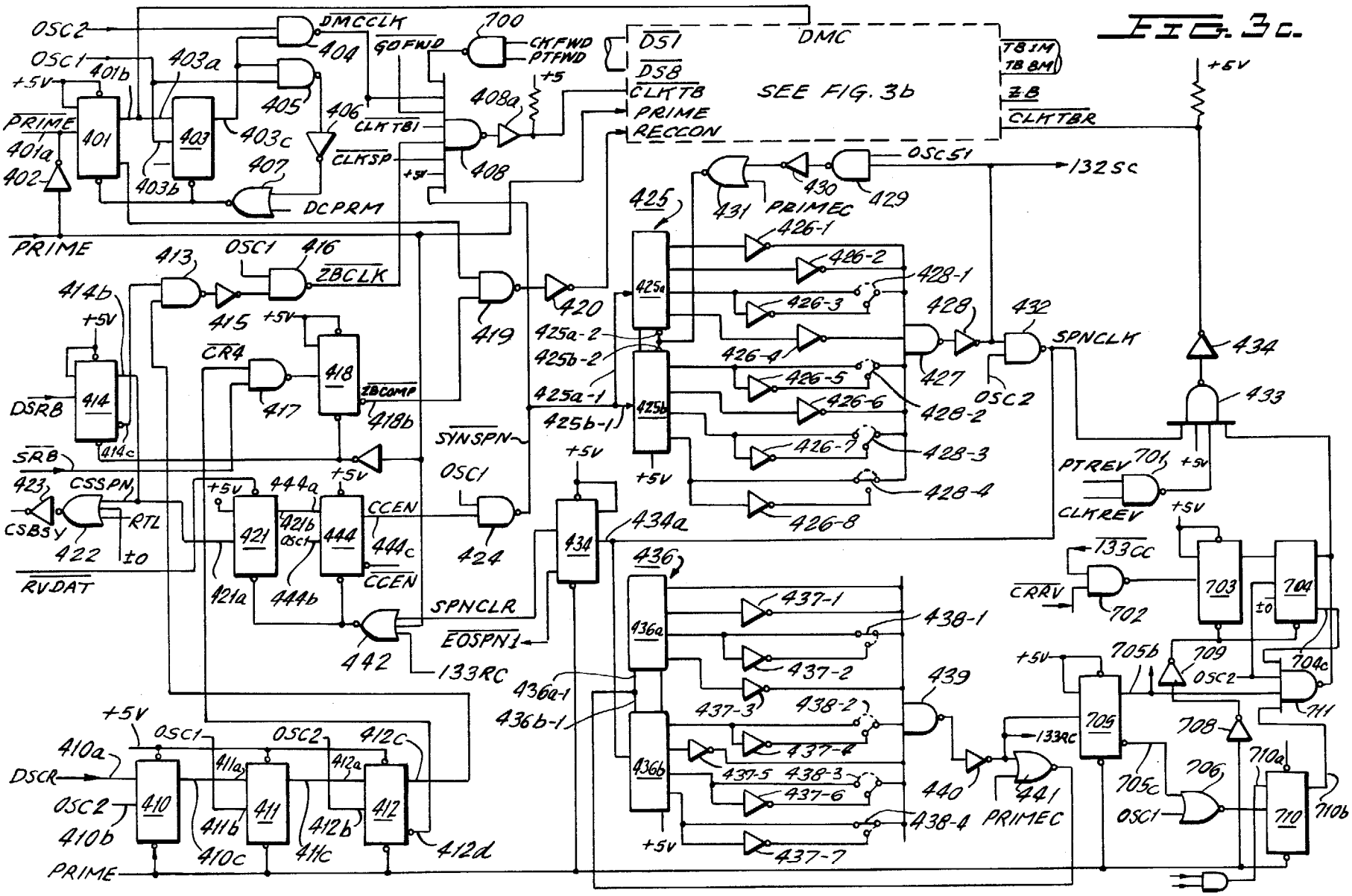
FIG. 3*c* shows the counting and control circuitry employed for examining the binary words representing the character field in the forward register and for reversing the order of the binary words and loading same into the reverse register.

The generation of a PRIME signal is applied to the circuitry 400 of FIG. 3*c* to bistable flip-flop 401 through gate 402 coupled to input 401*a*. The output 401*b* of gate 401 is coupled to the input 403*a* of bistable flip-flop 403 which is set upon the occurrence of the next OSC1 pulse applied to its clock input 403*b* to bring the generation of the PRIME signal into synchronism with the printer clock source 330. This causes the output 403*c* of bistable flip-flop 403 to be set, which condition is coupled into gates 404 and 405. The output of gate 405 is coupled to inverter 406 in gate 407 to clear the PRIME condition from bistable flip-flop 401.

The output 401*b* of bistable flip-flop 401 is coupled to the DMC input of gate 353 (shown in FIG. 3*b*), whose output is coupled to input 351*b*-1 of register half 351*b* to load a dummy character into the forward register 351.

The output of gate 404 (FIG. 3*c*) is coupled to one input of gate 408 whose output develops the $\overline{CLKTB}$ signal for shifting data into the forward register 351.

The PRIME signal is also applied to the clear or reset input of bistable flip-flops 410, 411 and 412 connected in tandem. The receipt of a remote carriage return code causes code recognition circuit 301 to generate a signal DSCR at the output of inverter 318 shown in FIG. 3*a*. This signal is coupled to input 410*a* of bistable flip-flop 410, which is caused to set its output 410*c* upon the application of the next OSC2 clock pulse at its clock input 410*b*. When the output 410*c* goes high, this conditions bistable flip-flop 411 at its input 411*a*, causing its output 411*c* to go high upon the occurrence of the next OSC1 clock pulse thereby bringing this circuitry into synchronism with the clock source. Output 411*c* is coupled to the input 412*a* of bistable flip-flop 412 whose output 412*c* goes high to develop the carriage return (CR) signal upon the occurrence of the next oscillator pulse OSC2 at its clock input 412*b*.

The carriage return signal CR is coupled to one input of gate 413, whose other input is coupled to the output 414*c* of bistable flip-flop 414, output 414*c* normally being high. With two high conditions applied to gate 413, its output goes low. This condition is inverted at 415 to apply a high input to gate 416. The other input to gate 416 is the oscillator output OSC1 which causes the clocking output $\overline{ZBCLK}$ to appear at the output of gate 416 so long as the output of inverter 415 is high. This condition is applied to one input of gate 408 to develop the clocking signal $\overline{CLKTB}$ which is applied to the forward register 351 of FIG. 3*b* to clock binary words toward the output of 351.

As soon as the dummy character is shifted to the right-hand-most stage of forward register 351, output DSR8 of register half 351*b*, which is coupled to input 414*a* of bistable flip-flop 414 causes bistable 414 to reset and disables gate 413 and hence disables gate 416 to prevent the generation of any further shifting pulses. Output DSR8 appears at the output of inverter 354-8 (FIG. 3*b*). This output is again inverted by inverter 355-8, which generates signal $\overline{SR8}$. This signal is applied to one input of gate 417 of FIG. 3*c* whose other input is coupled to output 412*d* of bistable flip-flop 412. Thus, for the condition when a full 132 character line is sent and no carriage return signal is generated and a dummy character appears in the right-hand-most stage of forward register 351, gate 417 causes bistable flip-flop 418 to be set. Its output 418*b* is coupled to one input of gate 419. The output of gate 419 is coupled to inverter 420, which develops a recirculate control signal RECCON which is applied to inputs 351*a*-2 and 351*b*-2 of forward register halves 351*a* and 351*b*, respectively, to place the forward register in the recirculation mode.

The high condition at output 414*b* of bistable flip-flop 414 shown in FIG. 3*c*, which indicates the presence of a dummy character in the right-hand-most stage of forward register 351, is simultaneously coupled to the clock input of a bistable flip-flop 412 and a gate 422. The output of gate 422 is coupled to inverter 423 to develop the CSBSY (cause busy) signal which is applied to inverter 336 of FIG. 3a to cause code recognition circuit 301 to develop the BUSY signal at inverter 335, which signal is coupled to the remote source operating the printer to indicate that no further characters may be received.

The high level at output 414*b* of bistable flip-flop 414 sets bistable flip-flop 421 so that its output 421*b* goes high. This condition is applied to one input 444*a* of bistable flip-flop 444, causing its output 444*c* to go high upon the occurrence of the next oscillator pulse OSC1 at its input 414*b*. The high level at output 444*c* is coupled to one input of gate 424. The remaining input of gate 424 receives the oscillator pulses OSC1 to develop the output signal $\overline{\text{SYNSPN}}$ which is simultaneously applied to one input of gate 408 and to the clock input 425*a*-1 and 425*b*-1 of counter halves 425*a* and 425*b*, which collectively form a multi-stage counter 425 utilized to keep a count of the number of clock pulses applied to forward register 351 when this register is in the recirculation mode.

The recirculation mode is utilized at this time to identify the end points of the character field and to load reverse register 352 with only the first binary coded word, representative of the last character in the line of characters to be printed, in the reverse order from that of register 351. After forward register 351 is loaded, the format is such that the right-hand-most stage (i.e., stage 133) contains a dummy character, the next stage contains the information to be printed at the left-hand-most end of the line (i.e., stage 132), which information may be a character or a space. Stage 131 contains the information (character or space) to be printed on a line of characters when printing from left to right, stage 130 contains a third character (or space) and so forth, until finally stage 1 or the left-hand-most stage of forward register 351 contains the code for the character (or space) which is to be printed at the right-hand-most end of the line of characters. By initially applying a total of 132 clock pulses to forward register 351, the binary character in the left-hand-most stage of register 351 will then be moved to the right-hand-most stage. Counter 425 keeps a count of the number of clock pulses applied. The output stages of counter 425 are coupled to a decoder circuit comprised of inverters 426-1 through 426-8 whose outputs are coupled to decoder gate 427 which develops a low level output as soon as the counter 425 has accumulated a total of 132 clock pulses. The jumper arrangements 428-1 through 428-4 indicate the alternative electrical connections which may be made for converting the printer electronics for use in an 80 column printer, i.e., a printer capable of printing a maximum of 80 characters per line. Obviously, through appropriate logic changes in the decoding circuitry and printer mechanical components, the printer may be altered to print any desired number of characters per line.

As soon as 132 clock pulses have been accumulated in counter 425, the output of gate 427 goes low, causing the output of inverter 428 to go high. This condition is applied through gate 429, inverter 430, and gate 431 simultaneously to the inputs 425*a*-2 and 425*b*-2 of counter portions 425*a* and 425*b* to reset the counter to zero.

The output of inverter 428 is further coupled to one input of gate 432 to generate the signal $\overline{\text{SPNCLK}}$ which is simultaneously applied to one input of gate 433 and to the clock input 434*a* of bistable flip-flop 434. The remaining input of gate 432 receives the OSC2 clock pulses causing the output of gate 432 to go alternately high and low at the rate of oscillator signal OSC2. Gate 433 thus applies a pulse through inverter 434 to the clock input $\overline{\text{CLKTBR}}$ of the reverse register 352, thereby enabling the binary word now in the right-hand-most stage of forward register 351 to be shifted into the left-hand-most stage of register halves 352*a* and 352*b* which comprise the reverse register 352. Since counter 425 is properly reset to zero, only one pulse will be permitted to pass to the clock input $\overline{\text{CLKTBR}}$ of the reverse register. When the end points of the character field indicate that printing in the reverse direction is required, by circuitry to be more fully described, the recirculation operation continues at which time counter 425 again accumulates 132 pulses, which pulses also cause the binary word which originally was loaded into stage 2 of the forward register 351 to be loaded into the right-hand-most stage of forward register 351, at which time a reverse register clock pulse is again developed, which causes the first binary word shifted into reverse register 352 to be shifted into its second stage, causing the second binary word shifted to reverse register 352 to be loaded into the first stage of reverse register 352.

The operation continues until a total of 133 such recirculation operations have occurred. This count is kept by counter 436 comprised of counter stages 436*a* and 436*b*, also shown in FIG. 3*c*. Counter 436 is stepped each time an output signal appears at the output of gate 432. Counter 436 is coupled to decoding circuitry comprised of inverters 437-1 through 437-7, whose outputs are coupled to decoder gate 439. Jumper connections 438-1 through 438-4 show the manner in which decoding circuitry wiring may be altered for use in an 80-column printer.

After a total of 133 recirculation operations have occurred, forward register 351 will now have the binary words stored therein in the same exact order as they were originally presented to the forward register. However, these binary words will be arranged in reverse order in reverse register 352.

Upon the completion of 133 recirculation operations, gate 439 will be enabled. Its output is coupled through inverter 440 and gate 441 to the reset inputs 436*a*-1 and 436*b*-1 of counter 436. At this time the printer is now ready to print the line of characters now loaded in the "reverse" order in reverse register 352, thereby enabling the printer to print in the reverse direction as will be more fully described. All of the above operations are completed within 35 milliseconds.

The signal 133RC appearing at the output of inverter 440 is coupled to one input of gate 442 shown in FIG. 3*c* to reset bistable flip-flops 421 and 444 in order to terminate the recirculation pulses applied to forward register 351 through gates 424 and 408.

Figure 4:
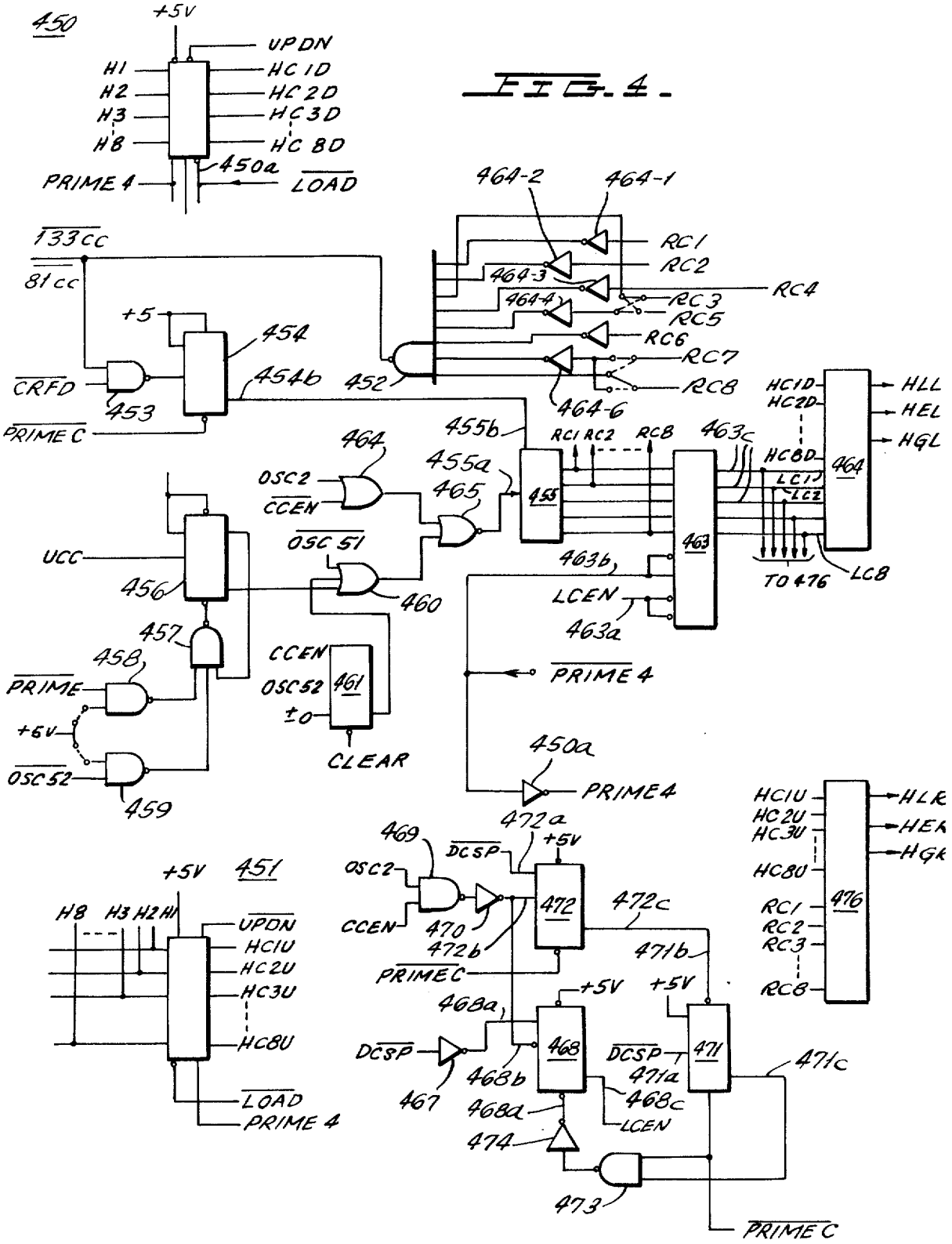
FIG. 4 shows a circuitry employed for determining the position of the print head relative to the end points of the character field.

The actual printing of a line of characters, which may be either an entire line or a portion of a line, as represented by the binary information now loaded into the forward and/or reverse registers, will not be initiated until a decision is first made as to what constitutes the shortest distance which the head must travel to begin printing of the next line. For purposes of understanding the decision-making logic, let it be assumed that the previous line of characters constituted less than a full line of 132 characters. As soon as the last character of the previous line printed has been completed, the print head is abruptly brought to a halt regardless of what position it may occupy at that time. The exact position of the print head is stored in a head counter to be more fully described. The decision-making logic examines the forward register during the first "spin" operation to transfer counts representative of the left-hand and right-hand end points of the character field to be printed, as represented by the binary data now stored in the forward and reverse registers. FIG. 4 shows the decision-making logic for performing these functions. A latch-counter 450 is provided for receiving the count of the head counter shown in FIG. 6*a*, to be more fully described. A second latch counter 451 is provided to receive the count in the head counter. The head counter receives forward or reverse pulses representative of forward movement or reverse movement of the print head across the paper document to either increment or decrement the head counter. Print head 101 is provided with the optical means of FIGS. 2*m*–2*o* which cooperates with timing strip 113 to generate a pair of out-of-phase pulses, which are interpreted by logic to be more fully described, to generate either incrementing or decrementing pulses for operating the head counter. The count developed by the head counter is coupled to the output of latch counters 450 and 451 until receipt of a LOAD signal. Upon the occurrence of a LOAD signal, which is applied to inputs 450*a* and 451*a* of latches 450 and 451, the contents of the head counters last appearing at inputs H1–H8 of latch counters 450 and 451 "set" into latch counters 450 and 451 are immune to receipt of any further signals applied to their inputs. At this time counters 450 and 451 are operated as "up" and "down" counters, as will be more fully described hereinbelow.

Counters 450 and 451 operate in conjunction with counter 455 of FIG. 4 and are comprised of an 8-stage binary counter capable of accumulating a count of at least 132 pulses. The outputs RC1–RC8 of counter 455 are coupled to a latch circuit 463 which directly couples the state of its input terminals RC1–RC8 to comparators 464 and 476, until the receipt of an LCEN signal, at which time the state of the input terminals RC1–RC8 is "latched" at the output terminals 463*c*. This count represents the count of the left-hand end point of the character field. The outputs RC1–RC8 of the stages of counter 455 are also selectively coupled to gate 452 either through the inverters 464-1 — 464-6 or directly without inversion. The inputs to decoder gate 452 indicate the completion of accumulation of 132 pulses by counter 455 to be used in a manner to be described hereinbelow. The jumper arrangements 465-1 and 465-2 indicate the alternative connections which may be made between gate 452 and counter 455 for an 80-column printer. The counter 455 continues to count beyond the "latched" count until it is incremented to a binary count representing the right-hand point of the character field.

The left and right-hand end points of the character field are determined during the very first recirculation operation (of the 133 recirculation operations) performed on register 351. When the dummy character reaches the right-hand most stage of forward register 351, as was described hereinabove, output 414*b* of bistable flip-flop 414 shown in FIG. 3*c* goes high, ultimately causing output 444*c* of bistable flip-flop 443 to go high to develop the signal CCEN which is coupled to one input of gate 464, shown in FIG. 4. The other input of gate 464 is coupled to the output $\overline{\text{OSC2}}$ of the oscillator 330 shown in FIG. 3*a* causing oscillator pulses to be applied to the clock input 455*a* of counter 455. The outputs of each stage of counter 455 are coupled to a comparator circuit 464 through latch circuit 463 which transfers the output of counter 455 to the LC1-LC8 inputs of comparator 464 until, upon generation of the LCEN signal the count of counter 455 is "latched" at the output of latch 463.

Before undertaking an explanation of the manner in which the signal LCEN is generated, it should be understood that the data in the form of binary words inputted into forward register 351 will include binary words representative of a "space code" at those positions at which no character is to be printed. Thus, the forward register will receive a combination of binary words representative of both characters and spaces which will be inputted into forward register 351 in the exact order in which the data is to be printed. Thus, in order to locate the end points of the character field, a gate 356 is provided as shown in FIG. 3*b*, for the purpose of detecting the presence of spaces (i.e. no character). The inputs of gate 356 are coupled to the eight outputs of forward register 351 and the output of gate 356 develops a $\overline{\text{DCSP}}$ (decode space) signal each time a space code (i.e., representing a blank space) is detected.

As soon as the dummy character is loaded into the right-hand-most stage of forward register 351, the forward register is conditioned to operate in the recirculation phase, as was described hereinabove. Thus, as soon as the signal $\overline{\text{CCEN}}$ is generated, the oscillator pulses $\overline{\text{OSC2}}$ enable counter 455 to begin counting. Thus, the dummy character in the right-hand-most stage of forward register 351 will be transferred to the left-hand-most stage and the binary word in the stage immediately adjacent the right-hand-most stage in forward register 351 will be shifted into the right-hand-most or output stage. Since the forward register 351 is pulsed by OSC1 pulses, the dummy character will be transferred to the left-hand stage of register 351 before gate 469 is enabled. As space conditions are encountered, the output of gate 356 of FIG. 3*b* will be enabled. This condition is applied directly to input 471*a* of flip-flop 471 and through inverter 467 of FIG. 4 to the input 468*a* of bistable flip-flop 468. Gate 469 has one of its inputs coupled to the oscillator output OSC2 and its other input coupled to receive the signal CCEN from bistable flip-flop 414 of FIG. 3*c*. The output of gate 469 is inverted at 470 and applied directly to input 472*b* of flip-flop 472 and 468*b* to the clock input of bistable flip-flop 468 to develop the signal LCEN at its output 468*c*. The signal LCEN is applied to input 463*a* of latch 463 to instantaneously latch the output to the state of counter 455 at the time that LCEN is generated.

The logic comprised of circuits 467–473 is provided to "latch" the latch circuit 463 immediately upon the shifting of the first non-space character into the right-hand-most stage of forward register 351, and to ignore space codes thereafter shifted into the right-hand-most stage of register 351.

If the binary code now in the output of forward register 351 is a space code input 472*a* is low and input 468*a* is high causing output 468*c* to go high and causing output 472*c* to go low. These conditions are retained so long as space codes are shifted into the output stage of register 351. When the first character code is shifted into the output stage of register 351, the output of gate 356 (FIG. 3*b*) goes high. This causes output 472*c* to go low and causes output 468*c* to go high to "set" latch 463 with the signal LCEN. Prior thereto, and when output 472*c* is high, it presets flip-flop 471 at preset input 471*b* causing its output 471*c* to go low. As soon as the first character code is transferred to the output stage of register 351, 471*c* goes low causing the output of gate 473 to go high. This state is inverted at 474 to clear flip-flop 468 at input 468*d* causing 468*c* to go low. Any space codes which may be shifted into the output to register 351 after the first character code will cause $\overline{DCSP}$ to go high causing the output 472*c* of flip-flop 472 to go low and preventing flip-flop 471 from changing its low output state at 471*c*. This condition prevents 468*c* from going low upon the occurrence of any space codes so as to "set" latch 463 only once during a spin operation of forward register 351.

Counter 455, however, is continuously incremented until a signal $\overline{CRFD}$ is developed, which is a signal developed by gate 357 of FIG. 3*a* to indicate the right-hand end of a character field for those situations where the right-hand-most character of a character field will occupy a position of one or more spaces to the left of the right-hand-most printable position of the paper document. This code is detected by gate 357 of FIG. 3*b* which is coupled to selected outputs of forward register 351 to enable gate 357 only upon the occurrence of the aforementioned condition. The $\overline{CRFD}$ signal developed by gate 357 is applied to one input of gate 453 shown in FIG. 4 to clock bistable flip-flop 454 to cause its output 454*b* to go low. This low state is coupled to the disable input 455*b* of counter 454 and prevents counter 455 from accepting any more oscillator pulses. The decoder circuitry comprised of inverters 466 and gate 452 also serves a similar function in that it prevents counter 455 from accumulating a binary count of greater than 132, for the condition when no carriage return code is received.

The outputs of all stages of counter 455 are coupled to respective inputs RC1-RC8 of a second comparator circuit 476 of FIG. 4, whose remaining inputs are coupled to the up counter 451. Thus, summarizing the operation described hereinabove, comparator circuit 464 receives binary information through latch 63 representative of the left-hand most point of the character field. Comparator 476 receives binary information directly from counter 455 representative of the right-hand-most point of the character field to be printed.

The head position down counter 450 and the head position up counter 451 now contain at this time a count representative of the exact position of the print head at which position the print head was abruptly stopped after printing of the previous line of characters. The down and up counters 450 and 451 have their outputs directly coupled to the appropriate inputs of comparators 464 and 476, which are provided with logical circuitry for comparing the end points of the character field against the exact position of the print head. These numerical quantities, in binary coded from, cause the development of one of three possible conditions at the respective outputs at each of the comparison circuits 464 and 476. For example, considering comparator circuit 464, the possible output conditions are HLL (representative of the condition that the head position is to the left of the left-hand point of the character field; HEL (representative of the fact that the counts are exactly equal to one another indicating that the print head is one character to the left of the left-hand point of the character field, interpreted however as "head position equals left-hand end point"); and HGL (indicating that the count representative of the head position is greater than the count representative of the left-hand end point of the character field).

Similarly, comparator 476 is capable of developing any one of the three outputs HLR (indicating that the count representative of the head position is less than the count representative of the right-hand-most end of the character field); HER (indicating that the count of the head position "equals" the count representative of the right-hand-most end of the character field); HGR (indicating that the count of the head position is greater than the count representing the right-hand end of the character field).

Figure 4A:
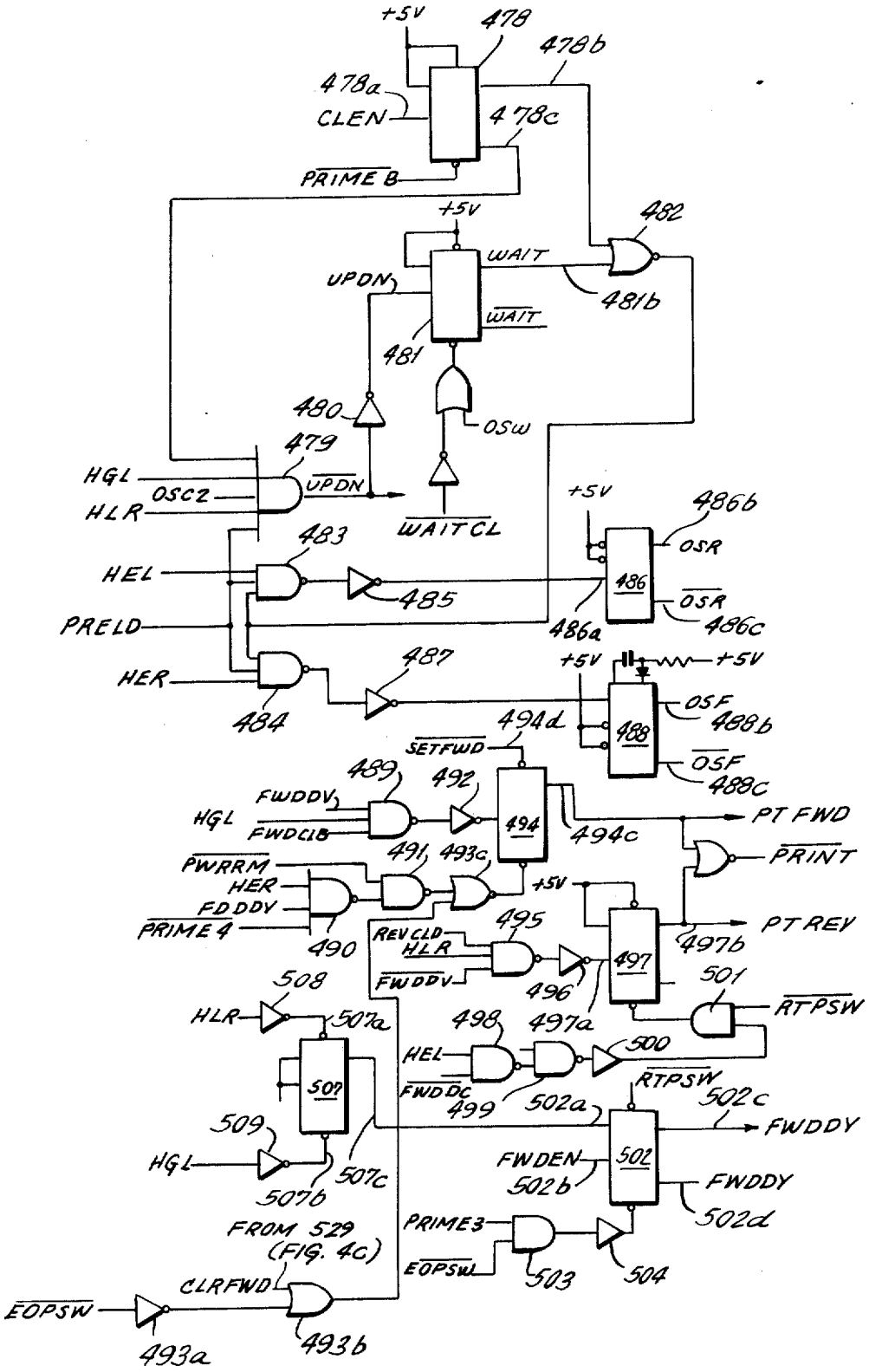
FIG. 4*a* shows a circuitry employed for determining the direction of movement of the print head for printing.

The outputs of comparators 464 and 476 are utilized with the decision logic of FIG. 4*a* in the following manner:

Considering the circuitry of FIG. 4*a*, when the signal LCEN is generated by bistable flip-flop 468 of FIG. 4, this signal sets bistable flip-flop 478 of FIG. 4*a* causing its output 478*b* to go high and its output 478*c* to go low. Output 478*c* is coupled to one input of gate 479, enabling gate 479. Gate 479 also receives the outputs HGL and HLR, as well as the signal PRELD (to be more fully described) and OSC2 causing the output of gate 479 to pass pulses when the count representative of the head position is greater than the left-hand end of the character field and when the count representative of the print head position is less than the count representative of the right-hand end point of the character field. This condition exists when the print head is positioned within the data field. Gate 479 is thus enabled, causing the signal $\overline{UPDN}$ to be generated. The OSC2 pulses are simultaneously applied to the down input of down counter 450 and the up input of up counter 451, to respectively decrement and increment these counters. The first OSC2 pulse passed by gate 479 is inverted at 480 and applied to bistable flip-flop 481 to develop a WAIT signal at output 481*b*. This high level is applied to gate 482 to condition gates 483 and 484.

The up and down counters 450 and 451 are stepped simultaneously and at the same rate. Except for the condition where the position of the head counter is exactly in the middle of the character field, it can be seen that the print head will be closer to one of the end points of the character field, thereby causing one of the comparators 464 or 476 to develop a signal HEL or HER, as soon as the incremented or decremented head count equals a count representative of either the left or the right-hand-most end point of the character field.

Assuming that the print head is located closer to the left-hand end point, the signal HEL will be developed before the signal HER. The signal HEL is applied to one input of gate 483 which has been conditioned to be enabled by the output of gate 482 and the signal PRELD. When the output of gate 483 is enabled, its output is inverted at 485 and applied to the trigger input 486*a* of one-shot multivibrator 486 to develop the signal OSR and the signal $\overline{OSR}$ at outputs 486*b* and 486*c*, respectively. These signals are utilized to operate circuitry to be more fully described in connection with the control of the brake and forward and reverse clutches for controlling the movement of the print head.

In the case where the print head position is closer to the right-hand end of the character field, comparator 476 will develop the signal HER before comparator 464 can develop the signal HEL. The signal HER is applied to gate 484 which is enabled in a manner similar to that of gate 483. The enabled output is coupled through inverter 487 to one-shot multivibrator 488 to develop the signal OSF (at output 488*b*) and $\overline{OSF}$ (at output 488*c*), which signals are also utilized in a manner similar to the trigger pulses developed by one-shot multivibrator 486 to control the non-printing movement of the print head.

Bistable flip-flop 507 has its set and clear inputs 507*a* and 507*b* respectively coupled to the outputs HLR (of comparator 476) and HGL (of comparator 464) through inverters 508 and 509.

Figure 4B:
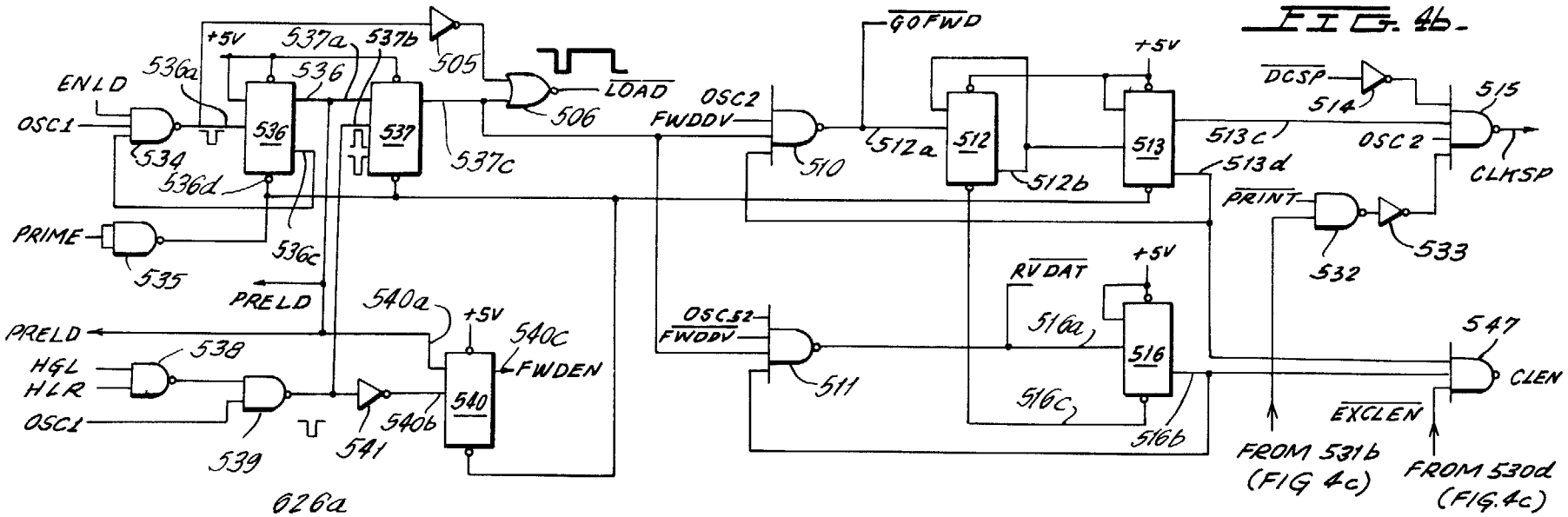
FIG. 4*b* shows a block diagram of the circuitry employed for loading the up-down counters with the contents of the head position counter and for enabling operation of the clutch.

FIG. 4*b* shows the circuitry employed for loading the up and down counters 450 and 451 which receive the head count and for determining the direction in which head 101 (FIG. 1) must be moved. Gate 534 has its inputs coupled to the enable load signal (ENLD-derived from gate 670- FIG. 4*e*), the oscillator signal OSC1 and the output 536*c* of bistable flip-flop 536. Output 536*c* is normally high. The signal ENLD goes high after completion of the first spin operation of the forward register 351 of FIG. 3*b*. Bistable flip-flop 536 changes state (i.e. clocks) on the positive edge of a pulse so as to change state on the trailing edge of the first oscillator pulse passed by gate 534. This causes output 536*b* to go high and 536*c* to go low. The low level at output 536*c* disables gate 534 from passing more than one OSC1 pulse. The high level at 536*b*, which is also identified as the preload signal (PRELD) is simultaneously applied to respective inputs of gates 483 and 484 as shown in FIG. 4*a* to condition these gates; is applied to input 537*a* of bistable flip-flop 537 and is applied to input 540*a* of bistable flip-flop 540.

In the case where the head position lies outside of the character field (i.e. beyond either the left or right-hand end points), at least one of the signals HGL or HLR will be low. This causes the output of gate 538, shown in FIG. 4*b*, to go high, passing oscillator pulses OSC1 through gate 539. The output of gate 539 is inverted at 541 and applied to the clock input 540*b* of bistable flip-flop 540 which causes its output 540*c* to go high on the first positive going edge of the pulse applied to its clock input 540*b*, which signal is utilized as a forward-enable signal (FWDEN) to be more fully described.

The output of gate 539 also clocks bistable flip-flop 537 at 537*b* whose input 537*a* has been set by bistable flip-flop 536. This causes its output 537*c* to go high, which condition is simultaneously applied to respective inputs of gates 506, 510 and 511. The output of gate 534 is coupled to the remaining input of gate 506 through inverter 505.

The output of gate 506 is normally high before the occurrence of the enable load (ENLD) signal. This condition is inverted at 505 to apply a low level to one input of NOR gate 506 which goes low so long as both of its inputs are high. Initially output 537*c* of bistable flip-flop 537 is high having been cleared by a PRIME signal in a manner to be more fully described. This causes gate 506 to develop a low level $\overline{LOAD}$ signal which is utilized to load the head count of counter 775 (FIG. 6*a*) into up and down counters 450 and 451 of FIG. 4. This signal goes high again if the head is not inside the data as a result of one input to gate 538 being low, which causes bistable flip-flop 537 to be clocked causing its output 537*c* to go low. Thus, the output of gate 506 stays low for a length of only one clock pulse. Output 537*c* goes high one clock pulse after 536*b* goes high, which high condition is simultaneously applied to gates 510 and 511.

In the situation where the head position is to the left of the left-hand end of the character field, the signal HLR will be high. This condition is inverted by inverter 508 applying a low level to the preset input 507*a* of bistable flip-flop 507 causing output 507*c* of bistable flip-flop 507 to go high. This high condition is applied to input 502*a* of bistable flip-flop 502 which receives the forward enable (FWDEN) signal from output 540*c* of bistable flip-flop 540, shown in FIG. 4*b*, to cause the output 502*c* of bistable flip-flop 502 to go high, thereby developing a forward drive (FWDDV) signal. At the same time, output 502*d* will be low. These conditions are applied to respective inputs of gates 510 and 511.

In the case where the print head position lies to the right of the right-hand-most end of the character field, signal HGL will be high, placing a low condition on input 507*b* of bistable flip-flop 507. This will cause a low condition at output 507*c* so that the forward enable signal FWDEN at the clock input 502*b* will cause output 502*d* of bistable flip-flop 502 to go high and conversely will cause output 502*c* to go low. Thus, based upon the states of the outputs 502*c* and 502*d* of bistable flip-flop 502, only one of the gates 510 or 511 can be enabled at any given time. Both of these gates have respective inputs coupled to outputs 513*d* and 516*b* of bistable flip-flops 513 and 516. In the case where the signal FWDDV is high, output 513*d* is high and output 537*c* is high, oscillator pulses from output OSC2 will be passed by gate 510 to develop the go forward signal $\overline{GOFWD}$ which is applied to other circuitry to be more fully described, as well as to the clock input of bistable flip-flop 512. Output 512*b* is coupled to the clock input of bistable flip-flop 513. Flip-flops 512 and 513 are coupled to operate as frequency dividers to enable two pulses to be passed by gate 510 before output 513*d* of bistable flip-flop 513 goes low. These two pulses are applied to one input of gate 408, shown in FIG. 3*c* which, in turn, applies two clock pulses to the clock input ($\overline{CLKTB}$) OF FORWARD REGISTER 351. This operation occurs after completion of one spin operation of the forward register. It should be recalled that the forward register is advanced through 132 pulses whereby the last character is in the right-hand-most stage of the register and the dummy character is in the stage to its immediate left. By clocking the forward register two times the binary code representing the right-hand-most character to be printed is transferred to the left-hand-most stage of the forward register on the first clock pulse and on the second clock pulse the dummy character is transferred to the left-hand-most stage of the forward register. Thus, at this time, the output stage of the forward register contains the binary word for the left-hand-most character of the next line to be printed (in the forward direction), which character may either be a space or a character so that we now have the first principal character or space in the output stage of the forward register.

When output 513*d* of bistable flip-flop 513 goes low, simultaneously therewith output 513*c* goes high which condition is applied to one input of gate 515. Gate 356 of FIG. 3*b*, which detects the presence of space codes, has its output applied through inverter 514 to another input of gate 515. So long as spaces are present, a low condition is applied to inverter 514 which thus applied a high condition to gate 515. The space condition is also applied to the clock input 531*a* of bistable flip-flop 531 shown in FIG. 4*c* causing its output 531*b* to go high. This condition is applied to one input of gate 532.

The other input of gate 532 receives the $\overline{\text{PRINT}}$ signal from gate 670 shown in FIG. 4*a* and to be more fully described, whose output is high until printing occurs. At this time the output of gate 532 of FIG. 4*b* is low. This condition is inverted by inverter 533 placing a high state on an associated input of gate 515. With the aforementioned inputs to gate 515 all being high, OSC2 oscillator pulses are passed by gate 515 to develop the clock-space signal ($\overline{\text{CLKSP}}$) which is applied to one input of gate 408 shown in FIG. 3*c* so as to be coupled to the $\overline{\text{CLKTB}}$ input of forward register 351 of FIG. 3*b* to shift the binary words in the register to the right. As soon as the first non-space code is detected by gate 356 of FIG. 3*b*, this condition causes bistable flip-flop 531 (FIG. 4*c*) to be clocked causing its output 531*b* to go low. This causes the output of gate 532 to go high thereby applying a low level input to gate 515 through inverter 533 to prevent any more OSC2 clock pulses from being passed through gate 515.

Figure 4E:
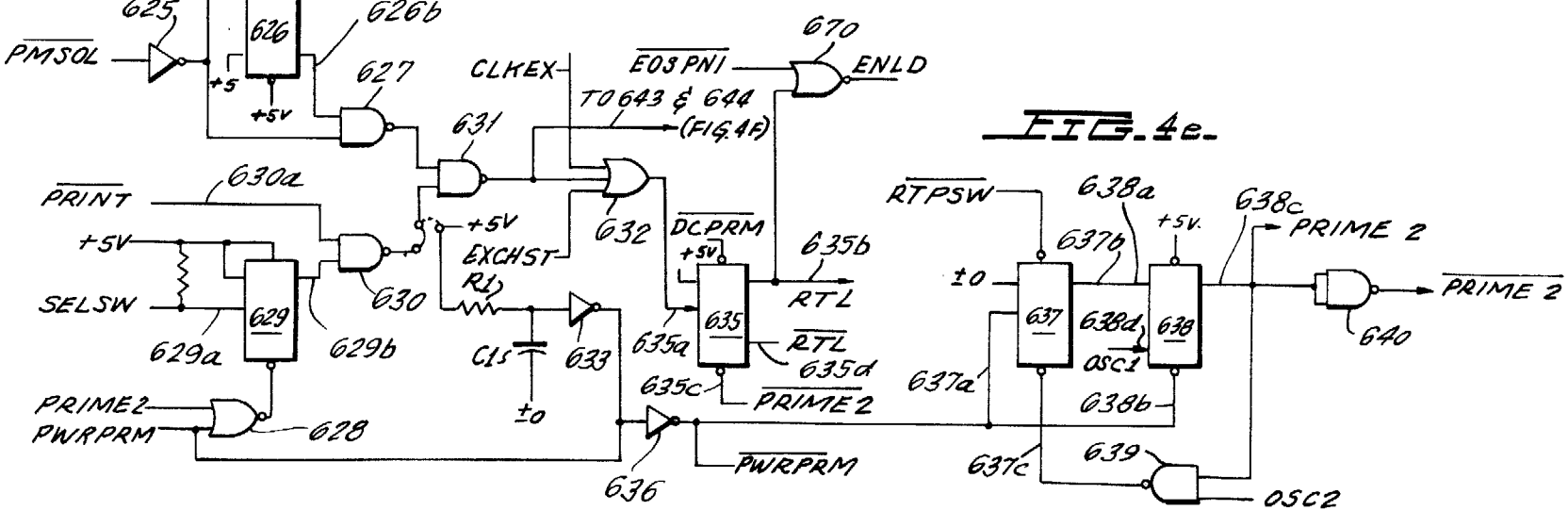
FIG. 4*e* shows the circuitry employed for generating prime signals to initialize this system and for returning the print head to the left-hand margin under certain operating conditions.
Figure 4C:
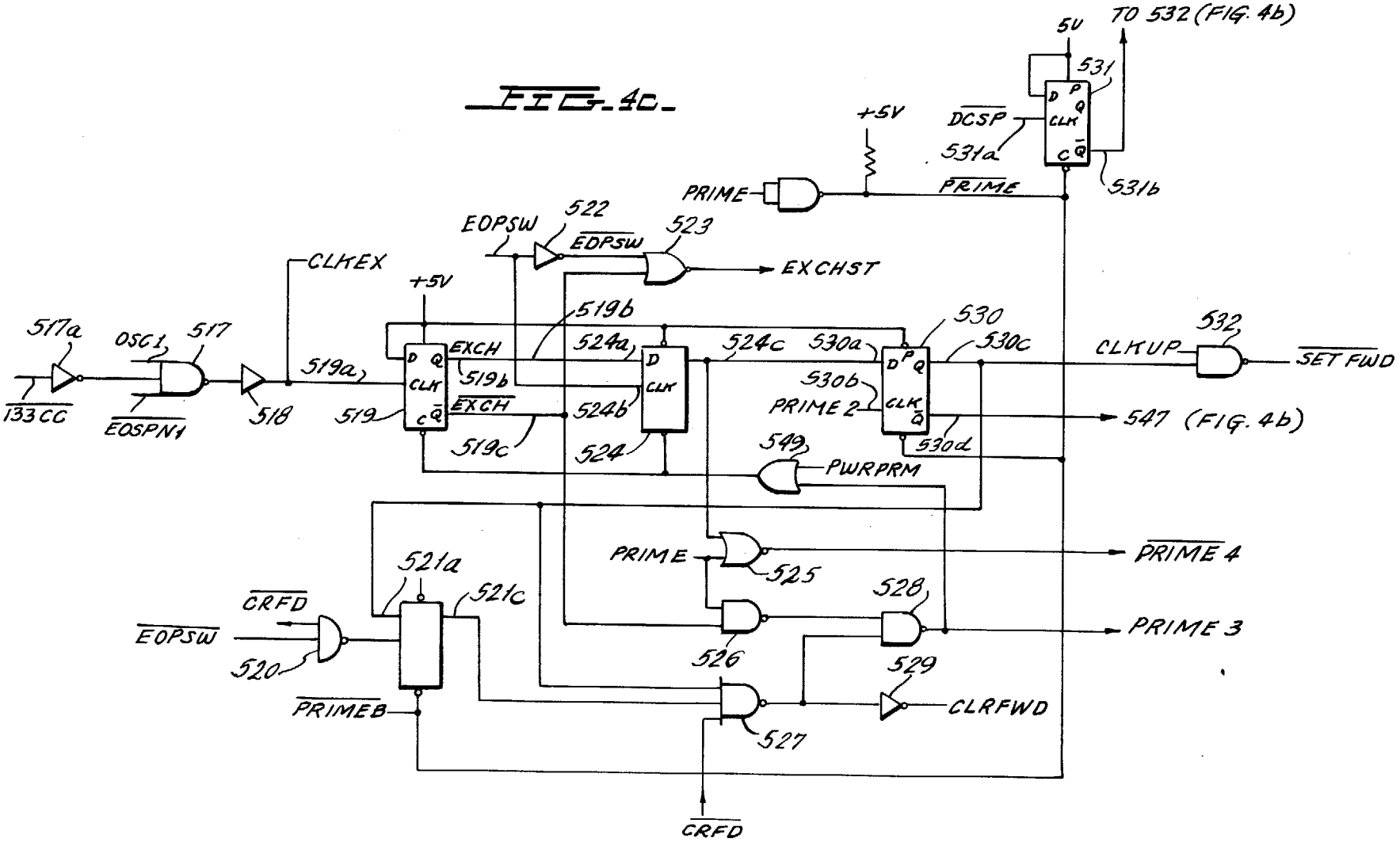
FIG. 4*c* shows the circuitry employed for controlling the printing operation when printing expanded characters.
Figure 4C:
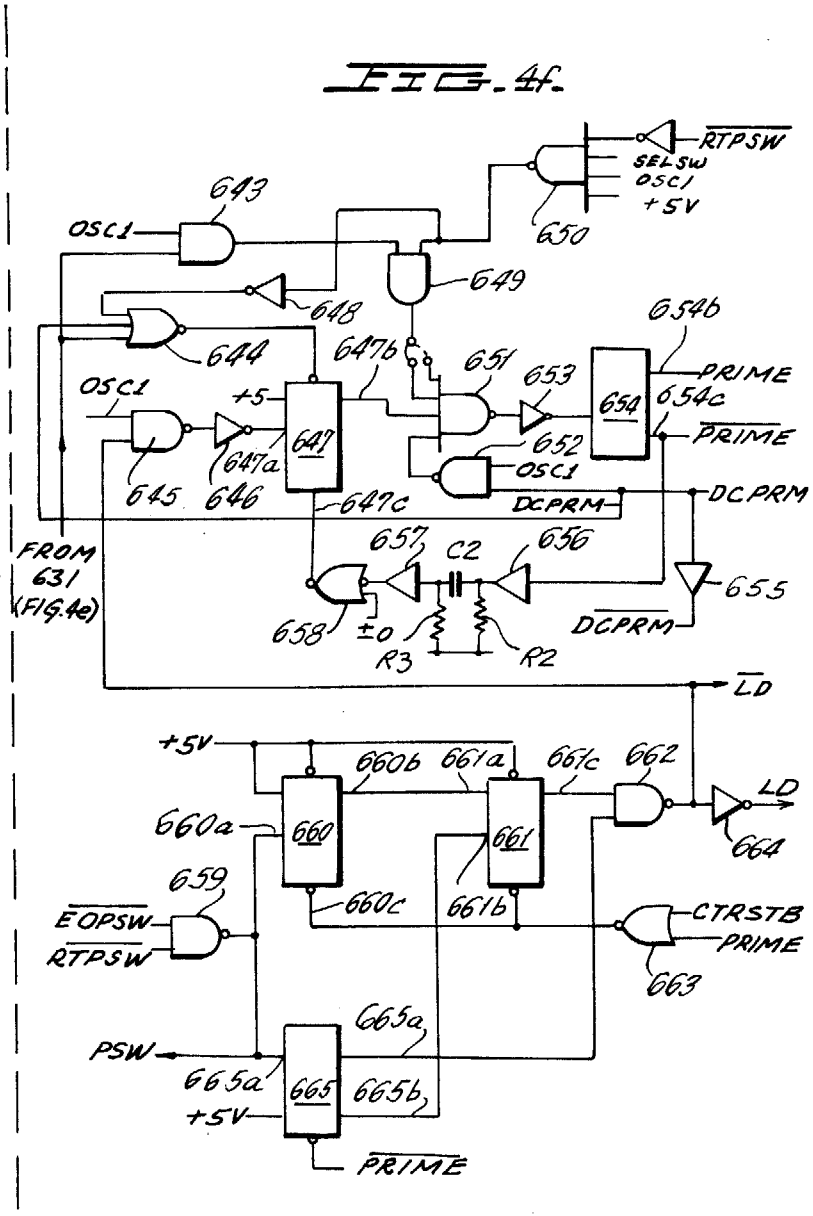
Figure 4D:
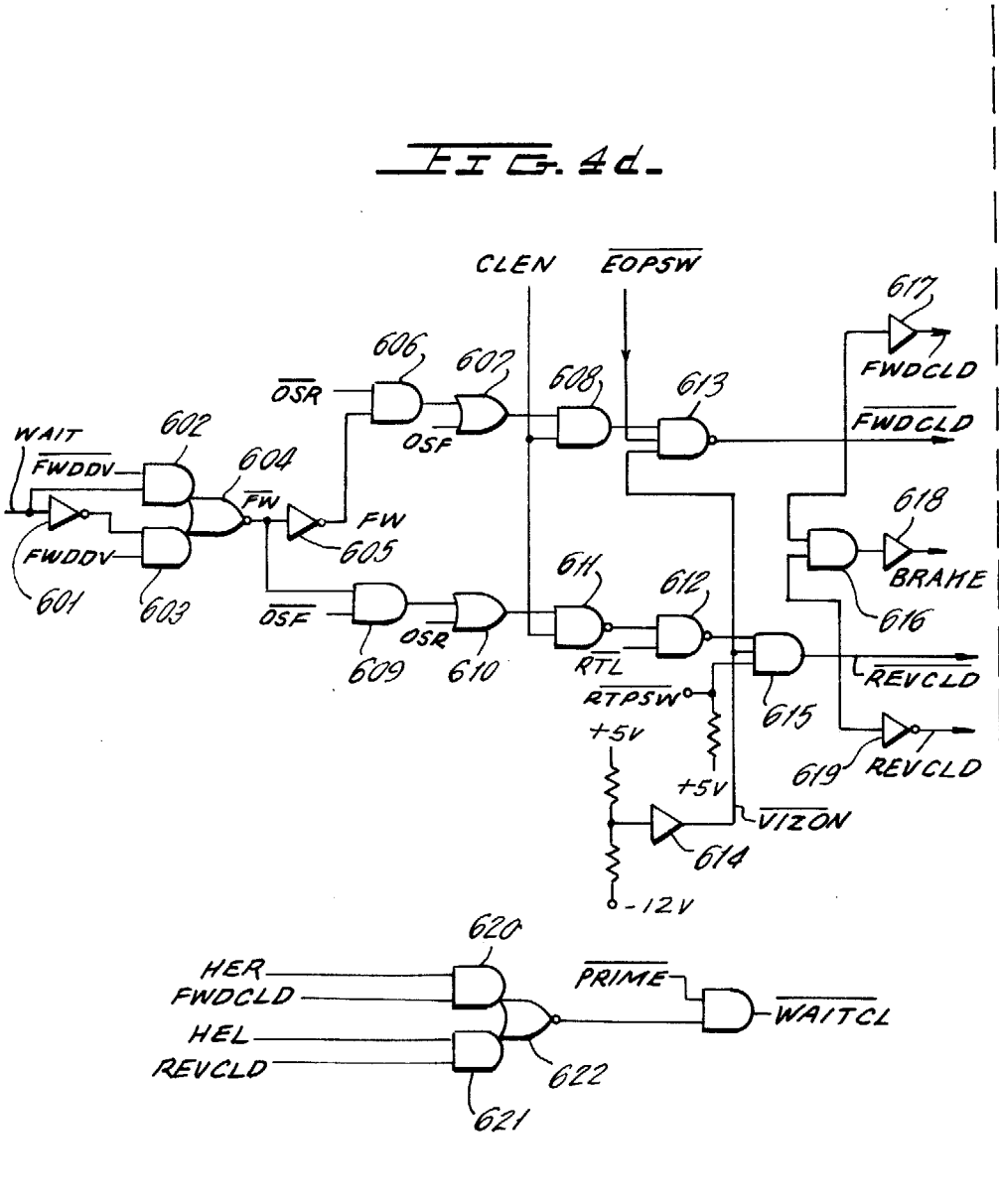
FIG. 4*d* shows the circuitry employed for selectively enabling the forward and reverse clutches and the brake.

Considering FIG. 4*d*, gates 602 and 603 are shown as being coupled to receive the WAIT signal and its inverted state (through inverter 601) as well as being coupled to receive the $\overline{\text{FWDDV}}$ and FWDDV signals respectively. In the case where the head position is not within the character field, the WAIT signal will be low disabling gate 602 and enabling gate 603. Assuming that the head position lies to the left of the left-hand end of the character field, the signal FWDDV will be high enabling gate 603. This causes the output of gate 604 to go low, thereby disabling gate 609. The output state of gate 604 is inverted at 605 to enable gate 606. The signal $\overline{\text{OSR}}$ will be high in this condition since the head is to move in the forward and not reverse direction causing gate 606 to be enabled. This high condition is applied to one input of OR gate 607 causing its output to go high. This high condition is applied to one input of AND gate 608 whose other input receives the clutch enable (CLEN) signal. The clutch enable signal is derived from gate 547 of FIG. 4*b* which has its inputs coupled to output 513*d* of bistable flip-flop 513, output 516*b* of bistable flip-flop 516 and output 530*d* of bistable flip-flop 530, shown in FIG. 4*c*. When at least one of these inputs is low, the output of gate 547 will be high to develop a clutch enable signal (CLEN). This signal conditions gates 608 and 611. However, since the print head 102 is to move in the forward direction the remaining input of gate 611 will be low causing its output to be high. Gate 608, however, applies a high input to gate 613. The remaining inputs of gate 613 are coupled to receive the end of print switch signal ($\overline{\text{EOPSW}}$) and the 12 volt ON signal ($\overline{\text{V12ON}}$). The 12 volt ON signal will be high to indicate that the 12 volt power supply utilized to operate the solenoids is present since its absence or malfunction will cause the solenoids to malfunction. The end of print switch signal will be high, indicating that the print head has not reached the right-hand end of the line of characters and is still free to move toward the right. This thereby causes the output of gate 613 to go low to develop the forward clutch drive signal ($\overline{\text{FWDCLD}}$) which is applied to the forward clutch 108 (FIG. 1) in order to drive the print head toward the right. This signal is also inverted at 617 to provide the signal FWDCLD at the output of inverter 617 which is utilized in a manner to be more fully described.

Gate 616 receives the output of gates 613 and 615. It should be understood that when neither a forward clutch drive nor a reverse clutch drive signal ($\overline{\text{REVCLD}}$) is present, the outputs of both gates 613 and 615 will be high applying high inputs to AND gate 616. This condition is inverted at 618 to provide the $\overline{\text{BRAKE}}$ signal for the purpose of activating the brake mechanism to abruptly halt the print head. In all other instances when either a forward clutch drive or a reverse clutch drive condition is indicated, the output of inverter 618 will be high to deenergize and hence disengage the brake mechanism.

Considering the situation in which the print head is to be driven in the reverse direction, i.e., from right-to-left, gate 602 will provide a high output causing the output of NOR gate 604 to go high thereby applying a low level input to gate 606 and a high level input to gate 609. Gate 610 will thus have its output go high to enable gate 611 when a clutch enable (CLEN) signal is present. This causes the output of gate 611 to go low which, in turn, causes the output of gate 612 to go high. This high condition is applied to one input of gate 615 whose other inputs receive the 12 volt ON signal ($\overline{\text{V12ON}}$) and the $\overline{\text{RTPSW}}$ signal, which is high only when the print head is positioned to the right of the left-hand end of the paper document. This will cause the output of gate 615 to go low to provide a reverse clutch drive signal ($\overline{\text{REVCLD}}$) which functions to operate the reverse clutch in order to drive the print head toward the left.

Considering a case where the print head is to be moved toward the right and lies to the left of the left-hand end of the character field, the forward drive and forward clutch drive signals are applied to gate 489 of FIG. 4*a*. As soon as the head count is equal to the left end of the character field count (i.e., when the print head is actually at the position of the left-hand end point of the character field), the signal HGL will be generated to enable gate 489. The output of gate 489 goes low and is inverted at 492 to apply a high input to bistable flip-flop 494 which operates to switch on a positive going edge causing its output 494*c* to go high. This condition is applied to one input of NOR gate 670 causing its output to go low and thereby provide a $\overline{\text{PRINT}}$ signal which, when low, initiates printing.

Conversely, when the print head lies to the right of the right-hand end of the character field and is being moved in the reverse direction, the signals REVCLD and $\overline{\text{FWDDV}}$ are high so that when the signal HLR (head count less than the right-hand end of the character field) is high, the output of gate 495 goes low, is inverted at 496 and applies a high level to the clock input 497*a* of bistable flip-flop 497. This flip-flop switches on a positive going edge causing its output 497*b* to go high which, in turn, causes the output of NOR gate 670 to go low to initiate printing. The bistable flip-flops 494 and 497 may be reset upon the occurrence of the HER signal at gate 490 to reset bistable flip-flop 494 and thereby terminate printing. Similarly, when printing in the reverse direction, upon the occurrence of the HEL signal at the input of gate 498, bistable flip-flop 497 will be reset to cause its output 497*b* to go high and thereby cause the $\overline{\text{PRINT}}$ signal to go high and thereby terminate printing.

The PTFWD signal appearing at the output 494*c* of bistable flip-flop 494 shown in FIG. 4*a* is applied to gate 700 of FIG. 3*c* to shift the forward register 351 for the printing of each character. The remaining input (CLKFWD) of gate 700 is derived from the output of inverter 784 of FIG. 6, which output goes high before the first dot column of each character is printed in order to clock register 351 before the printing of the next character as the head is moving from left to right.

In situations where printing is to occur by moving the head from right to left, the signal PTREV appearing at output 497*b* of bistable flip-flop 497 (FIG. 4*a*) goes to one input of gate 701 shown in FIG. 3*c*. The other input of gate 701 receives the CLKREV signal from inverter 783 of FIG. 6 to pass pulses to one input of gate 433 to shift reverse register 352 just before the printing of the next character. The remaining inputs of gate 433 are coupled to the output of gate 432 and the output of gate 711.

FIGS. 4*e* and 4*f* show circuitry employed for reinitializing the printer under a variety of conditions.

Inverter 625 of FIG. 4*e* receives the paper movement solenoid signal $\overline{\text{PMSOL}}$ and simultaneously applies this signal to one input of one-shot multivibrator 626 at 626*a* and to one input of gate 627. One-shot 626 has its output 626*b* connected to the remaining input of gate 627. Upon the occurrence of an initial paper movement solenoid signal the one-shot 626 is triggered causing 626*b* to go low. After a delay of 60 milliseconds, 626*b* goes high. If the paper movement solenoid signal is still present, i.e., when a multiple number of single line feed operations are desired, gate 627 is enabled to apply a low condition to one input of gate 631. Instances where gate 627 is enabled are occurrences of a top of form signal and any paper movement other than a single line feed operation which requires an elapsed time of greater than 60 milliseconds.

The output of gate 631 is simultaneously applied to one input of gate 632 and to corresponding inputs of gates 643 and 644 shown in FIG. 4*f* for the purpose of generating a PRIME signal, as will be more fully described.

The remaining inputs to OR gate 632 consist of the CLKEX signal and the EXCHST signal which are respectively generated when in the expanded character mode, as will be more fully described. The presence of any one of the three conditions causes OR gate 632 to go high to clock the bistable flip-flop 635 at clock input 635*a*. This causes outputs 635*b* and 635*c* to go high and low, respectively. Output 635*b* generates an enable load (ENLD) signal through gate 670. This signal is employed at the input of gate 534 shown in FIG. 4*b* to initiate the loading operation of the head position up and down counters as was described hereinabove. This condition is also initiated upon the occurrence of an end of first spin signal ($\overline{\text{EOSPN1}}$) which, as was described previously, is generated at output 434*c* of bistable gate 434, shown in FIG. 3*c*, after the forward register has undergone a complete spin cycle.

The high level at output 635*b* of bistable flip-flop 635 shown in FIG. 4*e* is utilized to cause return of the print head to the extreme left-hand margin of the paper document, as will be more fully described.

Another means for generating the enable load and return to left signals (ENLD and RTL, respectively) is through the use of bistable flip-flop 629, gate 628 and gate 630. In the absence of a printing operation and upon the occurrence of a select signal code, input 629*a* and input 630*a* will both be high causing gate 630 to go low in order to initiate a return to left (RTL) and an enable load (ENLD) signal. Upon the occurrence of either a PRIME 2 or a POWER PRIME (PWRPRM) signal, the output of gate 628 will go low to set output 629*b* low to cause an enable load (ENLD) and a return to left (RTL) signal.

The POWER PRIME signal is generated upon turn on of the equipment. At this time a +5 volt condition will appear at one input of resistor R1. Since capacitor C1 cannot be instantaneously charged a low level will initially be applied to the input of inverter 633 which is inverted at 636 to generate the signal $\overline{\text{PWRPRM}}$ at the output of gate 636. The high level at the output of gate 633 causes the output of gate 628 to go low to set output 629*b* of bistable flip-flop 629 to a low level causing generation of the enable load and return to left signals. As soon as the capacitor C1 charges to a sufficient level, the output of inverter 633 goes low providing a low level at the output of inverter 636. However, when the output of inverter 633 is initially low, the output of inverter 636 is high. This condition is simulataneously applied to the inputs 637*a* and 638*b* of bistable flip-flops 637 and 638. During the high condition the output 637*b* of flip-flop 637 goes high. When the output of inverter 636 is initially low, this causes output 638*c* to go low to generate the signal PRIME 2. This is inverted at 640 to provide the signal $\overline{\text{PRIME 2}}$. The first oscillator pulse phase OSC1 applied to input 638*d* of bistable flip-flop 638 drives output 638*c* high and the output of gate 640 low to clear 635, setting output 635*b* low. Upon the occurrence of the next oscillator output OSC2, the output of gate 639 goes low applying a low to the clear input 637*c* of flip-flop 637 setting output 637*b* low. Upon the occurrence of the next oscillator pulse OSC 1, this condition is clocked into bistable flip-flop 638 causing its output 638*c* to go low causing the output of gate 640 to go high.

Considering the circuitry of FIG. 4*f*, when the output of gate 631 goes high (see FIG. 4*e*), which occurs during a prolonged paper movement operation, oscillator pulses OSC 1 are applied to one input of AND gate 649. Gate 650 also applies OSc1 pulses when the print head is not at the left-hand margin of the paper document. The presence of the oscillator pulses at the outputs of gates 643 and 650 cause pulses to be passed by AND gate 649. When the printer is not in a print condition and when the light emitting diodes (to be more fully described) of the registration system are in operating condition, one input to gate 645 will be high to pass OSC1 pulses to inverter 646 to apply a clock pulse at input 647*a* of bistable flip-flop 647 causing its output 647*b* to go high. The output 647*b* is coupled to one input of gate 651. The remaining input of gate 651 is coupled to the output of gate 652 which is low when no prime signal has been decoded by control code circuit 301 of FIG. 3. Thus, gate 651 will have its output go low, which output is inverted at 653 to apply a trigger pulse at input 654*a* of one-shot multivibrator 654. Output 654*b* goes high and remains high for a time period of the order of 0.16 milliseconds, thereby generating the PRIME signal. Upon the termination of this elapsed time period, output 654*c* goes high to ultimately apply a clear signal to the clear input 647*c* of bistable flip-flop 647 through inverters 656 and 657, gate 658 and resistors R2 and R3 and capacitor C2 (functioning as a delay circuit) so as to reset the output 647*b* to the low condition and remove the PRIME condition.

The light detector circuitry of FIG. 4*f* is utilized to prevent the machine from continuing to operate in situations where the light emitting diode devices employed in the character registration circuitry malfunction. The output of gate 659 goes high as soon as the print head is moved to either the extreme left or right-hand margin of the paper document. This condition is applied to input 660*a* of bistable flip-flop 660 causing its output 660*b* to go high, which condition is applied to input 661*a* of bistable flip-flop 661. As soon as the output of gate 659 goes high, trigger input 665*a* of one-shot multivibrator 665 coupled to gate 659 causes the one-shot to fire, generating a high level at 665*b* and a low level at 665*a*. The high level at 665*b* is applied to the clock input 661*b* of bistable flip-flop 661 causing its output 661*c* to go high. At the end of the delay period, output 665*a* goes high and 665*b* goes low. The conditions at 661*c* and 665*a* are simultaneously applied to the input of gate 662 to generate the low light detector signal $\overline{LD}$ and its inverted stated LD through inverter 664.

The low $\overline{LD}$ signal prohibits bistable flip-flop 647 from initiating a subsequent prime condition while the LD signal provides a lamp indication and, if desired, a tone signal to indicate faulty operation of the light emitting diodes in the character registration circuitry.

Once the print head moves from either the left or right-hand margin and the light emitting diodes are operating properly, a center strobe (CTRSTB) signal is applied to one input of gate 663 to apply a signal to the clear input 660*c* of bistable flip-flop 660 to reset bistable flip-flop 661 and prevent the generation of the light detector signal.

FIG. 4*c* shows the circuitry employed for operating the printer in the expanded character mode. Expanded characters differ from normal characters in that they are double width as each dot column of an expanded character is printed twice. As a result, only 66 characters can be printed on a single line. However, the binary code representing an expanded character is identical to the binary code representing a normal character so that both the forward and reverse registers 351 and 352 can in actuality receive and store binary codes for 132 characters even though only 66 expanded characters can be printed on a single line. If the printer is in the expanded character mode, and more than 66 character codes are inserted into register 351, the circuitry of FIG. 4*c* provides the unique function of printing only 66 expanded characters on a line and thereafter moves the print head to the extreme left-hand margin to enable printing of expanded characters in excess of 66 on the next line of print. Under normal conditions, when the forward register has completed its first spin cycle, the signal $\overline{EOSPN1}$ will be high. At this time, if greater than 132 oscillator pulses are counted by counter 455 of FIG. 4 before the termination of the first spin cycle, then the input to inverter 517*a* will be low causing a high input to be applied to gate 517 enabling an oscillator pulse OSC1 to be passed by gate 517. The low condition is inverted at 518 to generate the signal CLKEX which is applied to one input of OR gate 632, shown in FIG. 4*e* in order to immediately generate an RTL signal so as to return the print head to the left-hand margin of the paper document regardless of its position upon the generation of the RTL signal. This is done to be assured that the printing of the first 66 expanded characters will occur from left to right and printing of the remaining expanded characters shifted into the forward register in excess of 66 will also be printed from left to right, as will be more fully described.

The CLKEX signal is also applied to the clock input 519*a* of bistable flip-flop 519, causing its output 519*b* to go high. This condition is also applied to input 524*a* of bistable flip-flop 524. When the entire line has been printed, the print head will be at the extreme right-hand margin of the paper document causing the generation of the EOPSW signal which is generated typically by a reed relay device energized by a permanent magnet which influences the reed relay device and which permanent magnet is mounted upon the carriage of the print head. When this signal goes high, it clocks input 524*b* of bistable flip-flop 524 to set output 524*c* high. This high level is applied to one input of gate 525 whose output will then go low to develop a PRIME 4 signal which is applied to input 463*b* of latch circuit 463 shown in FIG. 4, as well as being inverted at 450*a* of FIG. 4 to be applied as a $\overline{PRIME\ 4}$ input to both of the up and down counters 450 and 451. This causes a clear operation clearing counters 450 and 451 to prevent the operation of comparators 464 and 476 of FIG. 4 during an expanded character printing mode.

The high level at the output 524*c* of bistable flip-flop 524 is applied to input 530*a* of bistable flip-flop 530, upon the occurrence of a PRIME 2 signal which is developed at the output 638*c* of bistable flip-flop 638 (FIG. 4*e*) as a result of the print head having been moved to the left-hand margin of the paper document. This signal is generated by a similar reed switch to that described hereinabove to develop a low $\overline{RTPSW}$ signal applied to input 637*d* of bistable flip-flop 637 (FIG. 4*e*) presetting output 637*b* to a high condition. This is clocked into bistable flip-flop 638 upon the occurrence of the next oscillator pulse OSC1 causing the output 638*c* to go high and develop the PRIME 2 signal. This signal clocks the high level at input 530*a* of bistable flip-flop 530 shown in FIG. 4*c* to cause its output 530*c* to go high. This condition, together with a clock up (CLKUP) signal applied to gate 532 causes its output to go low to generate the $\overline{SET\ FWD}$ in order to preset bistable flip-flop 494 of FIG. 4*a* to cause its output 494*c* to go high to generate the print forward (PT FWD) signal to enable printing to occur in the forward direction.

Output 530*c* is further coupled to one input of gate 527 and to input 521*a* of bistable flip-flop 521. At the end of the line of print signal or upon the detection of a carriage return forward signal ($\overline{CRFD}$), either of these signals goes low causing the output of gate 520 to go high to clock the high level at input 521*a* of bistable flip-flop 521 and thereby cause output 521*c* to go high. This high level is applied to one input of gate 527 whose output goes low when these two conditions are present together with the condition that no character return forward code has been detected. This low level is applied to one input of gate 528 causing its output to go high. This high level state (the PRIME 3 signal) is applied to one input of gate 549 whose output goes low to clear bistable flip-flops 519 and 524 and set their outputs 519*b* and 524*c* to a low level.

The output of gate 527 is inverted at 529 to develop the clear forward signal (CLR FWD) which is applied to OR gate 505 of FIG. 4*a* to provide a high level at the output of gate 505. This high level is applied to one input of NOR gate 493*c* through gate 493*b* to clear bistable flip-flop 494 and thereby set its output 494*c* low (FIG. 4*a*).

Gate 526 receives the PRIME signal and the output 519c of bistable flip-flop 519 and goes low upon the occurrence of a PRIME signal and when the printer contains no expanded characters in excess of 66 in the forward register to cause the output of gate 526 to go low and keep the output of gate 528 high.

After 66 of the expanded characters have been printed and the register still contains character codes in excess of 66, output 519*c* of bistable flip-flop 519 goes low. This condition is applied to one input of NOR gate 523. After the printing of the 66 expanded characters, the end of print switch signal (EOPSW) is generated and is inverted at 522. With two low conditions at the inputs of NOR gate 523, its output goes high developing the signal EXCHST which is applied to one input of OR gate 632 shown in FIG. 4*c* to generate an RTL signal causing the print head to return to the left-hand margin in order to print the remaining expanded characters in excess of 66 on the next line. This technique not only permits the loading of expanded characters in excess of 66 without loss of these characters, but further assures that the appropriate order of the characters will be preserved.

APPARATUS FOR DETERMINING DIRECTION OF MOVEMENT OF THE PRINT HEAD AND FOR CONTROLLING ACCURATE REGISTRATION OF CHARACTERS

As is set forth in U.S. Pat. No. 3,703,949 the technique for printing characters utilizes an elongated strip provided with a plurality of preferably equispaced transparent slits formed on an opaque substrate. This elongated strip is mounted substantially parallel to the paper document and is designed to cooperate with a light source of photocell mounted on the printer head carriage with the light source positioned to one side of the registration strip and the photocell positioned to the opposite side. As the light source passes a slit, the photocell detects the presence of light to generate what is referred to as a strobe (STROBE) pulse which enables the solenoids of the print head at the proper moment, i.e., only as the print head is passing the slit. This assures precise registration of each character regardless of the speed of movement of the print head and regardless of any changes in the speed of movement of the print head.

Figures 5A, 5B, 5C:
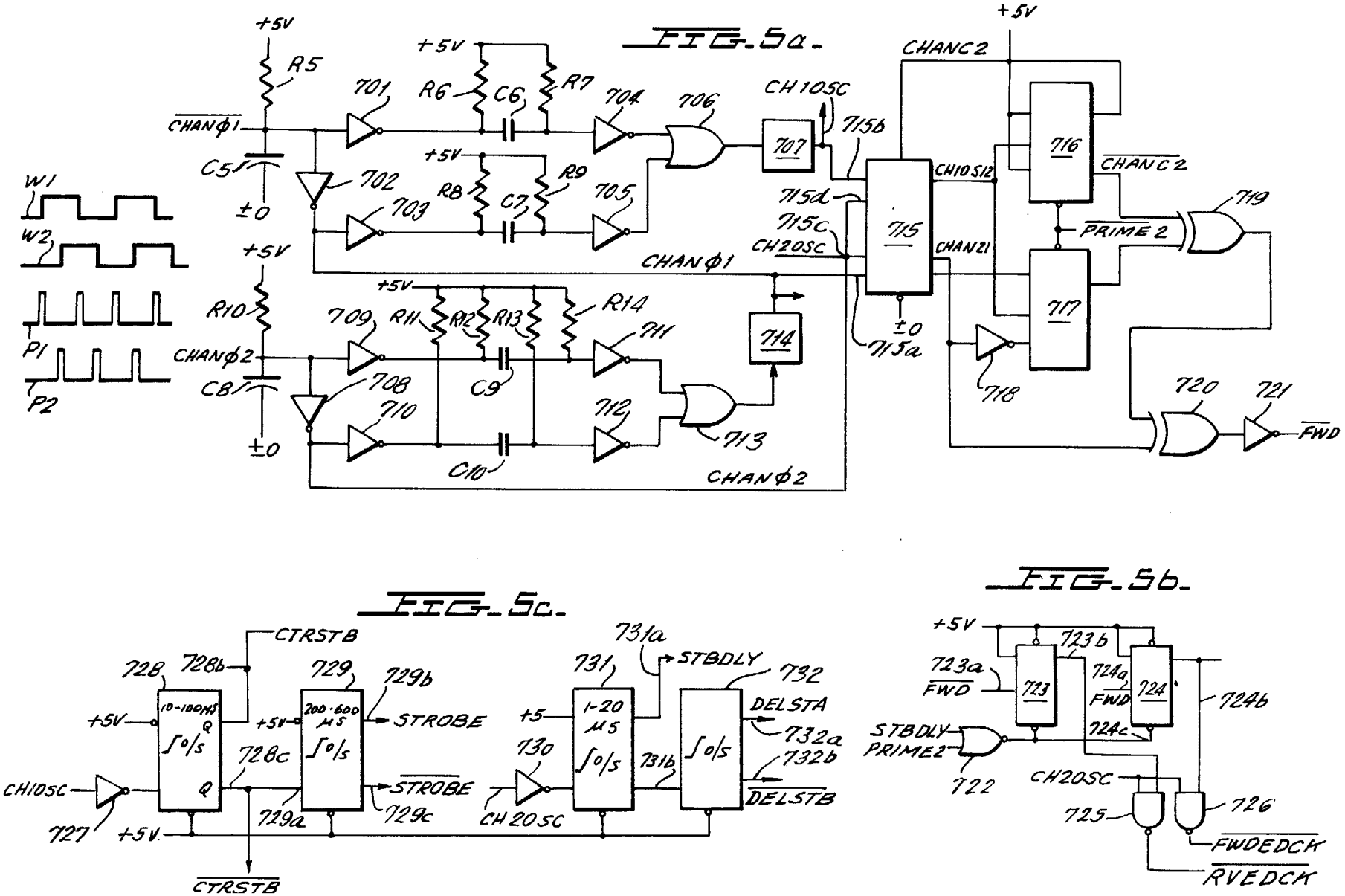
FIG. 5*a* shows a block diagram of the circuitry employed for determining the direction of movement of the print head at any given instant.
FIG. 5*b* is a block diagram showing the circuitry employed for creating "artificial" registration pulses upon the initiation of movement of the print head from other than the left and right-hand margins.
FIG. 5*c* shows a block diagram of the circuitry employed to provide the strobing pulses for printing full-step and half-step dot columns.

Although the technique described hereinabove functions quite well in line printers designed to print only from left to right in the random access printer of the present invention, means must be provided to detect the direction of movement of the head at all times. In the present invention this is achieved by providing a novel registration strip which cooperates with two separate photosensitive devices aligned 90° out of phase. FIG. 5*a* shows the circuitry employed for this purpose. The optical registration components briefly consist of an elongated registration strip and first and second photodetector devices for each channel, which photodetection devices generate square pulses that are high for 180°. The channel 2 waveform W2, when moving in the forward direction is delayed from the channel 1 waveform W1 by 90°. When moving in the reverse direction, the channel 1 waveform W1 is delayed from the channel 2 waveform W2 by 90°. The channel 1 waveform identified by $\overline{\text{CHAN01}}$ is applied to the common terminal of R5 and C5 which simultaneously applies the signal to inverters 701 and 702. The output of inverter 701 is coupled to a differentiation circuit comprised of resistors R6 and R7 and capacitor C6. The output of the differentiator is coupled to an inverter 704 whose output is applied to OR gate 706. The common terminal between resistor R5 and capacitor C5 is also coupled to inverter 702 whose output is simultaneously coupled to input 715*a* of AND/OR gate 715 and to one input of inverter 703. The output of inverter 703 is coupled to a differentiation circuit comprised of resistors R8 and R9 and capacitor C7. The output of the differentiation circuit is applied to the remaining input of gate 706 through inverter 705. The output of gate 706 serves to generate a positive going pulse at both the leading and trailing edges of waveform W1, as shown by waveform P1. These pulses are sharpened and widened by a one-shot multivibrator 707. The pulses generated as shown by waveform P1 have a pulse width of the order of 2 microseconds and the one-shot multivibrator 707 serves to lengthen those pulses to a pulse length of the order of 10 microseconds. The output of one-shot multivibrator 707 is coupled to input 715*b* of AND/OR gate circuit 715. The channel 2 square pulses represented by waveform W2 are treated in a similar manner whereby ultimately the output of one-shot multivibrator 714 (which is the same one-shot 707) generates square pulses of 10 microsecond pulse width at the leading and trailing edges of each of the positive going square pulses shown by waveform W2. The output of one-shot 714 is coupled to input 715*c* of circuit 715. The output of inverter 708 passes the square pulses as shown by waveform W2 to input 715*d* of circuit 715. The CHANC2 output switches multiplexer 715. The switching of 715 creates signal CHOS12 from CH10SC and CH20SC. It creates signal CHAN21 from CHAN01 and CHANO2. CHOS12 is used to clock flip-flops 716 and 717. CHAN21 sets up flip-flop 717. The signals out of 716 and 717 are compared in EXCLUSIVE-OR gate 719. The output of 719 and CHAN21 are compared in the EXCLUSIVE-OR gate 720.

The output of EXCLUSIVE-OR gate 720 will be high to develop the forward signal FWD when the head is traveling in the forward direction. When the output of EXCLUSIVE-OR gate 720 is low, the signals FWD will be low, which signal is inverted at 721 to provide a high $\overline{\text{FWD}}$ signal. Since only one of the signals FWD and $\overline{\text{FWD}}$ is high at any given time, that signal which is in the high state represents the direction of travel of the head.

FIG. 5*b* shows the circuit employed for artifically developing pulses which assure alignment of dot columns on the paper document. As was described hereinabove, the registration strip consists of transparent slits of equal width and uniformly spaced from one another by interspersed opaque bars. The photodetector, which detects the passage of light through a slit, picks up light as the photodetector and its accompanying light source move past an opaque bar and into the region of a slit. In moving in the forward direction, the photodetector will actually be passing the next opaque bar to the right of the slit when printing actually occurs due to the time required to fire a solenoid pin which is of the order of 500 microseconds. When the print head moves in the reverse direction, the photodetector is energized as the photodetector passes the bar to the right of the aforementioned slit. However, firing of the solenoid pin will occur at a time when the photodetector is passing the opaque bar to the left of the aforementioned slit so that dot columns of succeeding lines will be offset from one another. In order to eliminate this condition, artificial pulses are generated when the head first begins moving in either the forward or reverse direction.

Let it be assumed that the head is about to move in the forward direction. The FWD signal at the output of exclusive OR gate 720 of FIG. 5*a* will be high. This is applied to clock input 724 of bistable flip-flop 724 to clock in a high state at 724*b*. Upon the occurrence of the first channel 2 oscillator signal (CH20SC) at the output of one-shot multivibrator 714, gate 726 will be enabled to go low and develop a forward edge clock signal $\overline{\text{FWDEDCK}}$. Bistable flip-flop 724 is reset by a strobe delay signal STBDLY applied to gate 722 which goes low to apply a clear signal at input 724*c* causing output 724*b* to go low and disable gate 726.

As the head begins to move in the reverse direction, the signal $\overline{\text{FWD}}$ goes high. This positive going transition is applied at the clock input 723*a* of bistable flip-flop 723 causing its output 723*b* to go high and thereby enabling gate 725 to develop a low level reverse edge clock signal $\overline{\text{RVEDCK}}$. Bistable flip-flop 723 is reset by a strobe delay signal in the same manner described in connection with flip-flop 724 to prevent the generation of more than one reverse edge clock signal. A PRIME 2 signal applied to gate 722 also resets bistable flip-flops 723 and 724 each time a prime condition or ready to print switch condition occurs.

FIG. 5*c* shows the circuitry employed for generating strobe and delay strobe signals which are utilized in the following manner:

The printer is capable of printing dots arranged in a 5 column by 7 row matrix, printing occurring sequentially by dot columns. In cases where it is desired to print characters with increased definition, this matrix can be increased to a 7 row by 9 column matrix. In order to provide this capability without alteration in the optical registration apparatus and specifically in the registration strip which contains the equispaced transparent slits, a delay strobe signal is provided which is generated midway between the strobe signals which trigger the solenoids to print each dot column.

As shown in FIG. 5*c*, the output of one-shot multivibrator 707 (signal CH10SC FIG. 5*a*) is applied to inverter 727 to trigger the operation of one-shot multivibrator 728 whereby its outputs 728*b* and 728*c* go high and low, respectively. After reset of one-shot 728, outputs 728*b* and 728*c* go low and high, respectively, applying a positive going edge to trigger input 729*a* of one-shot multivibrator 729 causing its outputs 729*b* and 729*c* to generate positive and negative going pulses, respectively, whose pulse widths are typically of the order of 200–600 microseconds. The STROBE signal at the output 729*b* is the signal employed for firing the solenoids at a time of the order of 200 milliseconds after each CH10SC pulse.

The output of one-shot multivibrator 714 (FIG. 5*a*) is applied to one input of inverter 730 which triggers one-shot multivibrator 731 to generate the strobe delay signal STBDLY at output 731*a*. Outputs 731*a* and 731*b*, respectively, generate positive and negative going pulses having a pulse width of less than 20 microseconds. When one-shot 731 resets, output 731*b* goes high, triggering one-shot multivibrator 732, whose outputs 732*a* and 732*b* respectively generate positive and negative going pulses of a pulse width of the order of 200 microseconds. The output at 732*a* is utilized to control the printing of half-step dot columns.

Output 728*b* of bistable flip-flop 728, which develops the center strobe (CTRSTB) signal is coupled to one input of gate 663 shown in FIG. 4*f* which serves to reset the light detector circuitry flip-flops 660 and 661 upon the occurrence of each CTRSTB pulse to prevent an erroneous indication of false operation thereof. Output 731*a* of bistable flip-flop 731 which develops the strobe delay (STBDLY) signal has its output coupled to the input of gate 722 shown in FIG. 5*b* for resetting flip-flops 723 and 724 immediately after one of the gates 725 or 726 has been operated.

Figures 6, 6A:
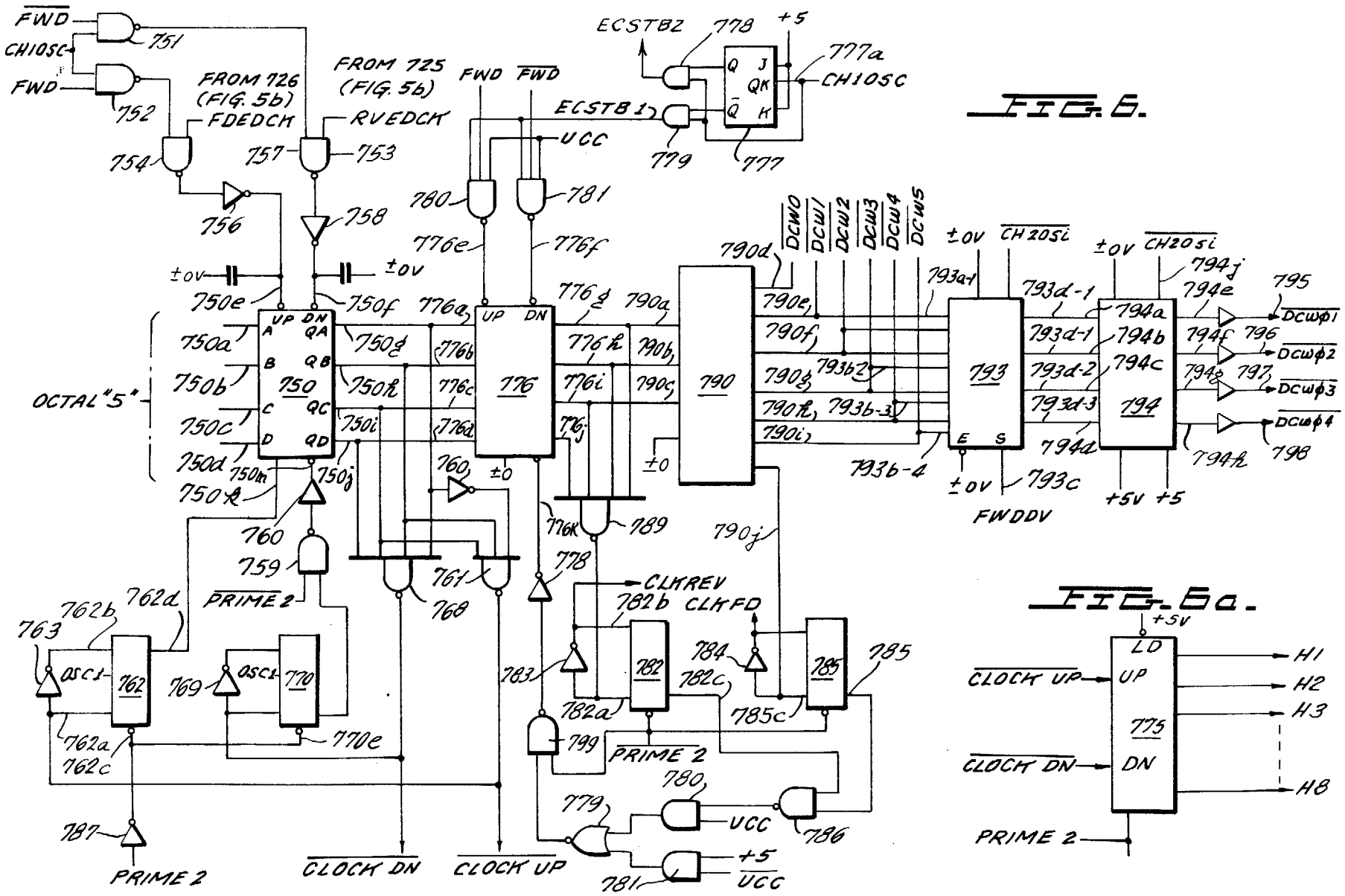
FIG. 6 is a block diagram showing the circuitry employed for generating the dot column selection signals for forward or reverse printing and for printing of 5 × 7 or 9 × 7 matrix characters or for graphic printing.
FIG. 6*a* is a block diagram showing the head counter employed for maintaining a binary count representative of the position of the print head at any given instant.

FIG. 6 shows the circuitry employed for controlling the selection of dot columns for the character generators for printing. The printing technique briefly consists of printing (for 5×7 dot matrix) five dot columns in succession to form a single character, allowing a space, i.e. not printing, or a width substantially equal to a dot column and subsequent thereto printing the next five dot columns in succession for forming the next character. The print head is provided with seven print wires arranged along an imaginary vertical line and capable of being fired simultaneously in any combination from none of the solenoids up to a maximum of seven. In printing in the forward direction, dot columns are printed in the order of 1st, 2nd, 3rd, 4th and 5th. However, printing in the rearward direction must occur such that dot columns will be printed in the reverse order, i.e. 5th, 4th, 3rd, 2nd and 1st dot columns.

With this arrangement in mind, FIG. 6 provides an up/down counter 750 whose inputs 750*a*–750*d* are hardwired for loading an octal five code therein. Up pulses are applied at input 750*e* while down pulses are applied at input 750*f*. Up/down counter 750 is capable of counting to a maximum of 1111 in binary code which is the equivalent of decimal 15, the output states appearing at 750*g*–750*j*. Input 750*k* is adapted to clear the contents of the counter so that its output is 0000 when triggered. Input 750*m* is a load input terminal adapted to load the octal five condition hardwired to 750*a*–750*d* when triggered.

When the print head is moving the circuitry of FIG. 5*a* operates to determine the direction of movement. The two outputs FWD and $\overline{\text{FWD}}$ are applied at respective inputs of gates 751 and 752. It can clearly be seen that only one of these gates will be conditioned to pass pulses from the output of one-shot multivibrator 707 of FIG. 5*a* with the enabled gate being determined by the direction in which the print head is moving. Thus, either gate 751 or 752 will pass output pulses from one-shot multivibrator 707 through either gate 753 or gate 754. The outputs of gates 726 and 725, shown in FIG. 5*b*, are coupled to the remaining inputs of gates 753 and 754. The forward edge clock and reverse edge clock signals are normally high except upon initiation of movement of the print head, at which time the output of one of these gates will go low, depending upon the direction of movement of the print head. When the head first starts moving in the forward direction, for example, gate 754 will go high before the first channel 1 oscillator signal. This state is inverted at 756 to apply a low level to "up" input 750*e* to advance the state of the counter. Thereafter, and upon the occurrence of the STBDLY signal the forward edge clock signal FWDEDCK will go high allowing one channel 1 oscillator pulse to be applied to the up input of counter 750. Prior to initiation of the operation of counter 750, a $\overline{\text{PRIME 2}}$ condition causes gate 759 output to go high. This is inverted at 760 causing the load input to go low thereby setting an octal 5 into the counter. The forward edges of the clock pulse causes the counter to count up which changes the count to octal six. The code for octal six is decoded by gate 761 to apply a low level to input 762*a* of bistable flip-flop 762 and to apply a high level to input 762*b* through inverter 763. Upon the occurrence of the next 0SC1 signal at the clock input 762*c* output 762*d* goes high to clear counter 750 and reset it to 0000. The decoding of the octal six condition and clearing of the counter occurs within the order of 2 microseconds.

Thereafter, channel 1 oscillator pulses CH10SC continue to be applied to counter 750 to increment so that succeeding counts are (in octal form) 1, 2, 3, 4, 5. Upon the occurrence of the next octal six condition, decoder gate 761 forces counter 750 into the octal zero state. Thus, so long as the print head is moving in the forward direction, counter 750 counts from octal zero through octal five, is reset to octal zero when an octal six condition to operate is detected and continues in this manner until the line of characters being printed is completed.

In the reverse print direction, gate 752 is disabled and gate 751 is enabled to pass channel 1 oscillator pulses. As soon as the head begins to move in the reverse direction, the reverse edge clock signal ($\overline{\text{RVEDCK}}$) goes low causing a low condition to be applied to the down input 750*f* to insert an initial reverse edge clock pulse after the counter 750 has been set by a PRIME 2 signal to set the octal 5 condition therein. Thereafter, channel 1 oscillator pulses are applied to the clock "down" input to cause the counter to be decremented in the order octal 5, 4, 3, 2, 1, 0. After octal 0, the counter generates the code octal 15, which is decoded by gate 768 to set bistable flip-flop 770 and cause a load signal to be applied at input 750*m* to load the octal 5 state in the counter. Thus, when printing in the reverse direction, counter 750 generates binary signals representative of octal 5, 4, 3, 2, 1, 0, 5, 4, 3, 2, 1, 0, etc.

As was described hereinabove, when printing characters of the 5×7 matrix type, each character is formed through the printing of 5 dot columns. As will be noted, counter 750 has six different octal output states. The sixth state is utilized to identify the space between adjacent characters. As was described hereinabove, when the print head is moving in the forward print direction, the forward edge clock applies the first up pulse to the counter 750 into the octal 6 output condition immediately after it has been loaded with the octal 5 state, which octal 6 condition is immediately detected to clear the counter and thereby drive it into the octal 0 state. This condition, which causes clearing of the counter and appears at the output of gate 761 constitutes the $\overline{\text{CLOCKUP}}$ signal which is applied to the head counter 775 shown in FIG. 6*a*. Head counter 775 is an up/down counter which is incremented by clock up pulses and which is decremented by clock down pulses.

In the reverse direction, the detection of an octal 15 condition at the output of decoder gate 768 develops the clock down pulses $\overline{\text{CLOCKDN}}$ for decrementing head counter 775 so as to keep an accurate count in binary form of the head position regardless of which direction the head may be moving.

Returning to FIG. 6, the print control circuitry is further comprised of an up/down counter 776 identical to up/down counter 750. Its inputs 776*a* through 776*d* are coupled to the outputs of counter 750. A bistable flip-flop 777 has its clock input 777*a* coupled to receive the channel 1 oscillator pulses. Bistable flip-flop 777 functions as a divide by two circuit to condition gates 778 and 779 to be enabled by a channel 1 oscillating pulse (coupled to the remaining inputs of gates 778 and 779) at half the frequency rate of the channel 1 oscillator signal. The output of gate 779, which constitutes the expanded character strobe signal ECSTB1, is applied to one input of gates 780 and 781. These gates are disabled whenever in the normal printing mode. However, when in the expanded character mode, signal UCC is high. When the printer is printing in the forward direction, the signal FWD is high to enable ESCTD1 pulses to be passed through gate 780 to increment counter 776. Conversely, when printing in the reverse direction the $\overline{\text{FWD}}$ signal is high causing gate 781 to pass pulses to decrement counter 776.

Counter 776 has a load input 776*k* for loading in the contents applied to its inputs 776*a*–776*d* from the outputs 750*g*–750*j* of counter 750. This is accomplished by means of gate 799 which passes a $\overline{\text{PRIME 2}}$ signal applied to one of its inputs, through inverter 778 to load the contents of counter 750 into counter 776. The signal $\overline{\text{PRIME 2}}$ is also applied to inverter 787 which places a low level signal at the clear inputs 762*e* and 770*e* of bistable flip-flops 762 and 770. When the output 762 goes low, counter 750 is cleared and thus develops an octal 0 at its outputs 750*g*–750*j*. This condition (octal 0) is loaded into counter 776. In the forward mode, due to the divide by two action of bistable flip-flop 777, counter 776 is incremented at one-half the rate of counter 750. Counter 776 counts through octal 1, 2, 3, 4, 5, 6, . . . 14 and 15. At this time decoder gate 789 decodes an octal 15 condition to cause its output to go low. The low level is applied to input 782*a* of bistable flip-flop 782. This level is inverted at 783 to apply a high level at input 782*b* causing output 782*c* of the bistable flip-flop to go low. This causes gate 786 to develop a high level at its output which, in turn, causes the output of gate 780 to go high, since the printer has been assumed to be operating in the expanded character mode at which time UCC is high. This high state causes the output of gate 779 to go low causing a high condition at the output of gate 799 which is inverted at 778 to cause a load operation to load the contents of counter 750 at this time into counter 776. As was set forth hereinabove, counter 750 counts at twice the rate of counter 776 so that counter 750 at this time will be in an octal 0 state thereby driving the outputs 776*g*–776*j* of counter 776 into the octal 0 state in a time period of the order of two microseconds (similar to that of counter 750).

The output of AND gate 789 which functions as a decoder, after inversion at 783, develops the clock reverse signal (CLKREV) which is applied to one input of gage 701 shown in FIG. 3*c*. This pulse is developed upon the completion of printing of each character and is passed by gates 701 and 433 and inverted 434 and is identified as the clock reverse register signal $\overline{\text{CLKTBR}}$ shown in FIG. 3*c*. This signal is applied to the similarly marked line of FIG. 3*b* to clock binary words out of the reverse register 352 at the printing rate.

The outputs 776*g*–776*i* are applied to respective inputs 790*a*–790*c* of a binary to decimal decoder 790 which functions to convert the binary input information into a decimal output form. As will be noted, only the first three outputs of counter 776 are applied to binary to decimal decoder 790 which is adapted to generate a decimal output from 0–7. When the octal code for zero (0) is applied to decoder 790 only output line 790*d* will be low to develop the signal $\overline{\text{DCW0}}$ while the remaining lines 790*e*–790*j* will be high. Counter 776 is incremented when printing in the forward direction. The code for octal 1 will next be presented to decoder 790 causing line 790*d* to go low and shifting line 790*e* to the high state. This operation continues through six steps to sequentially develop the signals $\overline{DCW0}$ - $\overline{DCW5}$, which signals are directly applied to the character generator circuits to be more fully described.

Signal $\overline{DCW0}$ identifies the blank state provided between adjacent characters while signals $\overline{DCW1}$ - $\overline{DCW5}$ are employed to step out of the character generator the dot column patterns for the first through fifth dot columns utilized to form a character.

When a count of octal 7 is generated by counter 776, output 790*j* goes low to set output 785*c* of bistable flip-flop 785 to the low state causing the output of gate 786 to go high. In the expanded character mode the output of gate 780 goes high causing the output of gate 779 to go low, the output of gate 799 to go high and the output of inverter 778 to go low to provide a load condition on counter 776 to load in the contents of counter 750. The low level at the output of 790*j* of binary to decimal decoder 790 is inverted at 784 to generate the clock forward signal CLKFWD. This signal is applied to one input of gate 700 shown in FIG. 3*c*. The clock forward signal is passed through gate 700 whenever printing occurs in the forward direction as a result of the occurrence of the print forward signal PT FWD which enables gate 700 to pass the clock forward pulses which occur at the printing rate. These signals are, in turn, passed through gate 408 and inverter 408*a* to develop the clock forward register signal $\overline{CLKTB}$, which signal is applied to a similarly designated line in FIG. 3*b* to shift binary words out of the forward register 351 at the printing rate.

In applications where the printer is printing normal and not expanded characters, the signal $\overline{UCC}$ will be high. This level is applied to the input of gate 781 shown in FIG. 6 to cause the output of gate 779 to be low. This causes the output of gate 777 to be high and the output of inverter 778 to be low to maintain a low level at the load input 776*k* of counter 776. This condition is maintained so long as normal characters are being printed. As a result, the contents at the outputs 750*g*–750*j* of counter 750 are continuously loaded into counter 776. It will be noted that gates 780 and 781 can neither increment nor decrement counter 776 since during normal printing signal UCC is low thereby disabling gates 780 and 781. As a result, the output states of outputs 776*g*–776*j* will be identical to the outputs 750*g*–750*j* of counter 750 when printing in the normal mode and it is only when printing in the expanded character mode that the octal outputs of counter 776 are generated at half the frequency rate of generation of counter 750. Thus, binary to decimal decoder 790 will generate the signals $\overline{DCW0}$ - $\overline{DCW5}$ either at the normal rate of counter 750 or at the half frequency rate of counter 776 when in the expanded character mode. The printer described herein has a further capability of printing characters or other symbols in a 9×7 matrix consisting of 9 columns and 7 rows. As was mentioned hereinabove, the binary to decimal decoder 790 generates only five signals ($\overline{DCW1}$ - $\overline{DCW5}$) which are utilized to print the five columns of a 5 column by 7 row matrix. In order to provide means for printing nine columns in a 9 column by 7 row matrix, there is provided a bistable latch 793 which has 8 inputs. These inputs are divided into two groups 793*a*-1 through 793*a*-4 and 793*b*-1 through 793*b*-4. Inputs 793*a*-1 through 793*a*-4 are respectively coupled to output lines 790*e*, 790*f*, 790*g* and 790*h* which, respectively, generate $\overline{DCW1}$ - $\overline{DCW4}$ signals. The remaining set of inputs 793*b*-1 through 793*b*-4 are coupled to outputs 790*f*-790*i* of decoder 790 which, respectively, generate the signals $\overline{DCW2}$ - $\overline{DCW5}$.

In the forward printing mode and with characters formed by a 9 column by 7 row matrix, it will be remembered that counter 750 develops at its output octal 5, 0, 1, 2, 3, 4, 5, 0 and so forth. When in the non-expanded character mode, it will be remembered that counter 776 develops at its output whatever octal state appears at the output of counter 750. Thus, binary to decimal decoder 790 will generate signals in the forward mode, i.e. $\overline{DCW0}$, . . . $\overline{DCW5}$. In the forward mode, the forward drive signal FWDDV is applied to input 793*c* of bistable latch 793 which functions to cause whatever appears at inputs 793*a*-1 through 793*a*-4 to appear at the outputs 793*d*-1 through 793*d*-4 respectively. This means that whenever line 790*e* is low, line 793*d*-1 will be low, whenever line 790*f* is low, line 793*d*-2 will be low, and so forth.

The outputs 793*d*-1 through 793*d*-4 are respectively connected to inputs 794*a*-794*d* of a parallel in, parallel out circuit 794 which functions to couple whatever appears at its input terminal directly to its associated output terminals 794*e*–794*h* only upon the occurrence of a clock signal at its input 794*j*. This input receives the clock 2 oscillator signal ($\overline{CH2OSC}$) from the output of one-shot multivabrator 714 shown in FIG. 5*a* which, it will be remembered, generates a positive going pulse 90° out of phase with the pulses generated by the channel 1 oscillator 707 of FIG. 5*a*. Thus, the output levels at 794*e*–794*h* do not appear until the clock signal occurs. These levels are inverted at 795-798 to develop the "half-step" signals $\overline{DCW\theta 1}$ - $\overline{DCW\theta 4}$ each occurring at an instant of time which is equidistant from the instant of time of the full step signals $\overline{DCW1}$ - $\overline{DCW5}$. Thus, when printing 9 column by 7 row matrix characters, the sequence of the signals applied to the character generator are as follows: $\overline{DCW0}$ (no printing occurring at this time), $\overline{DCW1}$ (first full-step), $\overline{DCW\theta 1}$ (first half-step), $\overline{DCW2}$ (second full step), $\overline{DCW\theta 2}$ (second half-step), . . . , $\overline{DCW5}$ (fifth full step).

When operating in the reverse printing mode and when printing 9 column by 7 row characters of the non-expanded type, it will be remembered that counter 750 counts, in octal code, in the order 5 4 3 2 1 0 5 4 3 2 1 0, etc. These states are constantly loaded into the counter 776 and converted into decimal fashion by decoder 790. Due to the reverse octal order, the signals out of decoder 790 will be in the order $\overline{DCW5}$ - $\overline{DCW0}$. When printing in the reverse mode, the signal FWDDV will be low so as to transfer to the outputs 793*d*-1 through 793*d*-4, the levels occurring at the inputs 793*b*-1 through 793*b*-4, respectively. These levels are passed by parallel in, parallel out circuit 794 only upon the occurrence of each channel 2 oscillator pulse ($\overline{CH2OSC}$) to assure appropriate timing. Thus, the order of generation of the signals will be as follows: $\overline{DCW5}$ (first full step to be printed), $\overline{DCW4\theta}$ (first half-step to be printed), $\overline{DCW4}$ (second full step to be printed) . . . , $\overline{DCW\theta 1}$ (fourth half-step to be printed), and $\overline{DCW1}$ (fifth and final full step to be printed).

Figure 7:
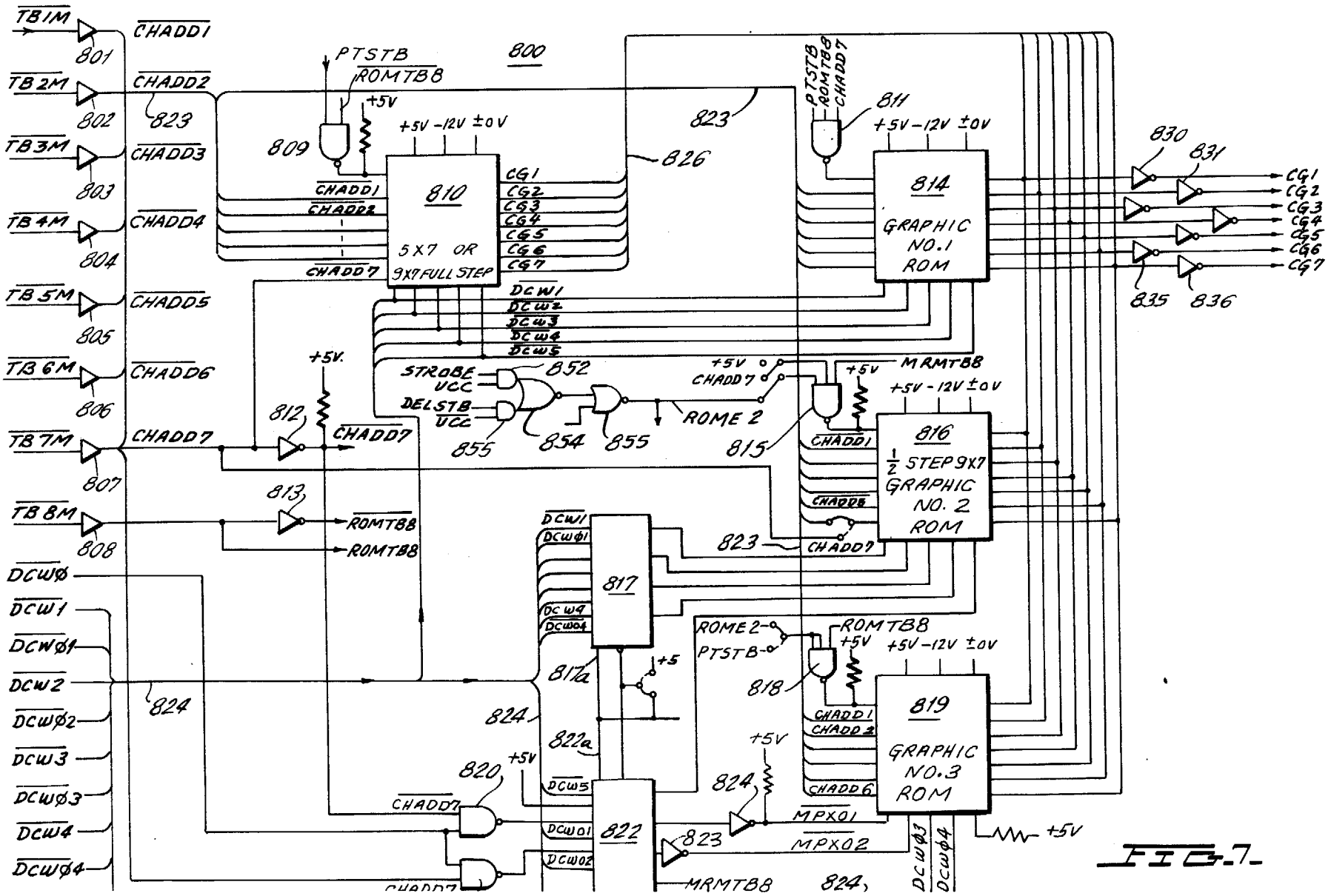
FIG. 7 is a block diagram showing the character generators and associated circuitry employed for printing 5 × 7 matrix characters, 9 × 7 matrix characters and segmented characters.

FIG. 7 shows the character generator array employed with the printer. A description of the character generator array employed with the printer. A description of the character generator array will now be given in conjunction with FIGS. 3*b* and 6. As shown in FIG. 3*b*, the outputs of forward register 351 and reverse register 352 are all applied to multiplexer 799. Multiplexer 799 is substantially identical to multiplexer 793 of FIG. 6 in that one series of inputs 799*a*-1 through 799*a*-8 are coupled to the outputs of forward registers 351 while the remaining set of inputs 799*b*-1 through 799*b*-8 are coupled to the outputs of reverse register 352. When printing in the forward mode, the forward drive signal FWDDV is applied to input 799*c* so as to couple input terminals 799*a*-1 through 799*a*-8 to output terminals 799*d*-1 through 799*d*-8, respectively. Thus, only the contents of the output stage of forward register 351 are passed by multiplexer 799. In the reverse print mode, the forward drive signal is removed causing the states of inputs 799*b*-1 through 799 *b*-8 to appear at outputs 799*d*-1 through 799*d*-8, respectively. Thus, the binary word at the output stage of reverse register 352 appears at the output of multiplexer 799. Turning to FIG. 8, these outputs, identified as $\overline{TB1M}$ - $\overline{TB8M}$ appear at similarly designated inputs shown in FIG. 8. These signals are inverted at 801–808. The signals appearing at the outputs of inverters 801–807 which are designated as $\overline{CHADD1}$ - $\overline{CHADD6}$ and CHADD7 are shown as being gathered at a common cable 823 which is coupled between inverters 801–807 and the character code receiving inputs of character generators 810, 814, 816 and 819.

The full and half-step column signals $\overline{DCW0}$ - $\overline{DCW5}$ and $\overline{DCW01}$ - $\overline{DCW04}$ appearing at the outputs of binary to decimal decoder 790 and parallel-in-to-parallel-out circuit 794, are coupled to the similarly designated inputs as shown in FIG. 8. These inputs (with the exception of $\overline{DCW0}$) are gathered in cable 824 for coupling the full and/or half-step column selection signals to character generators 810 and 814 and to the multiplexers 817 and 822. With the character generating circuit 800 of FIG. 7, it is possible to print normal characters and segmented characters which will be more fully described.

Let it be assumed that the printer is printing in the forward direction and is printing beginning at the extreme left-hand margin of the document for the purpose of printing 5 column × 7 row dot matrix characters. This will cause selection of the character generator 810 which may either be a 5 column × 7 row character generator or a 9 column by 7 row character generator, but for purposes of the present explanation, will be considered to be a 5 column by 7 row matrix character generator. All of the character generators are read-only-memories (ROMS) which are adapted to receive a character (binary) code at their character code inputs and are adapted to sequentially receive the dot column selection signals (DCW) at its remaining set of inputs. As soon as the printer is in the print mode, and the first character to be printed at the left-hand margin is shifted to its output stage in a manner described hereinabove, the binary code for that character will appear at terminals $\overline{TB1M}$ - $\overline{TB8M}$. When in the normal character mode the level at terminal $\overline{TB8M}$ will be low. This condition is inverted at 808 and at 813 to provide a low level $\overline{ROMTB8}$ signal which appears at the output of inverter 813 and which is applied to one input of gate 809. When a print strobe signal (PTSTB) appears at the remaining input of gate 809, character generator 810 will develop at its output terminals CG1-CG7 the dot column pattern determined by the character input (binary) code and the dot column selection signal. When printing in the forward mode the first dot column selection signal developed is $\overline{DCW1}$. This causes, upon the occurrence of the print strobe signal PTSTB, the first dot column of the character whose character code is applied to the character code input of character generator 810 to appear at the output terminals. These output terminals are combined into a cable 826 which can be seen to be ORed with the outputs of the remaining character generators 814, 816 and 819 so as to be applied to the solenoids of the print head through inverters 830–836. These signals will be either high or low in any predetermined combination to selectively control the energization of the solenoids for printing the first dot column of the character. The dot column selection signals are thereafter sequentially generated in the order mentioned hereinabove in connection with FIG. 6 until all five dot columns are printed, the printing of each dot column occurring in the precise print position under the control of the print strobe signal PTSTB. Upon the occurrence of the $\overline{DCW0}$ signal, the forward register is clocked to shift the next character into the output stage, which character code is applied to the input of character generator 810. The sequence is again repeated to print the next character. It should be understood that during the $\overline{DCW0}$ time, the print head is advanced but does not print to provide adequate spacing between the completed character and the next character to be printed.

When it is desired to provide the printer with the capability of printing 9-column by 7-row matrix characters, a full step character generator is provided at 810 and a half-step character generator is provided at 816. The full-step column selection signals are applied to character generator 810 in the same manner as was previously described. The half-step column position signals $\overline{DCW01}$ - $\overline{DCW04}$, as well as the full step column selection signals $\overline{DCW1}$ - $\overline{DCW5}$ are applied to multiplexers 817 and 822. When printing 9-column by 7-row matrix characters, inputs 817*a* and 822*a* of multiplexers 817 and 822 are coupled to the low level input through line 851 so as to pass only the $\overline{DCW01}$ - $\overline{DCW04}$ signals to the outputs of multiplexers 817 and 822 thus causing character generator 816 to provide the appropriate half-step dot column patterns for the print head solenoids. These half-step dot column patterns, together with the full-step dot column patterns developed by character generator 810, collectively print a 9 × 7 matrix character.

Expanded characters are simply double the width of normal characters whereby the $\overline{DCW1}$ signal is low for two successive data strobe signal times to print the first dot column pattern two times in succession. The second, third, fourth, and fifth dot column patterns are likewise printed two times in succession to print a double width or expanded character. When printing in the expanded character mode, gate 852 is enabled to cause NOR gate 854 to go low. During the print operation the $\overline{PRINT}$ signal is low causing the output of NOR gate 855 to go high to provide a high level to one input of gate 815. When the output of inverter 807 is high, indicating the presence of a CHADD7 signal, this condition is also applied to gate 815 whose final input receives MRMTB8 signal derived from one output of multiplexer 822 and which signal is utilized to select segmented characters to be set forth in detail hereinbelow.

The signal MRMTB8 described above is utilized to select the proper character generator for the octal 200 or octal 300 series of segmented characters.

Segmented characters are characters of double, triple or n-tuple height relative to normal height characters and when printing segmented characters graphic type character generators are employed at character generator positions 814, 816 and 819. Selection of segmented character patterns is obtained through the utilization of the 7th and 8th binary bit positions of the forward and/or reverse registers 351 and 352. The character code, while being an 8-bit code utilizes only the first six bits to represent the character desired to be printed. The 7th and 8th bits which provide four additional binary combinations, i.e., 00, 01, 10 and 11 are utilized to identify the same character, but of double or triple height. Decoding segmented characters is obtained through the use of the decoding gates 811, 815, 818, 820 and 854 which serve to selectively enable the character generators 814, 816 and 819.

Segmented character patterns and the manner of their formation is set forth in detail in copending application Ser. N0. 557,276 filed Mar. 11, 1975 and assigned to the assignee of the present invention. For purposes of understanding the present invention it is sufficient to understand that the same 6-bit binary code utilized to represent standard characters such as, for example, the standard alphanumeric set are utilized to represent segmented characters of double or triple height, for example, with the distinction between alphanumeric characters of the standard set and segmented characters being the utilization of the 7th and 8th bits of the code as identified by bits TB7 and TB8. By decoding these bits through the decoding logic gates described hereinabove, appropriate selection of the character generators is affected.

In addition thereto, segmented characters necessitate the capability of printing during the DCWO time, which is otherwise a time where spaces are provided between adjacent characters of normal size. By utilizing this time for printing, the printer is thus capable of forming a dot column pattern at any position on the paper document with segmented characters being constructed through the use of 6 × 7 (i.e., six dot column by seven dot row) matrices. Utilization of appropriate combinations of the 6 × 7 dot matrices which are generated by the read-only memories allows the generation of segmented characters.

The operation of the printer of the present invention may be summarized as follows:

Assuming initial turn-on of the equipment, and noting for example FIG. 4*e*, +5 volts is passed to resistor R1 to begin charging capacitor C1 to develop the signal PWR PRM which is used to initialize all of the counters, bistable flip-flops and the like. The power prime signal is applied through inverter 636 of FIG. 4*e* to bistable flip-flops 637 and 638. The output of 638*c* of bistable flip-flop 638 generates the signal PRIME 2 and $\overline{\text{PRIME 2}}$ which can be seen to clear bistable flip-flop 635 to generate the signal RTL which returns the print head to the left-hand margin. At the left-hand margin, a reed switch (not shown for purposes of simplicity) cooperates with a permanent magnet member mounted upon the carriage (not shown for purposes of simplicity) to activate the reed switch to generate the signal $\overline{\text{RTPSW}}$ which, for example, presets the bistable flip-flop 637 of FIG. 4*e*. This signal $\overline{\text{PRIME 2}}$ also is utilized to clear the head counter, shown in FIG. 6*a*.

With the head returned to the left-hand margin, the signal $\overline{\text{RTPSW}}$ is applied to inverter 656 and gate 650 of FIG. 4*f* and is thereafter coupled to gate 649, 651 and 653 to bistable flip-flop 654 to develop the signal PRIME at terminal 654*b* which goes high at this time, causing the signal $\overline{\text{PRIME}}$ at output 654*c* to go low. The high PRIME and the low $\overline{\text{PRIME}}$ signals are utilized to either preset or clear selected circuits which require initializing. For example, the prime signals are applied to gate 663 of FIG. 4*f* to deactive the light detector circuitry. The loading and print control circuitry of FIG. 4*b* likewise receives a prime signal at gate 535 to reset bistable flip-flops 536, 537, 512, 513, 516 and 540.

The $\overline{\text{PRIME}}$ signal is also applied to terminal 311 of FIG. 3*a* to initialize the control function decoding circuit 301.

At this time the data source may initiate transfer of both function codes and data to the printer. Transmission of a select code is responded to by the generation of an acknowledge signal ACK indicating to the data source that the printer has been initialized and is ready to accept data.

Data may be transmitted in either serial or parallel form. In the case where data is transmitted parallel by word, an 8-bit binary word is applied to the inputs DSC1-DSC8 of the function decoding circuit 301, shown in FIG. 3*a*. In the case where data is transmitted in serial fashion, i.e., serial by bit, a serial to parallel converter (not shown for purposes of simplicity) may be utilized in order to present binary words in parallel form to the function decoder circuit. Data words appear at the outputs of inverters 302-1 through 302-8 to be applied to the respective inputs $\overline{\text{DSL}}$ - $\overline{\text{DS8}}$ of forward register 351. As shown in FIG. 3*b*, both the forward and reverse shift registers 351 and 352 likewise initially receive the PRIME signal which is applied to the clear inputs of the shift registers to clear them prior to receipt of data.

Noting FIG. 3*c*, it can be seen that the signal $\overline{\text{PRIME}}$ is applied to bistable flip-flop 401 whose output 401*b* goes high to develop the dummy character signal DMC. This signal is applied to gate 353 of FIG. 3*b* to load in the dummy character before the transfer of data to the forward register 351.

The function decoder circuit 301 of FIG. 3*a* develops the signal $\overline{\text{CLKTB1}}$ at the output of inverter 334 which is applied to gate 408 of FIG. 3*c* to apply clocking pulses for shifting data into the forward register.

When the dummy character reaches the output stage of forward register 351, the output of inverter 354-9 (signal DSR8) is high. This condition is applied to bistable flip-flop 414 of FIG. 3*c* whose output 414*b* goes high to enable gate 422 and inverter 423 to develop the CSBSY (cause busy signal) which is coupled to function decoder 301 to develop the busy signal at inverter 335 to prevent the acceptance of any further data from the data source. The complement of the output of inverter 354-8 appears at the output of inverter 355-8 as a signal $\overline{\text{SR8}}$. This signal is applied to gate 417 of FIG. 3*c* setting bistable flip-flop 418 and enabling gate 419 and inverter 420 to develop the signal RECCON enabling the forward register to be operated in the closed loop recirculation mode. The high level at output 414*b* of bistable 414 sets bistable flip-flop 421 causing the output of bistable flip-flop 423 to go high upon the occurrence of the next OSC1 pulse to develop the signal GCEN at output 423*c*. This enables gate 424 to pass OSC1 pulses identified as the signal $\overline{\text{SYNSPN}}$ which pulses are applied to counter 425 and gate 408. These pulses are utilized as clock pulses by forward register 351 with a cumulative count of the number of pulses passed being developed by counter 425. During the first spin or recirculation cycle of forward register 351, the left and right-hand end points of the character field are determined. As shown in FIG. 4, the signal $\overline{\text{CCEN}}$ developed by the output 423*d* of bistable flip-flop 423 shown in FIG. 3*c*, to enable $\overline{\text{OSC2}}$ pulses to be passed to counter 455 as the forward register is being spun. The accumulated count of counter 455 is continuously passed by latch circuit 463 to comparator 464 until the first nonzero character is detected by decoding gate 356 of FIG. 3*b*. This signal is applied through inverter 467 to bistable flip-flop 468 of FIG. 4 to develop the signal LCEN at the output 468*c* to cause latch circuit 463 to retain at its outputs the last binary count representative of the left-hand end of the data field. As was previously described, the circuitry including the bistable flip-flops 468, 471 and 472 prevent any spaces decoded after decoding, of the left-hand most character of the character field, from erroneously operating latch circuit 463.

The count of counter 455 is continuously applied to comparator 476 until a binary code representative of the end of the character field (if less than an entire line of characters is to be printed) or until a full spin count has been derived. These conditions are applied to gate 453 of FIG. 4 to input 455*b* of counter 455 to prevent any further counts from being passed by the counter. This count is retained as representative of the right-hand end of the character field and is applied to respective inputs of comparator 476.

Under the assumption that the printer has just been turned on, initialized and has received a first line of characters, since the print head is at the left-hand margin of the paper document, printing will occur in the forward direction due to the presence of the $\overline{\text{RTPSW}}$ signal which is applied to bistable flip-flops 502 and 497 of FIG. 4*a* causing the signal FWDDV at output 502*c* to be high. This condition also prevents further spinning of the forward register since reversing the order of the binary data representative of characters to be printed is not required under these conditions.

Since the print head has been moved to the left-hand margin of the paper document, the signal RTL, is removed and, upon completion of one full spin of forward register 351, gate 432 of FIG. 3*c* is enabled to set bistable flip-flop 434. The signal $\overline{\text{EOSPN1}}$ appearing at output 434*c* is applied to one input of gate 670, shown in FIG. 4*c* to develop the enable load signal ENLD which is applied to gate 534 of FIG. 4*b* to develop the $\overline{\text{LOAD}}$ at the output of gate 506. This signal is applied to input 450*a* of counter 450 and input 451*a* of counter 451 to "set" the contents of head counter 775 of FIG. 6*a* into the up and down counters. At this time the count in head counter 775 will be 0 due to the fact that the print head is at the left-hand margin of the paper document. The presence of the forward drive signal $\overline{\text{FWDDV}}$ is applied to gate 511 of FIG. 4*b* to set bistable flip-flop 516 to develop the clutch enable signal CLEN which is applied to gates 608 and 611 of FIG. 4*d*. Only gate 608 will be enabled causing gate 613 to be enabled in order to generate the forward clutch drive signal $\overline{\text{FWDCLD}}$ to engage the forward clutch and thereby drive the print head in the forward direction. Printing will occur as soon as the head passes over the left-hand end point of the character field generating the signal HGL at the output of comparator 464 shown in FIG. 4. Since the position of the print head, when over the left-hand most point of the character field is interpreted herein as being greater than the left-hand end point, this signal is utilized to initiate printing. This signal is applied to gate 489 of FIG. 4*a* to set bistable flip-flop 494 and develop the $\overline{\text{PRINT}}$ signal at the output of gate 670.

With the head moving in the forward direction, the optical registration apparatus develops the channel 1 and channel 2 pulses as the photodetectors detect light passing through their respective associated registration slits. These signals are applied to the $\overline{\text{CHANO1}}$ and $\overline{\text{CHANO2}}$ inputs of FIG. 5*a*, are differentiated to develop narrow pulses at the leading and trailing edges of each slit of each array appearing at the outputs of one-shot multivibrators 704 and 714. The output of one-shot multivibrator 707 is applied to inverter 727 of FIG. 5*c* to set one-shot multivibrators 728 and 729 in succession in order to develop a strobe signal and its complement $\overline{\text{STROBE}}$. The $\overline{\text{PRINT}}$ and $\overline{\text{STROBE}}$ signals are applied to gate 899 of FIG. 7 to generate the print strobe PTSTB signal which is applied to read-only memory 810 which functions as the 5 × 7 character generator. The "artificial" pulse, developed by gate 726 (FIG. 5*b*) as the print head starts to move, assures correct positioning of the dot columns.

The circuitry of FIG. 5*a* also decodes the channel 1 and channel 2 pulses from the registration apparatus to determine that the head is travelling in the forward direction. This signal is applied to gates 752 and 780 of FIG. 6 in order to generate the dot column position signals $\overline{\text{DCWO}}$ through $\overline{\text{DCW5}}$ in the proper or forward drive order in order to step out the dot column patterns from character generator 810 in the order in which printing should occur, which in this case is in the forward direction.

Printing continues until comparator 476 detects the fact that the head has passed the right-hand end of the character field, at which time the forward clutch is deenergized and the brake is energized to bring the print head to a halt about five character positions beyond the right-hand end of the character field.

Let it be assumed that the right-hand end of the character field just printed terminates at character position 100. Assuming a printer having 132 character print line capacity, the print head will come to a halt at character position 105. The next line of information is then fed into the forward register in the form of binary coded data, the forward register is spun once to determine the end points of the character field and the binary values of the end points are established by counter 455 of FIG. 4 as was described hereinabove. These end point values are compared against the binary count representative of the print head position by comparators 464 and 476. Comparator 476 will develop the HGR indicating that the print head lies to the right of the right-hand end of the character field. This immediately indicates that printing must occur in the reverse direction. The loading of the contents of the head position counter (see FIG. 4*b*) conditions gates 510 and 511. At this time the signal HGL will be high, since the print head is located to the right hand of the left-hand end of the character field, this condition causes the output 507*c* of flip-flop 507 in FIG. 4*a* to go low driving the output 502*d* of bistable flip-flop 502 high. At the same time, output 502*c* goes low. This causes gate 510 to be disabled while enabling gate 511 to generate a reverse data signal ($\overline{\text{RVDAT}}$). This signal is applied to the preset input 421*c* of bistable flip-flop 421 shown in FIG. 3*c* which enables gate 424 to pass OSC1 pulses through gate 408 to continue spinning forward register 351. Each completed spin is detected by counter 425 and the decoding circuitry connected thereto to provide a spin clock signal ($\overline{SPNCLK}$) at the output of gate 432 which is passed by gate 433 and inverter 434 in order to clock the reverse register 352 by means of the $\overline{CLKTBR}$ signal appearing at the output of inverter 434. The signal for each completed spin is accumulated by counter 436. The decoding circuitry coupled thereto keeps a count of the number of completed spins in order to provide an indication at the output of gate 439 shown in FIG. 3*c* of completion of transfer of data from the forward register to the reverse register with the data being arranged in the reverse order in order to accomplish printing in the reverse direction.

The circuitry of FIG. 5*a* functions to generate two pulses per registration slit as well as determining direction of movement of the print head whereby the signal $\overline{FWD}$ is high when moving in the reverse direction. This signal is applied to gates 751 and 781, shown in FIG. 6, to operate counters 750 and 776 in the down count direction so as to ultimately reverse the order of generation of the dot column selection signals so as to occur in the order $\overline{DCW0}$, $\overline{DCW5}$, $\overline{DCW4}$, . . . $\overline{DCW1}$. These signals are applied to character generator 810, for example, in the order set forth hereinabove as each binary coded character is applied to other respective inputs of the character generator in order to generate the 5 dot column patterns in reverse order due to the fact that printing is occurring in the reverse direction. The $\overline{DCW0}$ signal developed by the decoder gates 768 and 761 of FIG. 6 serve to simultaneously force counters 750 and 776 in the octal zero condition as well as to provide the clock up and clock down pulses. In the present instance the clock down pulses are utilized to decrement the head counter due to movement of the print head in the reverse direction.

Comparators 464 and 476 compare the count of the head counter against the end points of the character field to start printing "on the fly" as soon as the signal HLR is developed by comparator 476 to being printing in the reverse direction.

Assuming the next line of characters is completed at head position 20, the reverse clutch is disengaged and the brake is engaged to stop the print head at position 15. The next group of data is then loaded into the forward register, the forward register is spun to determine the field end points for determining the direction of printing. Assuming the left-hand end point of the character field is position 10, the print head is within the character field causing comparators 464 and 476 to develop the signals HGL and HLR (see FIG. 4). The count in head counter 775 is "set" into counters 450 and 451 and the HGL and HLR signals are applied to gate 479 of FIG. 4*a* to enable the up-down counters 450 and 451 of FIG. 4 to be simultaneously decremented and incremented by OSC2 pulses passed by gate 479. Flip-flop 481 is also enabled to develop a WAIT signal. The first one of the counters 450 and 451 to develop a count equal to the count position of the head counter determines the direction which the head should move.

With the head closer to the left-hand end point of the character field, the signal HEL will first be developed by comparator 464. Comparator 476 can not develop the signal HER (see FIG. 4). The signal HEL is applied to gate 483 of FIG. 4*a* to activate multivibrator 486 to develop the output OSR at terminal 486*b*. This signal is utilized together with the WAIT signal and the signal indicating the direction of movement by the gating circuitry of FIG. 4*d* to initially deactivate the brake and drive the print head in the reverse direction so as to pass the left-hand end of the character field. As soon as the print head passes the left-hand end of the character field, comparator 464 of FIG. 4 develops the signal HLL indicating that the head now lies to the left of the left-hand end of the character field indicating that printing should occur in the forward direction. Under these circumstances, only a single spin of the forward register 351 occurs. The head is abruptly brought to a stop at character position 5 and the brake is energized. Thereafter the brake is deenergized and the head is moved in the forward direction, printing "on the fly" as the signal HEL is generated.

Printing will continue until the signal HER is developed by comparator 476. This signal is applied to gate 490 and is caused to reset bistable flip-flop 494 through gates 491 and 493 to deactivate the $\overline{PRINT}$ signal.

Let it now be assumed that the right-hand end of the character field ends at character position 80. The forward clutch is deenergized and the brake is energized causing the print head to come to a halt at character position 85.

The next group of data is then loaded into the forward register which is spun once to determine the end points of the character field. Let it be assumed that the right-hand end point of the character field occupies character position 90. The circuitry described hereinabove will then initially move the head in the forward direction, spin the forward register through 133 cycles to reverse the order of the data as it is transferred into the reverse register, and bring the print head to a halt at character position 90. The brake will then be deenergized, the reverse clutch energized and printing will occur "on the fly" as the head moves in the reverse direction with the dot column sequencing signals $\overline{DCW0}$ - $\overline{DCW5}$ being generated in reverse order.

Assuming that the next line of print is to consist of expanded characters, if less than 66 expanded characters are loaded into forward register 351, printing can occur in either the forward or the reverse direction. However, if more than 66 character codes are transferred into the forward register, the circuitry of FIG. 4*e* returns the print head to the left-hand margin by generation of the signal RTL as a result of the presence of the signal EXCHST which is developed at the output of inverter 518 whenever counter 455 develops a count greater than 133. Since the codes for expanded characters are identical to normal characters, forward register 351 can accept up to a maximum of 132 character codes before indicating a busy condition. However, as was mentioned hereinabove, the signal RTL automatically moves the print head to the left-hand margin of the paper document regardless of the position occupied by the print head at that time. Printing occurs in the forward direction until a maximum of 66 expanded characters are printed, at which time an end of print signal $\overline{EOPSW}$ is generated causing the head to return to the left-hand print margin from the right-hand print margin to print expanded characters in excess of the number capable of being printed on a single line.

It can be seen from the foregoing description that the present invention provides the novel random access printer which utilizes novel logic and decoding circuitry to enable its bidirectional print head to move substantially the shortest distance practical in printing succeeding lines of characters to thereby reduce the amount of travel experienced by the print head during non-printing movement, to a minimum.

What is claimed is:

1. Registration apparatus for use with line printers having means for supporting and feeding a paper document;

print head means for printing characters on said document;

a carriage supporting said print head in close proximity to said document supporting means and means for moving said carriage relative to said document to effect printing of a line;

said registration apparatus comprising:

an elongated stationary registration strip positioned in spaced substantially parallel fashion relative to said supporting means, said strip having a plurality of uniformly spaced slits each separated from adjacent slits by opaque bars, said slits being adapted to pass light therethrough;

housing means mounted on said carriage and movable therewith;

said housing means having a slot for receiving said strip;

first and second chambers being provided in said housing means on opposite sides of said slot;

a light source being mounted in said first chamber;

said first chamber having an opening communicating with said slot to cause light from said source to impinge on said strip;

photodetector means mounted in said second chamber;

said second chamber having a narrow rectangular opening communicating with said slot for passing light passing through only one slit in said strip at any given instant to activate said photodetector means for generating a pulse to actuate said print head means for printing characters at precise locations along said document;

said paper document is being adapted to have a maximum number $n$ of characters printed on each line;

said strip having $n/2$ slits;

said photodetector means being adapted to generate a pulse as said rectangular opening passes each slit whereby the leading edge of said pulse occurs as said opening passes one edge of a slit and wherein the trailing edge of the pulse occurs as the rectangular opening passes the opposite edge of the slit;

circuit means coupled to said photodetector means for generating a first narrow pulse responsive to the leading edge of the pulse generated by said photodetector means and for generating a second narrow pulse responsive to the trailing edge of the pulse generated by said photodetector means, said first and second narrow pulses being of substantially equal pulse width and being of a pulse width which is substantially narrower than the pulse width of the pulse generated by said photodetector means;

the output of said circuit means being coupled to said print head means to enable the print head means twice for each slit passed by said rectangular opening.

2. The registration apparatus of claim 1 wherein said light source is a light emitting diode.

3. The registration apparatus of claim 1 wherein said narrow opening is substantially parallel to said slits and the width of said opening is substantially equal to the width of said slits.

4. The registration apparatus of claim 1 wherein said circuit means comprises:

first differentiation means coupled to said photodetector means;

first one-shot multivibrator means coupled to said differentiation means for generating said first narrow pulse when the output of said first differentiation means reaches a first threshold level;

first invertor means coupled to said photodetector means for inverting the output of said photodetector means;

second differentiation means coupled to said first invertor means;

second one-shot multivibrator means coupled to said second differentiation means for generating said second narrow pulse when the output of said second differentiation means reaches a predetermined threshold, whereby narrow pulses are generated at the edges of every slit.

5. Registration means for accurately controlling the printing of characters in a line printer comprising;

first means for supporting a paper document;

second means for feeding a paper document in a first direction;

a print head for printing characters;

carriage means and means for selectively moving said carriage in either a forward or reverse printing direction said printing direction being transverse to the direction of movement of the paper document;

an elongated registration strip having uniformly spaced transparent slits, said strip being mounted in spaced parallel fashion relative to the portion of the surface of the paper document upon which printing is occurring;

housing means mounted upon said carriage for movement therewith, said housing means having a narrow slot for receiving said strip;

first and second chambers positioned on one side of said slot and having openings communicating with said slot;

a first and a second light source each respectively mounted in said first and second chambers for directing light into said slot;

third and fourth chambers positioned on the opposite side of said slot, each having a narrow opening communicating with said slot;

first and second photodetectors respectively mounted within said third and fourth chambers each being activated by light passing through a slit and the respective opening of the chamber in which the photodetector is mounted;

the openings of said third and fourth chambers being arranged in an offset manner to cause said photodetectors to be activated in a one-at-a-time fashion regardless of the direction of movement of said carriage means;

decoding circuit means coupled to said first and second photodetectors being responsive to the output pulses developed by the photodetectors to generate a signal representing the direction of movement of said carriage.

6. The device of claim 5 wherein said circuit means further comprises means for generating narrow pulses each occurring at the edges of said slits;

means coupling said means for generating narrow pulses to said print head to enable printing only during the occurrence of a narrow pulse.

7. Registration means for accurately controlling the printing of characters in a line printer comprising:

first means for supporting a paper document;

second means for feeding a paper document in a first direction;

a print head for printing characters;

carriage means and means for selectively moving said carriage in either a forward or reverse printing direction said printing direction being transverse to the direction of movement of the paper document;

an elongated registration strip having first and second arrays each comprised of uniformly spaced transparent slits, said strip being mounted in spaced parallel fashion relative to the portion of the surface of the paper document upon which printing is occurring;

each slit of said first array being offset relative to an associated slit of said second array;

housing means mounted upon said carriage for movement therewith, said housing means having a narrow slot for receiving said strip;

first and second chambers positioned on one side of said slot and having openings communicating with said slot and each arranged to pass along a different one of said arrays as the carriage is moved;

first and second light sources respectively mounted in said first and second chambers for directing light into said slot;

third and fourth chambers positioned on the opposite side of said slot, each having a narrow opening communicating with said slot and each arranged to pass along a different one of said arrays as the carriage is moved;

first and second photodetectors respectively mounted within said third and fourth chambers each being activated by light passing through a slit and the respective opening of the chamber in which the photodetector is mounted;

the openings of said third and fourth chambers being aligned with one another to cause said photodetectors to be activated in a one-at-a-time fashion regardless of the direction of movement of said carriage means;

decoding circuit means coupled to said first and second photodetectors being responsive to the output pulses of said photodetectors to generate a signal representing the direction of movement of said carriage.

8. The device of claim 7 wherein said circuit means further comprises means for generating narrow pulses occurring at each of the edges of said slits;

means coupling said narrow pulses to said print head to enable printing only during the occurrence of a narrow pulse.

9. A line printer comprising means for supporting a paper document;

means for moving said paper document in a first direction along said supporting means;

a carriage reversibly movable in a direction transverse to said first direction to traverse said document;

means for selectively driving said carriage in either a forward or reverse direction;

a print head mounted on said carriage for sequentially printing characters in either said forward or reverse direction;

registration means positioned in substantially spaced parallel fashion relative to said supporting means; said registration means having registration marks each representing a printing position;

optical means mounted on said carriage and traversing said registration means for generating a signal as said optical means passes each mark during movement of the carriage;

first bidirectional counting means coupled to said optical means for generating a cumulative count of print positions representative of the position of said print means along the paper document;

means coupled to said optical means for determining the direction of movement of said carriage to respectively increment or decrement said counting means;

first register means for receiving binary words representative of the graphic information to be printed on a line of said document;

carriage braking means and means responsive to termination of a line of print for activating said braking means to abruptly halt said carriage means;

means coupled to said first register means for determining the end points of a line of graphic information stored in said first register means;

first and second storage means coupled to said end point determining means for storing binary information representative of said end points;

means for comparing said end point binary information with the count in said first counting means to generate a signal for controlling the direction of movement of said carriage means for printing the graphic information stored in said register means whereby said carriage is moved towards the closest one of said end points.

10. The apparatus of claim 9 further comprising second register means;

means for transferring the contents of said first register means to said second register means when said comparison means generates a signal to indicate printing in the reverse direction;

said transferring means including means for reversing the order of the binary words in said second register means for controlling the operation of said print head;

means responsive to the direction of printing for selectively coupling only one of said first and second register means to said print head control means.

11. The apparatus of claim 10 wherein said comparison means includes means for generating a first signal when said print head lies to the same side of both of said end points;

said selective driving means being coupled to said comparison means for moving said carriage towards the closest end point responsive to said first signal.

12. The apparatus of claim 10 wherein said comparison means comprises means for generating a first signal when said print head is positioned between said end points;

means responsive to said first signal for simultaneously transferring the contents of said first counting means into second and third counters;

said transferring means further comprising stepping means for incrementing the count in said second counter and for decrementing the count in said third counter at the same rate;

said comparison means including a first comparator coupled to said second counter and said first storage means and a second comparator coupled to said third counter and said second storage means; and each comparator being adapted to generate a comparison signal when the count in its associated counter equals the count in its associated storage means;

means responsive to the first comparison signal to be generated to disable said stepping means and thereby terminate the incrementing and decrementing operation;

means responsive to the first generated comparison signal to operate said driving means to move said carriage toward the direction of closest end point position;

said comparison means including means for generating a signal when the count in said first counting means equals the count in the storage means which represents the end point towards which the print head is moving to de-activate said driving means and activate said braking means;

said comparison means including means for generating a second signal when the count in said first counting means is either greater or smaller than the count in both of said first and second storage means to activate said driving means to move said carriage means towards the closest end point of the next line of graphic information to be printed.

13. The apparatus of claim 9 further comprising character generator means;

means responsive to said optical means for sequentially transferring each binary word in said first register means to said character generator means for converting said binary word into signals representing the graphic information to be printed;

means coupling said print head to said character generator means for printing the graphic information developed by said character generator.

14. The apparatus of claim 13 wherein said print head comprises print wires for impacting said paper document and printing drive means for driving each print wire;

said character generator means comprising means for successively generating a plurality of dot patterns collectively representing the characters to be printed responsive to the binary word applied to said character generator;

means coupled to said optical means for generating sequential stepping signals coupled to said character generator means for generating one dot pattern at a time responsive to the sequential stepping signals.

15. Registration apparatus for use with line printers having means for supporting and feeding a paper document;

print head means for printing characters on said document;

a carriage supporting said print head in close proximity to said document supporting means and means for moving said carriage relative to said document to effect printing of a line;

said registration apparatus comprising:

an elongated stationary registration strip positioned in spaced substantially parallel fashion relative to said supporting means, said strip having a plurality of uniformly spaced slits each separated from adjacent slits by opaque bars, said slits being adapted to pass light therethrough;

housing means mounted on said carriage and movable therewith;

said housing means having a slot for receiving said strip;

first and second chambers being provided in said housing means on opposite sides of said slot;

a light source being mounted in said first chamber;

said first chamber having an opening communicating with said slot to cause light from said source to impinge on said strip;

photodetector means mounted in said second chamber;

said second chamber having a narrow rectangular opening communicating with said slot for passing light passing through only one slit in said strip at any given instant to activate said photodetector means for generating a pulse to actuate said print head means for printing characters at precise locations along said document;

said paper document is being adapted to have a maximum number n of dots printed on each line;

said strip having n/2 slits;

said photodetector means being adapted to generate a pulse as said rectangular opening passes each slit whereby the leading edge of said pulse occurs as said opening passes one edge of a slit and wherein the trailing edge of the pulse occurs as the rectangular opening passes the opposite edge of the slit;

circuit means coupled to said photodetector means for generating a first narrow pulse responsive to the leading edge of the pulse generated by said photodetector means and for generating a second narrow pulse responsive to the trailing edge of the pulse generated by said photodetector means, said first and second narrow pulses being of substantially equal pulse width and being of a pulse width which is substantially narrower than the pulse width of the pulse generated by said photodetector means;

the output of said circuit means being coupled to said print head means to enable the print head means twice for each slit passed by said rectangular opening.

16. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. reversing the order of the stored data when the first count is greater than both the second and third counts;

f. moving the head in the reverse direction towards the closest end point of the data field end point.

17. The method of claim 16 further including the steps of:

initiating printing as soon as the first count equals the second count, whereby the head begins printing only after the head reaches a predetermined velocity to assure that printing occurs "on the fly".

18. The method of claim 17 further including the steps of:

terminating printing when the first count equals the third count; and abruptly halting the head in readiness for printing the next line.

19. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. moving the head in the forward direction towards the closest data field end point when the first count is less than both the second and third counts.

20. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. reversing the order of the stored data when the first count is equal to the third count;

f. moving the head in the forward direction;

g. decelerating the head when the first count is greater than the third count whereby the head is halted after moving a first minimum distance;

h. reversing the movement of the head and initiating printing as soon as the first count equals the third count whereby the minimum distance allows the head to reach a predetermined velocity to assure printing "on the fly".

21. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. moving the head in the reverse direction when the first count equals the second count;

f. decelerating the head when the first count is less than the second count whereby the head is halted after moving a first minimum distance;

g. reversing the movement of the head and initiating printing as soon as the first count equals the second count to allow the head to move through said minimum distance towards the closest end point to reach a predetermined velocity and thereby assure that printing occurs "on the fly".

22. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. transferring the first count to a pair of counters and incrementing and decrementing the pair of counters at the said rate;

f. respectively comparing the incremented and decremented counts to the second and third counts;

g. terminating the incrementing and decrementing as soon as either the incremented first count equals the third count or the decremented first count equals the third count;

h. reversing the order of the data field;

i. moving the head in the forward direction when the incremented first count equals the third count;

j. decelerating the head when the first count equals the third count to allow the head to move a first minimum distance;

k. reversing the movement of the head and initiating printing as soon as the head has moved said first minimum distance to allow the head to reach a predetermined velocity and thereby assure that printing occurs "on the fly".

23. Method for operating the print head of a bidirectional printer comprising the steps of:

a. monitoring the movement and position of the head to generate a discrete first count representing the location of the head at every instant of time;

b. sequentially receiving and storing the data field of the next line of data to be printed;

c. locating the end points of the stored data field and developing second and third counts representative of the location of the data field left and right-hand end points;

d. comparing the first count with said second and third counts;

e. transferring the first count to a pair of counters and incrementing and decrementing the pair of counters at the said rate;

f. respectively comparing the incremented and decremented counts to the second and third counts;

g. terminating the incrementing and decrementing as soon as either the incremented first count equals the third count or the decremented first count equals the second count;

h. moving the head in the reverse direction when the decremented first count equals the second count;

i. deceleratiang the head when the first count equals the second count to allow the head to move a first minimum distance after the occurrence of equality between the first and second counts;

j. reversing the movement of the head and initiating printing as soon as the head has moved said first minimum distance to allow the head to reach a predetermined velocity and thereby assure that printing occurs "on the fly".

24. In a line printer having means for supporting a paper document; a print head for printing data on a paper document and means for moving the print head across the document, combined registration and direction determining means comprising;

a registration strip having at least one array of uniformly spaced slits arranged along the path of movement of said print head;

sensing means movable with said print head along said strip and cooperating with said registration strip for generating first and second signals being out of phase and having a predetermined substantially uniform phase offset;

said print head including means for printing on the paper;

means coupled to said sensing means for generating and enabling pulses as the sensing means passes each slit for enabling printing only in registration with said slits;

means coupled to said sensing means and responsive to said first and second signals for generating a direction signal representing the direction of movement of the print head;

means for storing information representing the data to be printed;

means responsive to the direction signal for controlling the order in which the stored information is utilized to control said print head.

25. The device of claim 24 wherein said registration means comprises a second array of uniformly spaced slits, the spacing of both arrays being equal;

the slits of said arrays being offset to obtain said electrical phase offset.

26. The device of claim 24 wherein said sensing means comprises first and second photosensing means for sensing light passing through said arrays;

mask means for each photosensing means said mask means each having narrow slits to permit light to reach said photosensing means when said registration slits pass said mask slits;

said mask slits being substantially parallel to said registration slits and being spaced apart a distance selected to provide said electrical phase offset.

27. In a line printer having means for supporting a paper document; a print head for printing data on a paper document and means for moving the print head across the document, combined registration and direction determining means comprising;

a registration strip having at least one array of uniformly spaced slits arranged along the path of movement of said print head;

sensing means movable with said print head along said strip and cooperating with said registration strip for generating first and second signals being out of phase and having a predetermined substantially uniform phase offset;

said print head including means for printing on the paper;

means coupled to said sensing means for generating and enabling pulses as the sensing means passes each slit for enabling printing only in registration with said slits;

means coupled to said sensing means and responsive to said first and second signals for generating a direction signal representing the direction of movement of the print head;

said first and second signals being defined by a waveform of rectangular shaped pulses each associated with one of said slits and whose leading and trailing each edge coincides with a leading and trailing edge of a slit;

said enabling pulse generating means including first and second means each generating narrow enabling pulses responsive to and coinciding with the leading and trailing edges of said rectangular pulses whereby printing is enabled at locations coinciding with the edges of each slit.

* * * * *